US007247422B2

(12) United States Patent
Suzuki

(10) Patent No.: US 7,247,422 B2
(45) **Date of Patent: *Jul. 24, 2007**

(54) HEAT—DEVELOPABLE PHOTOSENSITIVE MATERIAL CONTAINING LATEX POLYMER IN OUTERMOST LAYER

(75) Inventor: Keiichi Suzuki, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/819,260

(22) Filed: Apr. 7, 2004

(65) Prior Publication Data

US 2004/0234911 A1 Nov. 25, 2004

(30) Foreign Application Priority Data

Apr. 10, 2003 (JP) ..... 2003-106162

(51) Int. Cl.
*G03C 1/76* (2006.01)
*G03C 1/498* (2006.01)

(52) U.S. Cl. ..... 430/523; 430/531; 430/535; 430/536; 430/619

(58) Field of Classification Search ..... 430/523, 430/531, 535, 536, 619
See application file for complete search history.

(56) References Cited

U.S. PATENT DOCUMENTS 4,113,854 A 9/1978 Andrews et al.
6,140,038 A * 10/2000 Ishizuka et al. ..... 430/619
6,156,491 A 12/2000 Goto
6,261,754 B1 7/2001 Ishigaki et al.
6,582,898 B2 6/2003 Morita
6,821,720 B2 * 11/2004 Iwado ..... 430/523
2001/0051319 A1 12/2001 Oya et al.
2003/0232288 A1 12/2003 Oka et al.
2004/0126717 A1 * 7/2004 Nakagawa et al. ..... 430/523

FOREIGN PATENT DOCUMENTS

EP 1041434 A 10/2000
EP 1306720 A 5/2003
EP 1308776 A 5/2003
JP A 10-312038 11/1998
JP A 11-84573 3/1999
JP A 11-282123 10/1999
JP A 2001-194744 7/2001

OTHER PUBLICATIONS

Dewent-ACC-No. 1982-18594E.

* cited by examiner

*Primary Examiner*—Thorl Chea
(74) *Attorney, Agent, or Firm*—Margaret A. Burke; Sheldon J. Moss

(57) ABSTRACT

The present invention provides a ehat-developabel photosensitive material comprising a support having provided thereon an image forming layer containing a photosensitive silver halide, a non-photosensitive organic silver salt, a reducing agent, and a binder, wherein a binder of an outermost layer at a side of the support at which the image forming layer is provided includes a latex polymer such as an ionomer type urethane polymer latex in an amount of 85 mass % or more, preferably 90 mass % or more, and more preferably 95 mass % or more. The heat-developable photosensitive material may also have a layer adjacent to the outermost layer which layer contains a binder that gels due to temperature reduction or contains a binder containing a water-soluble polymer derived from animal protein in an amount of 50 mass % or more.

12 Claims, No Drawings

HEAT—DEVELOPABLE PHOTOSENSITIVE MATERIAL CONTAINING LATEX POLYMER IN OUTERMOST LAYER

CROSS-REFERENCE TO RELATED APPLICATION

This application claims priority under 35 U.S.C. 119 from Japanese Patent Application No. 2003-106162, the disclosure of which is incorporated by reference herein.

BACKGROUND OF THE INVENTION

1. Field of the Invention

The present invention concerns a heat-developable photosensitive material.

2. Description of the Related Art

In recent years, it has been strongly demanded to decrease the volume of processing liquid wastes in the medical field from the viewpoint of environmental protection and space saving. Thus, technology for photosensitive heat-developable materials for use in medical diagnosis and photographic applications which are capable of being exposed efficiently by laser image setters or laser imagers and are capable of forming clear black images having high resolution and sharpness is required. Such photosensitive heat-developable materials can eliminate the use of solution-based processing chemicals and can provide customers with a thermal development processing system which is simple and does not harm the environment.

While such requirements also exist in the field of general image forming materials, images for medical use particularly require high image quality of excellent sharpness and graininess since fine expression is needed, and images of cold black tone are preferred to facilitate diagnosis. At present, various kinds of hard copy systems that utilize pigments and dyes such as ink jet printers or electrophotographic systems have been marketed as conventional image forming systems, but they are not satisfactory as image output systems for medical use.

Thermal image forming systems utilizing organic silver salts are described in various documents (for example, refer to U.S. Pat. Nos. 3,152,904, 3,457,075, and "Thermally Processed Silver System" written by D. Klosterboer, appearing in "Imaging Processes and Materials", Neblette, 8th edition, edited by J. Sturge, V. Walworth, and A. Shepp, Chapter 9, page 279, 1989). In particular, a heat-developable photosensitive material generally has an image forming layer in which a catalytically active amount of photocatalyst (for example, silver halide), a reducing agent, a reducible silver salt (for example, organic silver salt) and, if necessary, a color toning agent for controlling the tone of silver are dispersed in a binder matrix. The heat-developable photosensitive material, when heated to a high temperature (for example, 80° C. or higher) after imagewise exposure, forms black silver images by redox reaction between a silver halide or reducible silver salt (functioning as an oxidizer) and a reducing agent. The redox reaction is promoted by the catalytic effect of latent images of the silver halide formed by exposure. Accordingly, black silver images are formed in exposed regions (for example, refer to U.S. Pat. No. 2,910,377 and Japanese Patent Application Publication (JP-B) No. 43-4924). Fuji Medical Dry Imager FM-DP L has been sold as an image forming system for medical use utilizing a heat-developable photosensitive material.

Production of thermal image forming systems utilizing an organic silver salt includes a method of production by solvent coating and a method of production by coating and drying a coating liquid containing, as a water dispersion, fine polymer particles as a main binder. Since the latter method does not require steps such as recovery of the solvent, production facilities are simple, and the method is advantageous for mass production.

In either the solvent coating or the water-based coating method, stable images not dependent upon the material storing conditions can be formed by forming layers including a protection layer on the outer surface of the image forming layer. Further, a photosensitive material having good damge-resistance and transportability in the handling of the photosensitive material during or after processing can be prepared by coating with a protection layer. Further, in view of economical production, it is preferable that two or more layers can be simultaneously coated in a stack.

When a polymer derived from animal protein (for example, gelatin) is used in an outermost layer (for example, refer to JP-A No. 2002-162712), water proofness and storage stability when the photosensitive material was stored over time and under high temperature and high humidity conditions were not sufficient. Further, it has been found that when photosensitive materials are processed to obtain images and then the images are stored in a stack, this results in a problem of color transfer. Further it has also been found that when outputted images are stored in a dark place being stacked upon each other for a long time, this results in a problem of uneven density of images.

The advantage of using gelatin as a binder is that a coated surface can be formed uniformly because of the setting property. Setting means elimination of fluidity by cooling a heated coating liquid just after coating on a support by utilizing the fact that an aqueous gelatin solution undergoes temperature dependent sol-gel change in which it becomes sol when heated to a temperature of 30° C. or higher and gels to lose the fluidity when the temperature is lowered to less than the level described above.

On the other hand, when a coating liquid mainly comprising a latex is applied to form an outermost layer (for example, refer to JP-A Nos. 2000-227643 and 2001-194744), it has been found that while a film of excellent water proofness can be formed, the stability of the coating liquid for the outermost layer highly tends to be affected by a salt concentration in additives of an adjacent layer, pH, or surface static charges of dispersed particles because of the lack of the setting property and creases sometimes occur on the surface of the photosensitive material during drying of the coating.

In view of improving the water proofness and the storage stability when the photosensitive material is stored over time and under high temperature and high humidity conditions, it is known that a hydrophobic polymer is preferably used as the binder for the outermost layer, but gelatin has often been used in consideration of problems in the production step.

Further, it has not yet been studied sufficiently as to what polymer is effective for use as the hydrophobic polymer, and the effect of changing the polymer species could not be anticipated.

Accordingly, a heat-developable photosensitive material having good storage stability before image formation and less fluctuation of sensitivity and also having excellent image storability in a dark place after image formation is required.

SUMMARY OF THE INVENTION

The present invention provides a heat-developable photosensitive material comprising a support having provided thereon an image forming layer containing a photosensitive silver halide, a non-photosensitive organic silver salt, a reducing agent, and a binder, wherein a binder of an outermost layer at a side of the support at which the image forming layer is provided includes a latex polymer in an amount of 85 mass % or more.

Since the effects of an outermost layer on an adjacent layer and on image formation have to be taken into consideration, change of the binder of the outermost layer by merely selecting a hydrophobic polymer does not lead to improvement of performance of a heat-developable photosensitive material.

In particular, unlike a photosensitive material which is subjected to liquid development processing, since a heat-developable photosensitive material contains therein all chemical substances necessary for development, materials added have great effect on other substances. Accordingly, since all components remain in the heat-developable photosensitive material before and after development, effects of the components on storage stability is much larger in the heat-developable photosensitive material than in a photosensitive material to be subjected to liquid development processing.

In particular, when the heat-developable photosensitive material is used for medical diagnosis, density uneveness generating during storage of formed images makes it difficult to judge whether a discolored portion is a normal portion or not.

The invention can provide a heat-developable photosensitive material having excellent image storability in a dark place after image formation. It is particularly effective to apply the invention to a heat-developable photosensitive material obtained by applying water-based solutions.

DETAILED DESCRIPTION OF THE INVENTION

The invention is to be described specifically.

The heat-developable photosensitive material of the invention has a support and an image forming layer containing a photosensitive silver halide, a non-photosensitive organic silver salt, a reducing agent and a binder. The binder of the outermost layer at an image forming layer side includes a latex polymer and the content of the latex polymer in the binder of the outermost layer is 85 mass % or more.

The heat-developable photosensitive material of the invention may be a single face type having an image forming layer only on one surface of a support or it may be a double face type having an image forming layer on each surface of a support. In the case of the single face type, the material preferably has a back layer on the other surface of the support opposite to the image forming layer side (hereinafter referred to as a back surface). The same binder can be used as the binder of the outermost layer at the back surface side, however the type of the binder of the outermost layer at the back surface side is not limited.

Description of the Outermost Layer

In the invention, the outermost layer at the image forming layer side includes a binder. The binder includes a latex polymer and the content of the latex polymer in the binder is 85 mass % or more, however, the other things are not limited.

Binder

In the invention, the content of the latex polymer in the binder of the outermost layer is 85 mass % or more, preferably 90 mass % or more and more preferably 95 mass % or more.

Preferred examples of polymers used in the latex of the hydrophobic polymers are hydrophobic polymer such as acrylic polymers, polyesters, rubbers (for example, an SBR resin), polyurethanes, polyvinyl chlorides, polyvinyl acetates, polyvinylidene chlorides, and polyolefins. The polymers may be linear polymers or branched polymers, or crosslinked polymers, and may be so-called homopolymers in which single monomer is polymerized or copolymers in which two or more kinds of monomers are polymerized. In the case of the copolymer, it may be either a random copolymer or a block copolymer.

The number average molecular weight of the polymer is preferably 5000 to 1,000,000, and more preferably 10,000 to 200,000. A polymer with excessively small molecular weight provides insufficient dynamic strength for a layer including the latex, whereas a polymer of excessively large molecular weight has a poor film-forming property. Further, the crosslinking polymer latex can be used particularly preferably.

In the heat-developable photosensitive material of the invention, the polymer latex usable as the binder is a material in which a water-insoluble hydrophobic polymer is dispersed as fine particles in a water-soluble dispersion medium. The dispersion may be any of states where a polymer is emulsified in a dispersion medium, emulsion-polymerized or micelle-dispersed, or where the polymer molecule partially has a hydrophilic structure and the molecular chain itself is dispersed in a molecular state.

The presence of the hydrophobic partial structure is effective for stabilizing the dispersion state of the latex. For example, examples of such a polymer include those having an anionic, cationic or nonionic structure.

The polymer latex is described in "Synthetic Resin Emulsion (edited by Taira Okuda, Hiroshi Inagaki, published from Kobunshi Publishing Society (1978))", "Application of Synthetic Latex (edited by Takaaki Sugimura, Yasuo Kataoka, Soichi Suzuki and Keiji Kasahara, published from Kobunshi Publishing Society (1993))", "Chemistry of Synthetic Latex (written by Soichi Muroi, published from Kobunshi Publishing Society (1970)) and JP-A No. 64-538.

The average grain size of the dispersed particles is within the range of from 1 to 50000 nm, and preferably from 5 to 1000 nm. There is no particular restriction on the grain size distribution of the dispersed particles, and the dispersed particles having a wide grain size distribution or a grain size distribution of mono dispersion can be used.

Since the protection layer and the back layer including the outermost layer are brought into contact with various equipments, the latex polymer preferably has a glass transition temperature within the range of from −20° to 30° C., and more preferably a glass transition temperature within the range of −10° C. to 20° C. in view of film strength and prevention of adhering failure.

The glass transition temperature Tg is calculated on the basis of the following equation in the specification.

$$1/Tg=\Sigma(Xi/Tgi)$$

The polymer whose glass transition temperature Tg is calculated by the above equation is assumed to be formed by copolymerizing n monomers (i indicates the number of the monomers copolymerized, from 1 to n); Xi indicates the weight percentage of the i'th monomer ($\Sigma Xi=1$) and Tgi represents the glass transition temperature (in terms of the absolute temperature) of the homopolymer of the i'th monomer alone; and Σ indicates the sum of (X1/Tg1) to (Xn/Tgn). As for the glass transition temperature (Tgi) of the homopolymer of each monomer alone, the descriptions in Polymer Handbook (3rd Edition) (written by J. Brandrup, E. H. Immergut (Wiley-Interscience, 1989)) is referred to.

Two or more kinds of binders may be used together, if necessary. Further, a binder with a glass transition temperature of 20° C. or higher and a binder with a glass temperature of lower than 20° C. may be used in combination. When two or more kinds of polymers having different Tg are blended, it is preferable that weight average Tg of the resultant mixture is within the range described above.

Preferred examples of the polymer latex include a latex (water dispersion) of an urethane polymer.

The urethane polymer used in the heat-developable photosensitive material of the invention is a polymer obtained by reaction between a polyisocyanate and a polyol and having urethane bonds in the molecular chain.

Examples of the polyisocyanate induce tolylene diisocyanate, diphenylmethane diisocyanate, naphthalene diisocyanate, toluidine diisocyanate, hexamethylene diisocyanate, isophorone diisocyanate, xylylene diisocyanate, lysine diisocyanate, tetramethylxylene diisocyanate, p-phenylene diisocyanate, transcyclohexone diisocyanate, and trimethylhexamethylene diisocyanate.

Further, the polyisocyanate may, for example, be that formed by adding 3 molecules of hexamethylene diisocyanate to 1 molecule of trimethylol propane.

Some of the polyisocyanates described above, such as 2,4-tolylene diisocyanate or 2,6-tyolylene diisocyanate, have various isomers and these isomers can be preferably used. Furthermore, dimers, trimers or modified forms (such as allophanate or burette form) of the polyisocyante described above may also be used.

Examples of the polyol include ethylene glycol, propylene glycol, glycerine, hexane triol, diglycerine, trimethlol propane, pentaerythritol, and sorbitol.

The urethane polymer may be a linear polymer, a branched polymer or a crosslinked polymer. Further, the polymer may be a so-called homopolymer in which one monomer is polymerized or a copolymer in which two or more kinds of monomers are polymerized. The copolymer may be a random copolymer or a block copolymer.

The urethane polymer used in the heat-developable photosensitive material of the invention is described, for example, in "Polyurethane Polymer Handbook" edited by Keiji Iwata, published from Nikkan Kogyo Shinbunsha (1987).

In order to coat the photosensitive layer of the heat-developable photosensitive material in the invention with a water-based coating liquid, a latex of the urethana polymer described above is preferably used. The latex of the urethane polymer may be obtained, for example, by a method of dispersing a polymer synthesized in an organic solvent into water with a surfactant, or a method of synthesizing an urethane polymer partially having a hydrophilic group in an organic solvent and dispersing the same into water without using a surfactant.

As the urethane polymer partially having a hydrophilic group, an anionic, cationic or nonionic stabilized polyurethane dispersion can be prepared.

The anionic polyurethane dispersion usually contains partially a carboxyl or sulfonic functional comonomer, for example, appropriately suppressed dihydroxycarboxylic acid (dimethylol propionic acid) or dihydroxylsulfonic acid. It may be an ionomer type synthesized by acting a metal cation.

The cationic polyurethane dispersion is prepared by using, as a diol component, a diol having a tertiary nitrogen atom. The tertiary nitrogen atom is transformed into quaternary ammonium by addition of an appropriate alkylating agent or acid.

The nonionically stabilized polyurethanes are prepared by using a diol or a diisocyante comonomer having a polyurethane oxide side group. Such a polyurethane dispersion is stable in a colloidal state over a wide pH range.

In order to attain a combination of small grain size and strong stability, a nonionic polyurethane and an anionic polyurethane may be used in combination.

The polyurethane latex is described, for example, in "Aqueous Coating Technology (CMC technical Library, issued from CMC co. (2001)".

The percentage of the hydrophilic group portions in the urethane polymer is preferably 60 mass % or less, preferably 0.5 mass % to 30 mass %, and more preferably 1 mass % to 5 mass %.

Specific examples of the urethane polymer usable in the photosensitive layer in the invention include the followings.

P-1

A water dispersion formed by dispersing the following compound

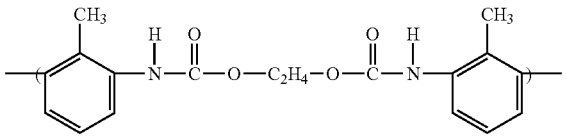

with a surfactant shown below

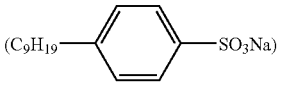

(number average molecular weight: 63,000; average grain size: 300 nm)

P-2

A water dispersion formed by dispersing the following compound

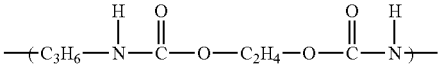

with the surfactant (number average molecular weight: 28,000; average grain size: 420 nm)

P-3

A water dispersion of the following compound

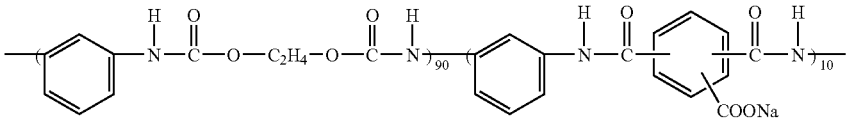

(number average molecular weight: 13,000; average grain size: 210 nm)

P-4

An aqueous dispersion of the following compound

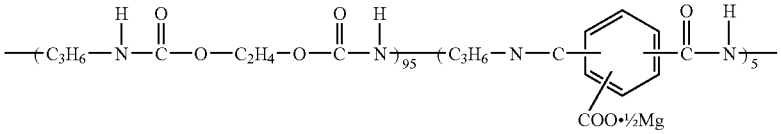

(number average molecular weight: 71,000; average grain size: 190 nm)

As the urethane polymer used in the photosensitive layer in the invention, the commercially available products such as Bondic 1370NS, 1610NS, 1320NS, 1612NS, Hydran HW310, HW340, HW350, HW100, HW140, Hydran AP10, AP30, AP40, APX-101H (manufactured by Dainippon Ink and Chemicals, Incorporated), Takerack W610, W621, W630, W710 (manufactured by Takeda Chemical Industries, Ltd.)

One urethane polymer may be used alone, or two or more kinds of urethane polymers may also be used in combination.

Examples of other polymer latexes include those described below. They are expressed by using starting monomers, parenthesized numerical values represent mass % of the monomer and the molecular weight is a number average molecular weight. When the polyfunctional monomer is used, it forms a crosslinking structure and therefore the concept of the molecular weight cannot be used. Accordingly, the term "crosslinking" is used for a polymer made of such a monomer and the molecular weight is omitted. Tg represents a glass transition temperature of the polymer.

P-1: a latex of MMA (70), EA (27), and MAA (3) (molecularweight: 37000; Tg: 61° C.)

P-2: a latex of MMA (70), 2EHA (20), St (5), and AA (5) (molecular weight: 40000; Tg: 59° C.)

P-3: a latex of St (50), Bu (47), and MAA (3) (crosslinking; Tg: −17° C.)

P-4: a latex of St (68), Bu (29), and AA (3) (crosslinking; Tg: 17° C.)

P-5: a latex of St (71), Bu(26), and AA (3) (crosslinking; Tg: 24° C.)

P-6: a latex of St (70), Bu (27), and IA (3) (crosslinking)

P-7: a latex of St (75), Bu (24), and AA (1) (crosslinking; Tg: 29° C.)

P-8: a latex of St (60), Bu (35), DVB (3), and MAA (2) (crosslinking)

P-9: a latex of St (70), Bu (25), DVB (2), and AA (3) (crosslinking)

P-10: a latex of VC (50), MMA (20), EA (20), AN (5), and AA (5) (molecular weight: 80000)

P-11: a latex of VDC (85), MMA (5), EA (5), and MAA (5) (molecular weight: 67000)

P-12: a latex of ET (90), and MMA (10) (molecular weight: 12000)

P-13: a latex of St(70), 2EHA (27), and AA (3) (molecular weight: 130000; Tg: 43° C.)

P-14: a latex of MMA (63), EA (35), and AA (2) (molecular weight: 33000; Tg: 47° C.)

P-15: a latex of St (70.5), Bu (26.5), and AA (3) (crosslinking; Tg: 23° C.)

P-16: a latex of St (69.5), Bu (27.5), and AA (3) (crosslinking; Tg: 20.5° C.)

In the above structure, MMA represents methyl methacrylate, EA represents ethyl acrylate, MAA represents methacrylic acid, 2EHA represents 2-ethylhexyl acrylate, St represents styrene, Bu represents butadiene, AA represents acrylic acid, DVB represents divinylbenzene, VC represents vinyl chloride, AN represents acrylonitrile, VDC represents vinylidene chloride, Et represents ethylene, and IA represents itaconic acid.

The polymer latexes described above are commercially available and the following products can be utilized. Examples of the acrylic polymer include Cebian A-4635, 4718, and 4601 (all manufactured by Dicel Chemical Industries, Ltd.), and Nipol Lx 811, 814, 821, 820, 857 (P-17; Tg: 36° C.), and 857x2 (P-18; Tg: 43° C.) (manufactured by Zeon Corporation), Voncoat R3370 (P-19; Tg: 25° C.), and 4280 (P-20; Tg: 15° C.) (manufactured by Dainippon Ink and Chemicals, Incorporated), Jurymer ET-410 (P-21; Tg: 44° C.) (manufactured by Nippon Junyaku Co., Ltd.), AE116 (P-22; Tg: 50° C.), AE119 (P-23; Tg: 55° C.), AE121 (P-24; Tg: 58° C.), AE1.25 (P-25; Tg: 60° C.), AE134 (P-26; Tg: 48° C.), AE137 (P-27; Tg: 48° C.), AE140 (P-28; Tg: 53° C.), and AE173 (P-29; Tg: 60° C.) (manufactured by JSR Corporation), Aron A-104 (P-30; Tg: 45° C.) (manufactured by Toagosei Co., Ltd.). Examples of the polyesters include Fintex ES 650, 611, 675, and 850 (manufactured by Dainippon Ink and Chemicals, Incorporated.), WD-size, and WMS (manufactured by Eastman Chemical Co.). Examples of polyurethans include Hydran AP10 (P-31; Tg: 37° C.), AP20, 30, 40 (P-32; Tg: 55° C.), 101H, Vondic 1320NS, and 1610NS (manufactured by Dainippon Ink and Chemicals, Incorporated.). Examples of rubbers include Lacstar 7310K, 3307B (P-33; Tg: 13° C.), 4700H, and 7132C (P-34; Tg: 70°

C.) (manufactured by Dainippon Ink and Chemicals, Incorporated.), Nipol Lx 416 (P-35; Tg: 50° C.), 410, 430, 435, 110, 415A (P-36; Tg: 27° C.), 438C, 2507H (P-37; Tg: 58° C.), and 303A (P-38; Tg: 100° C.) manufactured by Zeon Corporation.). Examples of the polyvinyl chlorides include G 351, and G576 (manufactured by Zeon Corporation). Examples of polyvinylidene chlorides include L502, and L513 (manufactured by Asahi Kasei Industries, Co., Ltd.), D-5071 (P-39; Tg: 36° C.) (manufactured by Dainippon Ink and Chemicals, Incorporated.). Examples of polyolefins include Chemipearl S120, SA100, and V300 (P-40; Tg: 80° C.) (manufactured by Mitsui Petrochemical Co.), Voncoat 2830 (P-41; Tg: 38° C.), 2210, and 2960 (manufactured by Dainippon Ink and Chemicals, Incorporated.).

The polymer latexes described above may be used alone or two or more of them may be blended, if necessary. Further, the urethane polymer described above and one or more of polymers other than the urethane polymers described above may also be blended.

It is necessary that the amount of the latex polymer is at least 85 mass % with respect to the total amount of the binder of the outermost layer. Plural kinds of the latex polymers may also be used and the ratio thereof may be properly adopted.

In the outermost layer in the invention, a water-soluble polymer may be used together with the latex polymer as the binder in the range of not more than 15 mass % of the total amount of the binder in the outermost layer.

Examples of the water-soluble polymer include those derived from animal protein, such as gelatin and glue, and those not derived from the animal protein (for example, polyvinyl alcohol) conventionally used in the art.

The total amount of the binder in the outermost layer in the invention is preferably within the range of from 0.2 to 6.0 g/m$^2$, and more preferably 0.5 to 4.0 g/m$^2$. The total amount of the binder of the image forming layer in the invention is preferably within the range of from 0.2 to 30 g/m$^2$, and more preferably 1.0 to 15 g/m$^2$. The total amount of the binder of the back layer in the invention is preferably within the range of from 0.01 to 3 g/m$^2$, and more preferably 0.05 to 1.5 g/m$^2$.

A protection layer which is the outermost layer may have two or more layers. In such a case, it is necessary that the content of the latex polymer in the binder contained in the outermost protection layer farthest from the support is 85 mass % or more.

The minimum film-forming temperature (MFT) of the polymer latex is preferably from about −30° C. to 90° C. and more preferably about 0° C. to 70° C. In order to control the minimum film-forming temperature, a film-forming aid may also be added to the polymer latex. The film-forming aid is referred to as a temporary plasticizer (usually an organic solvent), which is an organic compound for lowering the minimum film-forming temperature of the polymer latex, and described, for example, in "Chemistry of Synthetic Latex (written by Soichi Muroi, Published from High Molecule Publishing Society (1970))". Preferred examples of the film-forming aid include, but are not limited to, the following compounds.

Z-1: benzyl alcohol
Z-2: 2,2,4-trimethylpantanediol-1,3-monoisobutyrate
Z-3: 2-dimethylaminoethanol
Z-4: diethylene glycol In particular, when a protection layer is formed as the outermost layer, the film-forming aid is preferably added to the protection layer and the addition amount thereof is preferably from 1 to 30 mass % and more preferably 5 to 20 mass % based on the solid content of the polymer latex in the coating liquid for the protection layer. As the hydrophilic polymer which is a dispersion stabilizer contained in the image forming layer and the outermost layer in the invention, polyvinyl alcohol, methylcellulose, hydroxypropylcellulose, carboxymethylcellulose, or hydroxypropylmethylcellulose is preferably used. Polyvinyl alcohol is particularly preferred.

In the invention, various additives such as a matting agent, a film hardening agent, a fluorinated surfactant, a de-lustering agent, a filter dye and a crosslinking agent may also be incorporated in the outermost layer in the invention.

Matting Agent

The outermost layer is the most appropriate as a layer containing the matting agent at the image forming layer side and the matting agent may be added to one of the layers on the side nearer to the support than the outermost layer. A protection layer may have two layers including the outermost layer and it can be designed such that a coating property, production adaptability and image quality can be compatibly attained by selecting a layer to which additives concerning development, a film surface pH controlling agent, a charge controlling agent, a UV-ray absorbent, a slipping agent and/or a surfactant are added.

The matting agent is preferably used in the form of a matting agent particle dispersion obtained by dispersing the matting agent with a binder polymer. Further, a surfactant described later is preferably added to the matting agent particle dispersion.

The matting agent used in the invention is generally fine particles of a water-insoluble organic or inorganic compound. Any matting agent can be used and, specifically, those well known in the art such as organic matting agents described in U.S. Pat. Nos. 1,939,213, 2,701,245, 2,322,037, 3,262,782, 3,539,344, and 3,767,448, and inorganic matting agents described in U.S. Pat. Nos. 1,260,772, 2,192,241, 3,257,206, 3,370,951, 3,523,022, and 3,769,020 can be used.

As the organic compound usable as the matting agent, a vinyl polymer which can be dispersed in water, a cellulose derivative, and a starch derivative can be used. Examples of the vinyl polymer which can be dispersed in water include polymethyl acrylate, polymethyl methacrylate, polyacrylonitrile, an acrylonitrile-α-methylstyrene copolymer, polystyrene, a styrene-divinylbenzene copolymer, polyvinyl acetate, polyethylene carbonate and polytetrafluoroethylene. Examples of the cellulose derivative include methylcellulose, cellulose acetate, and cellulose acetate propionate. Examples of the starch derivative include carboxy starch, carboxynitrophenyl starch, and an urea-formaldehyde-starch reaction product. Gelatin hardened by a known hardening agent and hardened gelatin formed into fine capsule hollow particles by coacervate-hardening can also be preferably used.

As the inorganic compound, silicon dioxide, titanium dioxide, magnesium dioxide, aluminum oxide, barium sulfate, calcium carbonate, silver chloride and silver bromide de-sensitized by a known method, glass and diatomaceous earth can be preferably used. Different kinds of substances may be mixed and used as the matting agent, if necessary. There are no particular restrictions on the size and the shape of the matting agent and those having an arbitrary grain size can be used. In the invention, use of the matting agent having a grain size of from 0.1 μm to 30 μm is preferable. The size of the matting agent is more preferably from 0.3 μm to 20 μm and still more preferably 0.5 μm to 10 μm. Further, the grain size distribution of the matting agent may be narrow or broad. The fluctuation coefficient of the size distribution is preferably 50% or less, more preferably 40% or less, and still more preferably 30% or less. The fluctuation coefficient is a value represented by (the standard deviation of the particle size)/(the average value of the grain size)×100. It is preferable to use a combination of two types of matting agents having a small fluctuation coefficient and an average grain size ratio of 3 or more.

Meanwhile, since the matting agent has a significant effect on the haze and the surface luster of a coated film, it is preferable that the grain size, shape and grain size distribution are adjusted to a desired state at the time of the preparation of the matting agent or by mixing plural kinds of the matting agents.

Examples of the matting agent preferably used in the invention are shown below but the invention is not restricted to the following compounds.

M-1: Polyethylene particles having a specific gravity of 0.90 (Flow Beads LE-1080 manufactured by Sumitomo Seika Chemicals Co., Ltd.)

M-2: Polyethylene particles having a specific gravity of 0.93 (Flow Beads EA-209manufactured by Sumitomo Seika Chemicals Co., Ltd.)

M-3: Polyethylene particles having a specific gravity of 0.96 (Flow Beads HE-3040 manufactured by Sumitomo Seika chemicals Co., Ltd.)

M-4: Silicone particles having a specific gravity of 0.97

M-5: Silicone particles having a specific gravity of 1.00 (E701 manufactured by Toray Dow Silicone Co., Ltd.)

M-6: Silicone particles having a specific gravity of 1.03

M-7: polystyrene particles having a specific gravity of 1.05 (SB-6 manufactured by Sekisui Kaseihin Industries Co., Ltd.)

M-8: Styrene-methacrylic acid (ratio of 97/3) copolymer particles having a specific gravity of 1.05

M-9: Styrene-methacrylic acid (ratio of 90/10) copolymer particles having a specific gravity of 1.06

M-10: Styrene-methyl methacrylate-methacrylic acid (ratio of 50/40/10) copolymer particles having a specific gravity of 1.09

M-11 crosslinked polyethylene particles having a specific gravity of 0.92

M-12: Crosslinked polyethylene particles having a specific gravity of 0.95

M-13: Crosslinked polyethylene particles having a specific gravity of 0.98

M-14: Crosslinked silicone particles having a specific gravity of 0.99

M-15: Crosslinked silicone particles having a specific gravity of 1.02

M-16: Crosslinked silicone particles having a specific gravity of 1.04

M-17: Styrene-divinylbenzene (ratio of 90/10) copolymer particles having a specific gravity of 1.06 (SX-713 manufactured by Soken Chemical Co., Ltd.)

M-18: Styrene-divinylbenzene (ratio of 80/20) copolymer particles having a specific gravity of 1.06 (SX-713 manufactured by Soken Chemical Co., Ltd.)

M-19: Styrene-divinylbenzene (ratio of 70/30) copolymer particles having a specific gravity of 1.07 (SX-713 manufactured by Soken Chemical Co., Ltd.)

M-20: Styrene-methacrylic acid-divinylbenzene (ratio of 87/3/10) copolymer particles having a specific gravity of 1.06 (SX-713α manufactured by Soken Chemical Co., Ltd.)

M-21: Styrene-methacrylic acid-divinylbenzene (ratio of 88/10/10) copolymer particles having a specific gravity of 1.07 (SX-713α manufactured by Soken Chemical Co., Ltd.)

M-22: Styrene-methyl methacrylate-methacrylic acid-divinylbenzene (ratio of 40/40/10/10) copolymer particles having a specific gravity of 1.10

The content of the matting agent is set to such an extent that it enables the exhibition of the intended effect of the invention and does not excessively hinder the inherent function of the layer containing the matting agent. The coating amount of the matting agent per $m^2$ of the photosensitive material is preferably 1 to 400 $mg/m^2$ and more preferably 5 to 300 $mg/m^2$.

When the matting agent is incorporated in a layer provided at the imaging forming layer side, the content of the matting agent is generally set to such an extent that it does not cause star dust failure and preferably is set such that the beck smoothness is preferably 500 to 10,000 seconds, and more preferably 500 to 2000 seconds. When the matting agent is incorporated in the back layer, it is preferable that the beck smoothness is about 10 to about 2000 seconds and more preferably 50 to 1500 seconds. The beck smoothness in the invention can be determined according to JIS P8119 and TAPPI T479.

The matting agent contained in the outermost layer at the image forming layer side and the layer adjacent to the outermost layer is preferably dispersed with a binder polymer and used as a dispersion of matting agent particles. As a dispersion method, a method (a) in which a polymer used as a matting agent is dissolved in, for example, an organic solvent having a low boiling point to form a solution, the solution is emulsification-dispersed in an aqueous medium to obtain polymer droplets and the organic solvent having a low boiling point is removed from the resultant emulsion to prepare a dispersion of the matting agent, and a method (b) in which fine particles of a polymer used as a matting agent are previously prepared and dispersed in an aqueous medium such that coarse aggregates are not generated to prepare a dispersion can be used. In the invention, the method (b) not using the organic solvent having a low boiling point is preferable in view of environment.

The matting agent can be dispersed by a method in which an aqueous medium containing a binder polymer serving as a dispersing aid is previously added to an aqueous solvent, and a solution including a matting agent is mechanically dispersed in the aqueous solvent with a known high speed stirring apparatus (for example, Disper emulsifier, a homomixer, a turbine mixer or a homogenizer) or an ultrasonic emulsifier. The dispersion can be conducted in a reduced pressure lower than an atmospheric pressure in order to suppress forming. When a dispersing aid is used, the dispersing aid is previously dissolved in an aqueous medium and the matting is added to the medium, in general. However, the dispersing aid can be used in the form of an aqueous dispersion obtained by polymerization of the matting agent and including the dispersing aid as it is (without conducting a dry step). The dispersing aid can also be added to a liquid dispersion during dispersion. Further, in order to stabilize the physical properties of a liquid dispersion after dispersion, the dispersing aid may be added to the liquid dispersion. In any of the cases, a solvent (for example, water or an alcohol) is generally used together. The pH of the liquid dispersion may be controlled by adding an appropriate pH controlling agent before, after or during the dispersion.

In addition to the mechanically dispersion, the stability of the matting agent dispersion after dispersion may beenhanced by controlling the pH of the dispersion. Further, an extremely small amount of an organic solvent having a low boiling point may be auxiliarily used in the dispersion and the organic solvent is usually removed after the end of the micro-granulation.

The dispersion thus prepared can be stirred during storage, or stored in the form of a dispersion having a high viscosity by inclusion of a hydrophilic colloid (for example, in the form of a jelly including gelatin) in order to suppress precipitation of the matting agent during storage. Further, an antiseptic is preferably added to the matting agent in order to prevent growing of various kinds of minor germs during storage.

The binder polymer is preferably added to the matting agent and dispersed in an amount of 5 to 300 mass % with respect to the matting agent, and more preferably 10 to 200 mass %.

In the invention, the matting agent dispersion preferably includes a surfactant since the incorporation of the surfactant can stabilize the dispersed state of the dispersion. There is no particular restriction on the surfactant used herein but a fluorinated compound is preferably used. Specific fluorinated compounds described later are particularly preferable.

Surfactant

Surfactants which can be used in the invention are described in JP-A No. 11-65021, paragraph 0132, solvents usable in the invention are described in the same publication, paragraph 0133, supports usable in the invention are described in the same publication, paragraph 0134, an antistatic or conductive layer is described in the same publication, paragraph 0135, a method of obtaining color images is described in the same publication, paragraph 0136 and a sliding agent is described in JP-A No. 11-84573, paragraphs 0061 to 0064 and Japanese Patent Application No. 11-106881, paragraphs 0049 to 0062.

In the invention, a fluorinated surfactant is preferably used. Specific examples of the fluorinated surfactant include those described in JP-A Nos. 10-197985, 2000-19680, and 2000-214554. Further, a fluorinated polymer surfactant described in JP-A No. 09-281636 is also preferably used. In the heat-developable photosensitive material of the invention, it is preferable to use a fluorinated surfactant described in JP-A No. 2002-82411, and Japanese Patent Application Nos. 2001-242357 and 2001-264110. In particular, the fluorinated surfactants described in Japanese Patent Application Nos. 2001-242357 and 2001-264110 are preferable in view of a charge controlling ability, stability of a coated surface and sliding properties when coating is conducted by using a water-based coating liquid. Moreover, the fluorinated surfactant described in Japanese Patent Application No.2001-264110 is the most preferable. This is because the charge controlling ability thereof is high and, even if the amount thereof is low, a sufficient effect can be obtained.

Further, the inventors of the invention have found that a structure in which a latex-containing layer is disposed as an outermost layer and a layer containing a gelatin having a setting property is disposed as a layer directly adjacent to the outermost layer causes hydrophobic polymer particles in the latex to coagulate, which results in adhering failure at the time of heat development. It is thought that the phenomenon is attributed to that directly adjacently disposing the gelatin-containing layer which has a low pH and the latex-containing layer which is neutral causes the pH of the latex-containing layer to decrease and the hydrophobic polymer particles in the latex to coagulate. As described above, the inventors have found that directly adjacently disposing the latex-containing layer and the gelatin-containing layer deteriorates the state of a coated surface. In addition, the inventors have found that the charging effect of a fluorinated compound having a fluorinated alkyl group with two or more carbon atoms and 12 or less fluorine atoms is significantly effective for suppressing the coagulation of the hydrophobic polymer particles.

The heat-developable photosensitive material of the invention preferably contains a fluorinated compound having a fluorinated alkyl group with at least two carbon atoms and at most 12 fluorine atoms in at least one of the outermost layer and the layer adjacent to the outermost layer. The fluorinated compound can be used as a surfactant. Further, the fluorinated compound is preferably added to the matting agent dispersion described above.

The fluorinated compound used in the invention may have any structure so long as it has the fluorinated alkyl group as described above (the alkyl group having at least one fluorine atom is hereinafter referred to as an "Rf" group). Further, the fluorinated compound may have one or more Rf groups and have two or more of them. Fluorinated compound having two or more Rf groups are preferable.

Specific examples of the Rf group include, but are not limited to, —$C_2F_5$ group, —$C_3F_7$ group, —$C_4F_9$ group, —$C_5F_{11}$ group, —$CH_2$—$C_4F_9$ group, —$C_4F_8$—H group, —$C_2H_4$—$C_4F_9$ group, —$C_4H_8$—$C_4F_9$ group, —$C_6H_{12}$—$C_4F_9$ group, —$C_8H_{16}$—$C_4F_9$ group, —$C_4H_8$—$C_2F_5$ group, —$C_4H_8$—$C_3F_7$ group, —$C_4H_8$—$C_5F_{11}$ group, —$C_8H_{16}$—$C_2F_5$ group, —$C_2H_4$—$C_4F_8$—H group, —$C_4H_8$—$C_4F_8$—H group, —$C_6H_{12}$—$C_4F_8$—H group, —$C_6H_{12}$—$C_2F_4$—H group, —$C_8H_{16}$—$C_2F_4$—H group, —$C_6H_{12}$—$C_4F_8$—$CH_3$ group, —$C_2H_4$—$C_3F_7$ group, —$C_2H_4$—$C_5F_{11}$ group, —$C_4H_8$—$CF(CF_3)_2$ group, —$CH_2CF_3$ group, —$C_4H_8$—$CH(C_2F_5)_2$ group, —$C_4H_8$—$CH(CF_3)_2$ group, —$C_4H_8$—$C(CF_3)_3$ group, —$CH_2$—$C_4F_8$—H group, and —$CH_2$—$C_6F_{12}$—H group.

The Rf group has 12 fluorine atoms or less, preferably 3 to 11 fluorine atoms and more preferably 5 to 9 fluorine atoms. Further, the Rf group has at least two carbon atoms, preferably 4 to 16 carbon atoms and more preferably 5 to 12 carbon atoms.

There is no particular restriction on the structure of the Rf group so long as it has at least two carbon atoms and at most 12 fluorine atoms and is preferably a group represented by the following formula (A).

-Rc-Re—W Formula (A)

Rc in formula (A) represents an alkylene group having one to four carbon atoms, preferably one to three carbon atoms, and more preferably one or two carbon atoms.

The alkylene group represented by Rc may be linear or branched.

Re represents a perfluoroalkylene group having two to six carbon atoms, and preferably a perfluoroalkylene group having two to four carbon atoms. The perfluoroalkylene group means an alkylene group where all of hydrogen atoms of an unsubstituted alkylene group are substituted with fluorine atoms. The perfluoroalkylene group may be linear, branched or cyclic.

W represents a hydrogen atom, a fluorine atom or an alkyl group, and is preferably a hydrogen atom or a fluorine atom, and most preferably a fluorine atom.

The fluorinated compound in the invention may have a cationic hydrophilic group. The cationic hydrophilic group is a substance which forms a cation when dissolved in water.

Specifically, examples thereof include quaternary ammonium, an alkylpyridium, an alkylimidazolinium and primary to tertiary aliphatic amines.

The cation is preferably an organic cationic substituent, more preferably an organic cationic group containing a nitrogen or phosphorus atom, and still more preferably a pyridinium cation or an ammonium cation.

Anion species for forming salts with the cation may be an inorganic anion or an organic anion. The inorganic anion is preferably an iodide ion, a bromide ion and a fluoride ion. The organic anion can be, for example, a p-toluenesulfonate ion, a benzenesulfonate ion, a methanesulfonate ion and a trifluoromethanesulfonate ion.

Preferred cationic fluorinated compound in the invention is represented by the following formula (1).

Formula (1)

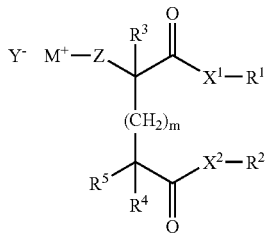

In the formula, $R^1$ and $R^2$ independently represent a substituted or unsubstituted alkyl group, and at least one of $R^1$ and $R^2$ is the fluorinated alkyl (Rf) group described above. It is preferable that both of $R^1$ and $R^2$ are the Rf groups. $R^3$, $R^4$, and $R^5$ independently represent a hydrogen atom or a substituent; $X^1$, $X^2$ and Z independently represent a bivalent connection group or a single bond; and $M^+$ represents a cationic substituent. $Y^-$ represents a counter anion but, when the total static charge amount of the compound represented by formula (1) is 0 without $Y^-$, the compound may not have $Y^-$. m is 0 or 1.

In formula (1), when $R^1$ and $R^2$ independently represent a substituted or unsubstituted alkyl group other than the Rf group, the alkyl group has one or more carbon atoms and may be linear, branched or cyclic. Examples of the substituent of the substituted alkyl group include a halogen atom other than a fluorine atom, an alkenyl group, an aryl group, an alkoxyl group, a carbonate group, a carbonamide group, a carbamoyl group, an oxycarbonyl group and a phosphate group.

When $R^1$ or $R^2$ represents an alkyl group other than the Rf group, that is, an alkyl group not substituted with a fluorine atom, the alkyl group is preferably a substituted or unsubstituted alkyl group with 1 to 24 carbon atoms, and more preferably a substituted or unsubstituted alkyl group with 6 to 24 carbon atoms. Typical examples of the unsubstituted alkyl group having 6 to 24 carbon atoms include a n-hexyl group, a n-heptyl group, a n-octyl group, a tert-octyl group, a 2-ethylhexyl group, a n-nonyl group, a 1,1,3-trimethylhexyl group, a n-decyl group, a n-dodecyl group, a cetyl group, a hexadecyl group, a 2-hexyldecyl group, an octadecyl group, an eicosyl group, a 2-octyldodecyl group, a docosyl group, a tetracosyl group, a 2-decyltetradecyl group, a tricosyl group, a cyclohexyl group, and a cycloheptyl group. Further, typical examples of the substituted alkyl group with 6 to 24 carbon atoms in total include a 2-hexenyl group, an oleyl group, a linoleyl group, a linolenyl group, a benzyl group, a β-phenetyl group, a 2-methoxyethyl group, a 4-phenylbutyl group, a 4-acetoxyethyl group, a 6-phenoxyhexyl group, a 12-phenyldodecyl group, a 18-phenyloctadecyl group, a 12-(p-chlorophenyl)dodecyl group and a 2-(diphenyl phosphate) ethyl group.

The alkyl group other than Rf independently represented by $R^1$ and $R^2$ is still more preferably a substituted or unsubstituted alkyl group having 6 to 18 carbon atoms. Typical examples of the unsubstituted alkyl group having 6 to 18 carbon atoms include a n-hexyl group, a cyclohexyl group, a n-heptyl group, a n-octyl group, a 2-ethylhexyl group, a n-nonyl group, a 1,1,3-trimethylhexyl group, a n-decyl group, a n-dodecyl group, a cetyl group, a hexadecyl group, a 2-hexyldecyl group, an octadecyl group, and a 4-tert-butylcyclohexyl group. Further, typicalexamples of the substituted alkyl group having 6 to 18 carbon atoms in total include a phenetyl group, a 6-phenoxyhexyl group, a 12-phenyldodecyl group, an oleyl group, a linoleyl group, and a linolenyl group.

The alkyl group other than Rf independently represented by $R^1$ and $R^2$ is particularly preferably a n-hexyl group, a cyclohexyl group, a n-heptyl group, a n-octyl group, a 2-ethylhexyl group, a n-nonyl group, a 1,1,3-trimethylhexyl group, a n-decyl group, a n-dodecyl group, a cetyl group, a hexadecyl group, a 2-hexyldecyl group, an octadecyl group, an oleyl group, a linoleyl group and a linolenyl group, and most preferably a linear, cyclic or branched unsubstituted alkyl group having 8 to 16 carbon atoms.

In formula (1), $R^3$, $R^4$ and $R^5$ independently represent a hydrogen atom or a substituent. The substituent is, for example, an alkyl group (alkyl group preferably having 1 to 20 carbon atoms, more preferably 1 to 12 carbon atoms and particularly preferably 1 to 8 carbon atoms, such as a methyl group, an ethyl group, an isopropyl group, a tert-butyl group, a n-octyl group, a n-decyl group, a n-hexadecyl group, a cyclopropyl group, a cyclopentyl group and a cyclohexyl group), an alkenyl group (alkenyl group preferably having 2 to 20 carbon atoms, more preferably 2 to 12 carbon atoms and particularly preferably 2 to 8 carbon atoms, such as a vinyl group, an allyl group, a 2-butenyl group, and a 3-pentenyl group), an alkynyl group (alkynyl group preferably having 2 to 20 carbon atoms, more preferably 2 to 12 carbon atoms and particularly preferably 2 to 8 carbon atoms, such as a propalgyl group and a 3-pentynyl group), an aryl group (aryl group preferably having 6 to 30 carbon atoms, more preferably 6 to 20 carbon atoms and particularly preferably 6 to 12 carbon atoms, such as a phenyl group, a p-methylphenyl group, and a naphthyl group), a substituted or unsubstituted amino group (amino group preferably having 0 to 20 carbon atoms, more preferably 0 to 10 carbon atoms and particularly preferably 0 to 6 carbon atoms, such as an unsubstituted amino group, a methylamino group, a dimethylamino group, a diethylamino group, and a dibenzylamino group), an alkoxy group (alkoxy group preferably having 1 to 20 carbon atoms, more preferably 1 to 12 carbon atoms and particularly preferably 1 to 8 carbon atoms, such as a methoxy group, an ethoxy group, and a butoxy group), an aryloxy group (aryloxy group preferably having 6 to 20 carbon atoms, more preferably 6 to 16 carbon atoms and particularly preferably 6 to 12 carbon atoms, such as a phenyloxy group and a 2-naphthyloxy group), an acyl group (acyl group preferably having 1 to 20 carbon atoms, more preferably 1 to 16 carbon atoms and particularly preferably 1 to 12 carbon atoms, such as an acetyl group, a benzoyl group, a formyl group, and a pivaloyl group), an alkoxycarbonyl group (alkoxycarbonyl group preferably having 2 to 20 carbon atoms, more preferably 2 to 16 carbon atoms, and particularly preferably 2 to 12 carbon atoms, such as a methoxycarbonyl group, and an ethoxycarbonyl group), an aryloxycarbonyl group (aryloxycarbonyl group preferably having 7 to 20 carbon atoms, more preferably 7 to 16 carbon atoms, and particularly preferably 7 to 10 carbon atoms, such as a phenyloxycarbonyl group), an acyloxy group (acyloxy group preferably having 2 to 20 carbon atoms, more preferably 2 to 16 carbon atoms and particularly preferably 2 to 10 carbon atoms such as an acetoxy group and a benzoyloxy group), an acylamino group (acylamino group preferably having 2 to 20 carbon atoms, more preferably 2 to 16 carbon atoms and particularly preferably 2 to 10 carbon atoms, such as an acetylamino group and a benzoylamino group), an alkoxycarbonylamino group (alkoxycarbonylamino group preferably having 2 to 20 carbon atoms, more preferably 2 to 16 carbon atoms and particularly preferably 2 to 12 carbon atoms, such as a methoxycarbonylamino group), an aryloxycarbonylamino group (aryloxycarbonylamino group preferably having 7 to 20 carbon atoms, more preferably 7 to 16 carbon atoms and particularly preferably 7 to 12 carbon atoms, such as a phenyloxycarbonylamino group), a sulfonylamino group (sulfonylamino group preferably having 1 to 20 carbon atoms, more preferably 1 to 16 carbon atoms and particularly preferably 1 to 12 carbon atoms, such as a methanesulfonylamino group, and a benzenesulfonylamino group), a sulfamoyl group (sulfamoyl group preferably having 0 to 20 carbon atoms, more preferably 0 to 16 carbon atoms and particularly preferably 0 to 12 carbon atoms, such as an unsubstituted sulfamoyl group, a methylsulfamoyl group, a dimethylsulfamoyl group and a phenylsulfamoyl group), a carbamoyl group (carbamoyl group preferably having 1 to 20 carbon atoms, more preferably 1 to 16 carbon atoms and particularly preferably 1 to 12 carbon atoms, such as an unsubstituted carbamoyl group, a methylcarbamoyl group, a diethylcarbamoyl group, and a phenylcarbamoyl group), an alkylthio group (alkylthio group preferably having 1 to 20 carbon atoms, more preferably 1 to 16 carbon atoms and particularly preferably 1 to 12 carbon atoms, such as a methylthio group, and an ethylthio group), an arylthio group (arylthio group preferably having 6 to 20 carbon atoms, more preferably 6 to 16 carbon atoms and particularly preferably 6 to 12 carbon atoms, such as a phenylthio group), a sulfonyl group (sulfonyl group preferably having 1 to 20 carbon atoms, more preferably 1 to 16 carbon atoms and particularly preferably 1 to 12 carbon atoms, such as a mesyl group and a tosyl group), a sulfinyl group (sulfinyl group preferably having 1 to 20 carbon atoms, more preferably 1 to 16 carbon atoms and particularly preferably 1 to 12 carbon atoms, such as a methanesulfinyl group and a benzenesulfinyl group), an ureido group (ureido group preferably having 1 to 20 carbon atoms, more preferably 1 to 16 carbon atoms and particularly preferably 1 to 12 carbon atoms, such as an unsubstituted ureido group, a methylureido group and a phenylureido group), a phosphoric amide group (phosphoric amide group preferably having 1 to 20 carbon atoms, more preferably 1 to 16 carbon atoms and particularly preferably 1 to 12 carbon atoms, such as a diethylphosphoric amide group and a phenylphosphoric amide group), a hydroxy group, a mercapto group, a halogen atom (for example, a fluorine atom, a chlorine atom, a bromine atom, and an iodine atom), a cyano group, a sulfo group, a carboxyl group, a nitro group, a hydroxamate group, a sulfino group, a hydrazino group, an imino group, a heterocyclic group (heterocyclic group preferably having 1 to 30 carbon atoms and more preferably 1 to 12 carbon atoms, such as a heterocyclic group having as a hetero atom a nitrogen atom, an oxygen atom, or a sulfur atom, for example, an imidazolyl group, a pyridyl group, a quinolyl group, a furyl group, a piperizyl group, a morpholino group, a benzooxazolyl group, a benzimidazolyl group, and a benzthiazolyl group), a silyl group (silyl group preferably having 3 to 40 carbon atoms, more preferably 3 to 30 carbon atoms and particularly preferably 3 to 24 carbon atoms, such as a trimethylsilyl group and a triphenylsilyl group). The substituents described above may be further substituted. When the compound of formula (1) has two or more substituents, they may be identical or different. Further, they may bond to each other to form a ring, if possible.

Each of $R^3$, $R^4$ and $R^5$ preferably represents an alkyl group or hydrogen atom and still more preferably a hydrogen atom.

In the formula, $X^1$ and $X^2$ independently represent a bivalent connection group or a single bond. There is no particular restriction on the bivalent connection group. However, the bivalent connection group preferably represents an arylene group, —O—, —S—, or —$NR^{31}$— ($R^{31}$ represents a hydrogen atom or a substituent, the substituent is the same as the examples of the substituent represented by each of $R^3$, $R^4$ and $R^5$, and $R^{31}$ preferably represents an alkyl group, the Rf group described above or a hydrogen atom, and more preferably a hydrogen atom), or a combination thereof, and more preferably represents —O—, —S—, or —$NR^{31}$—. $X^1$ and $X^2$ are preferably —O— or —$NR^{31}$—, more preferably —O— or —NH— and particularly preferably —O—.

In the formula, Z represents a bivalent connection group or a single bond. There is no particular restriction on the bivalent connection group. However, the bivalent connection group preferably represents an alkylene group, an arylene group, —C (═O)—, —O—, —S—, —S (═O)—, —S $(═O)_2$— or —$NR^{32}$— ($R^{32}$ represents a hydrogen atom or a substituent, the substituent is the same as the examples of the substituent represented by $R^3$, $R^4$ and $R^5$, and $R^{32}$ preferably represents an alkyl group or a hydrogen atom and more preferably a hydrogen atom), or a combination thereof, and more preferably an alkylene group having 1 to 12 carbon atoms, an arylene group having 6 to 12 carbon atoms, —C (═O)—, —O—, —S—, —S (═O)—, —S $(═O)_2$— or —$NR^{32}$—, or a combination thereof. Z more preferably represents an alkylene group having 1 to 8 carbon atoms, —C(═O)—, —O—, —S—, —S(═O)—, —S$(═O)_2$— or —$NR^{32}$—, or a combination thereof. Examples of Z include the following groups.

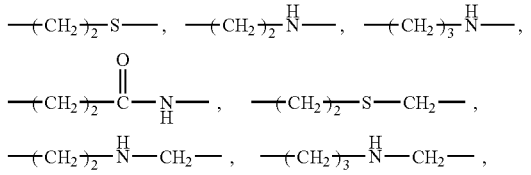

In the formula, $M^+$ represents a cationic substituent, and $M^+$ is preferably an organic cationic substituent, more preferably an organic cationic group containing a nitrogen or phosphorus atom, still more preferably a pyridinium cation or an ammonium cation, and most preferably a trialkylammonium cation represented by the following formula (2).

Formula (2)

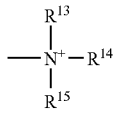

In formula, $R^{13}$, $R^{14}$ and $R^{15}$ independently represent a substituted or unsubstituted alkyl group. As the substituent of the substituted alkyl group, the examples of the substituent represented by $R^3$, $R^4$ and $R^5$ can be used. Further, $R^{13}$, $R^{14}$ and $R^{15}$ may bond to each other to form a ring, if possible. $R^{13}$, $R^{14}$ and $R^{15}$ is preferably an alkyl group having 1 to 12 carbon atoms, more preferably an alkyl group having 1 to 6 carbon atoms, still more preferably a methyl group, an ethyl group or a methylcarboxyl group, and particularly preferably a methyl group.

In the formula, $Y^-$ represents a counter anion, which may be an inorganic anion or an organic anion. Further, when the total static charge amount of the group of formula (2) is zero without $Y^-$, the group may not have $Y^-$. The inorganic anion is preferably an iodide ion, a bromide ion or a chloride ion. The organic anion is preferably a p-toluenesulfonate ion, a benzenesulfonate ion, a methanesulfonate ion, or a trifluoromethanesulfonate ion. $Y^-$ is more preferably an iodide ion, a p-toluenesulfonate ion, or a benzenesulfonate ion and still more preferably a p-toluenesulfonate ion.

In the formula, m is 0 or 1 and preferably 0.

Among the compounds represented by formula (1), compounds represented by the following formula (1-a) are preferable.

Formula (1-a)

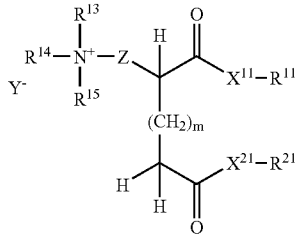

In the formula, $R^{11}$ and $R^{21}$ independently represent a substituted or unsubstituted alkyl group, provided that at least one of $R^1$ and $R^2$ represents the Rf group described above and the total number of carbon atoms in $R^{11}$ and $R^{21}$ is 19 or less. $R^{13}$, $R^{14}$ and $R^{15}$ independently represent a substituted or unsubstituted alkyl group, and may bond to each other to form a ring. $X^{11}$ and $X^{21}$ independently represent —O—, —S— or —$NR^{31}$— in which $R^{31}$ represents a hydrogen atom or a substituent, and Z represents a bivalent connection group or a single bond. $Y^-$ represents a counter anion, but, when the total static charge amount of the compound of formula (1-a) is 0 without $Y^-$, the compound may not have $Y^-$.

m is 0 or 1. In the formula, Z and $Y^-$ each have the same meanings as those in formula (1), respectively and preferred examples thereof are also the same. $R^{13}$, $R^{14}$, $R^{15}$ and m each have the same meanings as those in formula (1), respectively and preferred examples thereof are also the same.

In the formula, $X^{11}$ and $X^{12}$ independently represent —O—, —S— or —$NR^{31}$—. $R^{31}$ represents a hydrogen atom or a substituent. As the substituent, the examples of the substituent represented by $R^3$, $R^4$ and $R^5$ can be used. $R^{31}$ is preferably an alkyl group, the Rf group, or a hydrogen atom and more preferably a hydrogen atom. $X^{11}$ and $X^{21}$ are more preferably —O—, or —NH— and still more preferably —O—.

In the formula, $R^{11}$, and $R^{21}$ have the same meanings as $R^1$ and $R^2$ in formula (1), respectively and preferred examples thereof are also the same. The total number of carbon atoms in $R^{11}$ and $R^{21}$ is 19 or less. m is 0 or 1.

Specific examples of the compound represented by formula (1) are shown below but the invention is not restricted at all by the following specific examples. In the structure of the compounds exemplified below, an alkyl group and a perfluoroalkyl group have a linear structure unless otherwise specified. Further, among the abbreviations in the structure, 2EH is a 2-ethylhexyl group.

FS-1

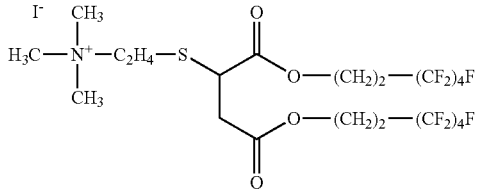

FS-2

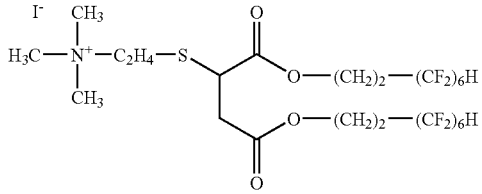

FS-3

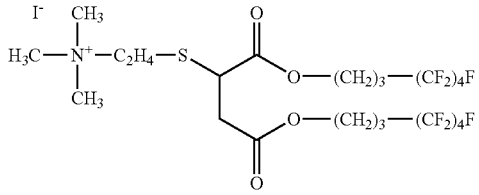

FS-4

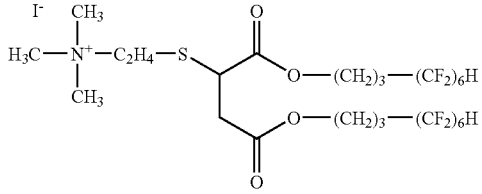

FS-5

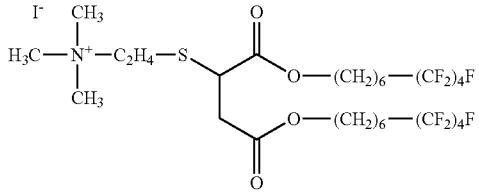

-continued
FS-6
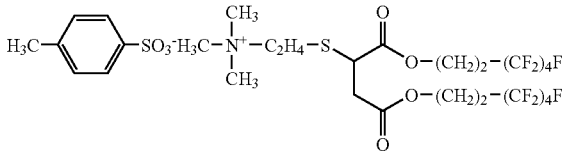
FS-7
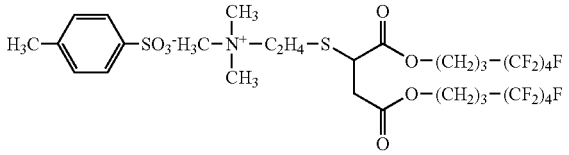
FS-8
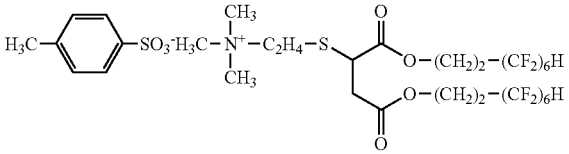
FS-9
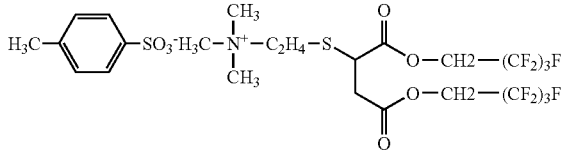
FS-10
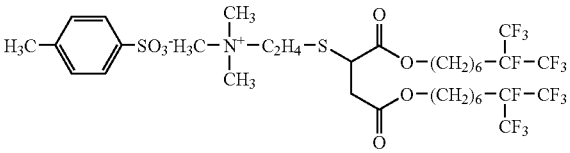
FS-11
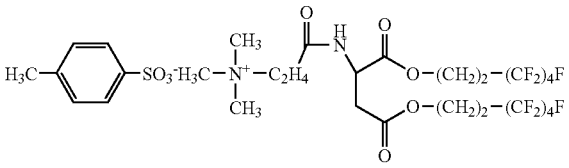
FS-12
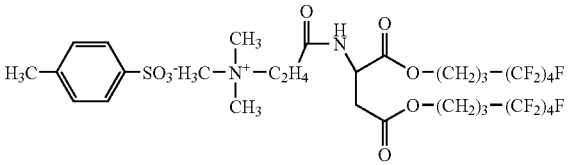
FS-13
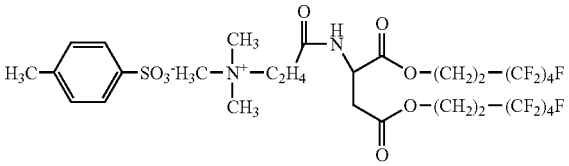
-continued
FS-14
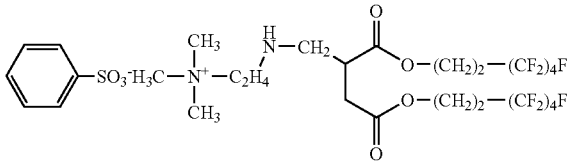
FS-15
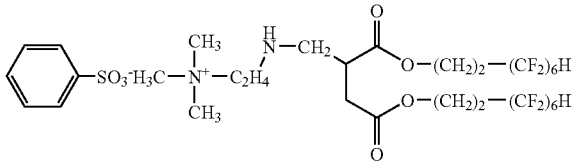
FS-16
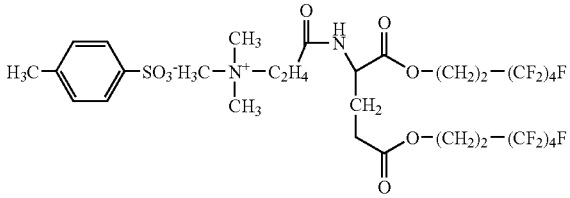
FS-17
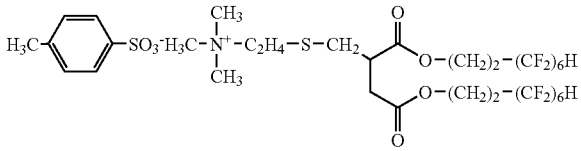
FS-18
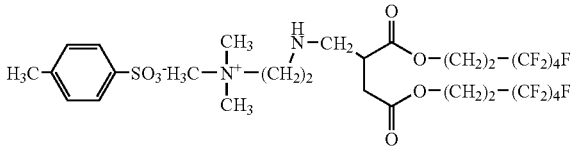
FS-19
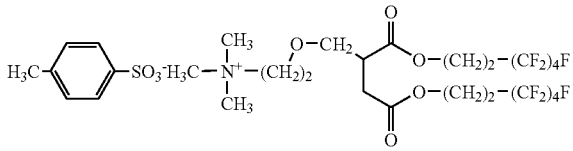
FS-20
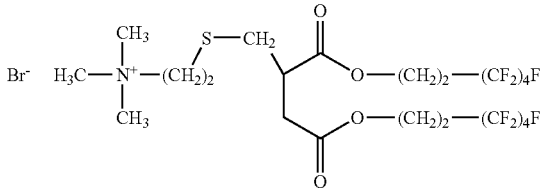
FS-21
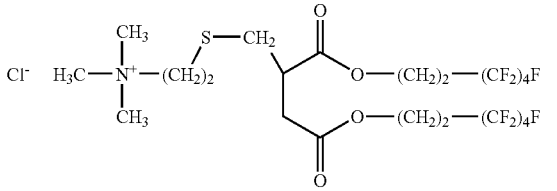

-continued
FS-22
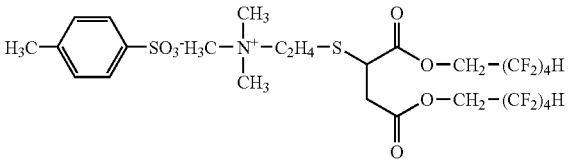
FS-23
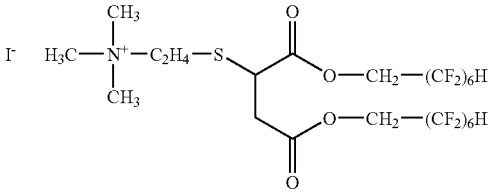
FS-24
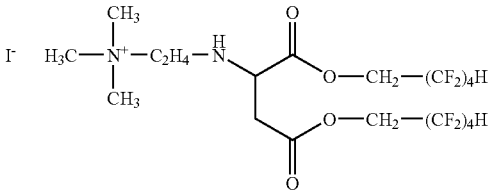
FS-25
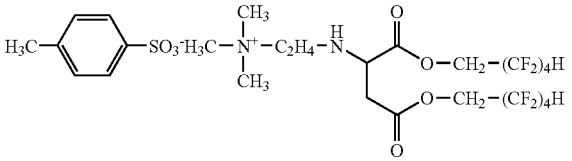
FS-26
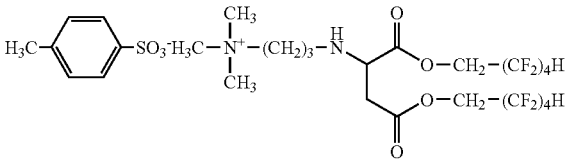
FS-27
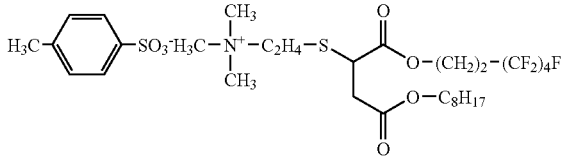
FS-28
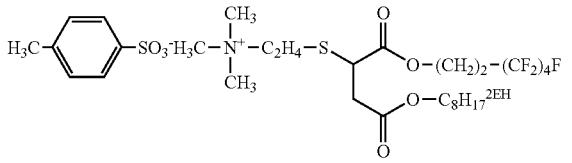
FS-29
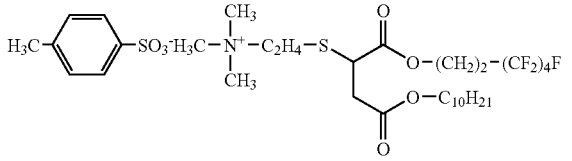
-continued
FS-30
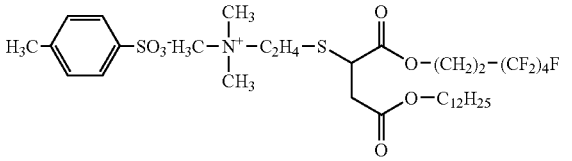
FS-31
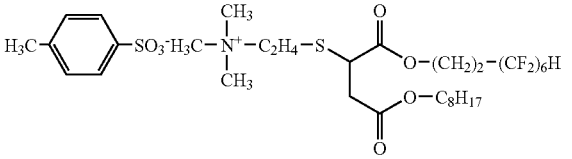
FS-32
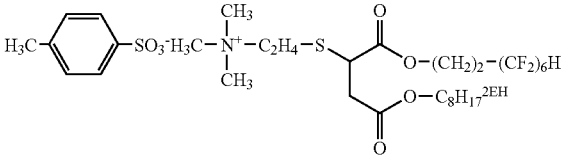
FS-33
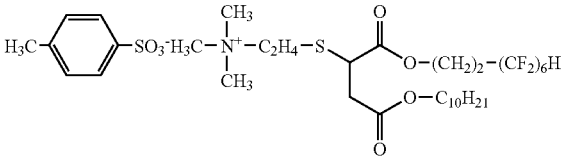
FS-34
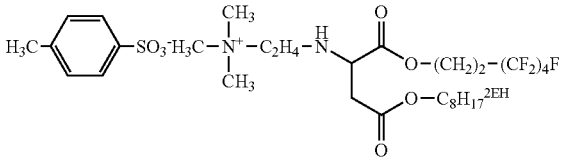
FS-35
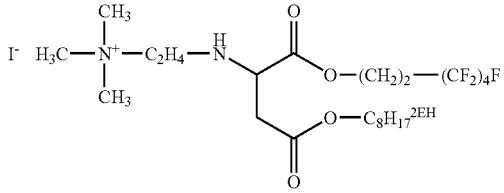
FS-36
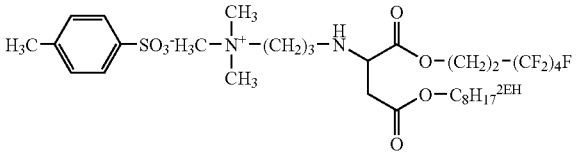
FS-37
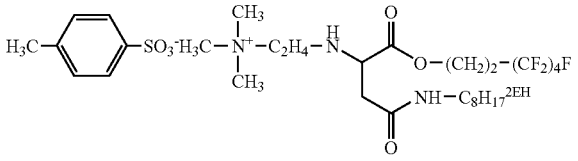

-continued
FS-38
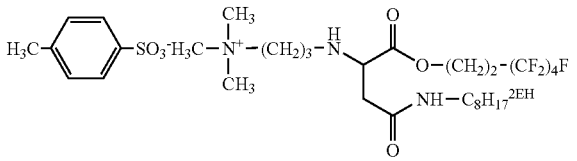
FS-39
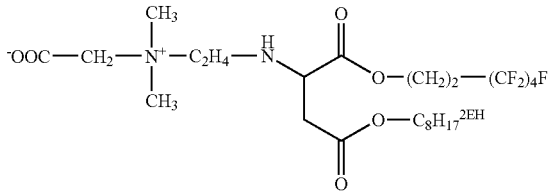
FS-40
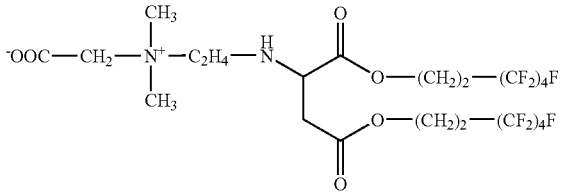
FS-41
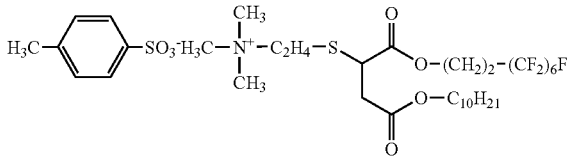
FS-42
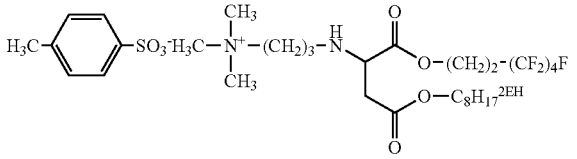
FS-43
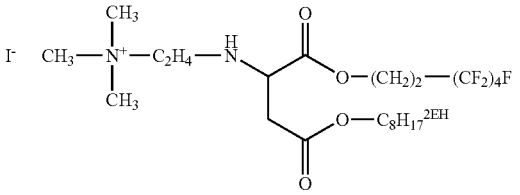
FS-44
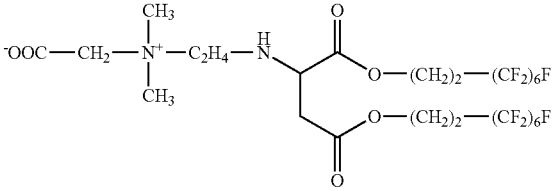
-continued
FS-45
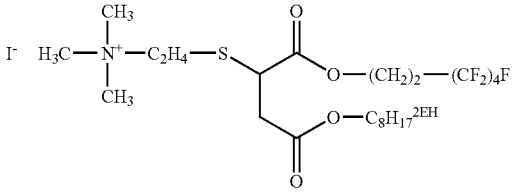
FS-46
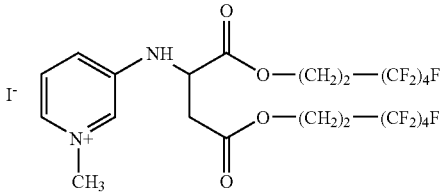
FS-47
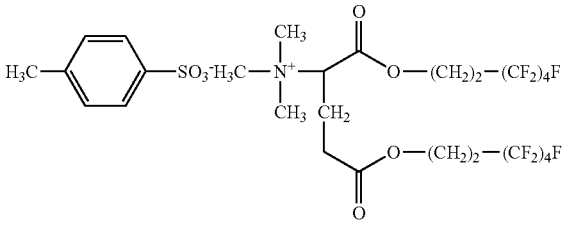
FS-48
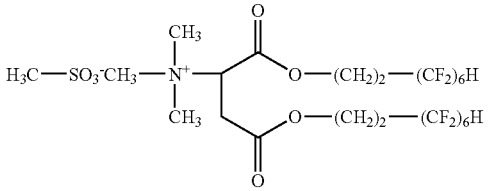
FS-49
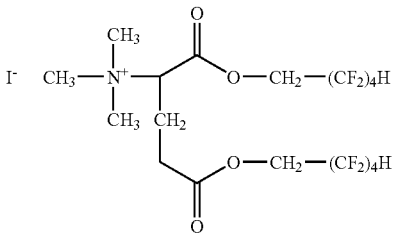
FS-50
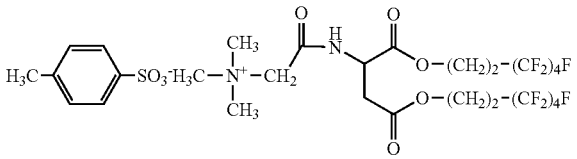
FS-51
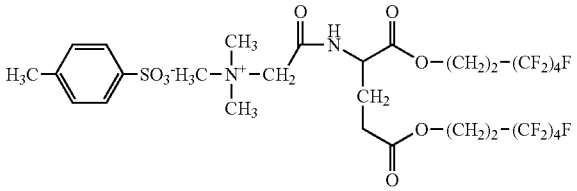

-continued
FS-52
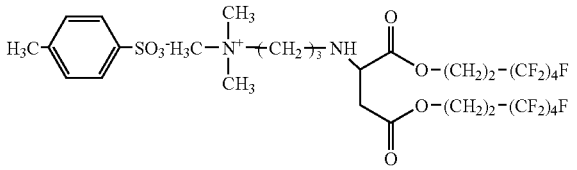
FS-53
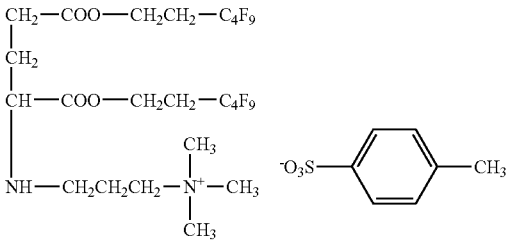
FS-54
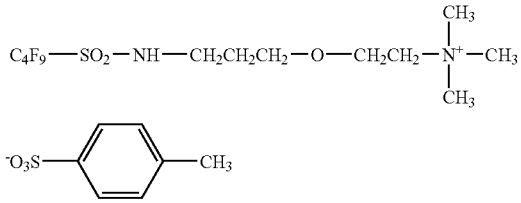
FS-55
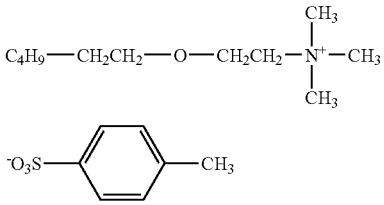
FS-56
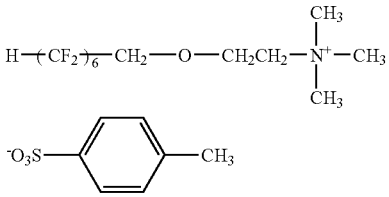
FS-57
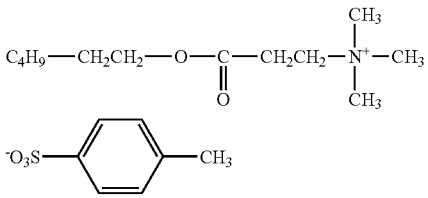
FS-58
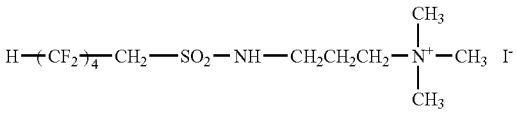
FS-59
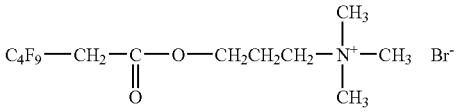
-continued
FS-60
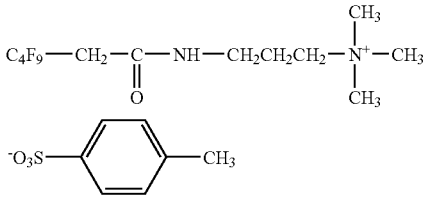
FS-61
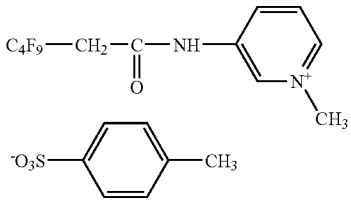
FS-62
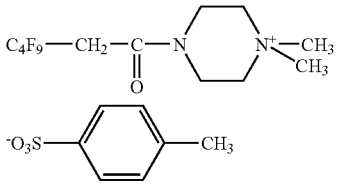
FS-63
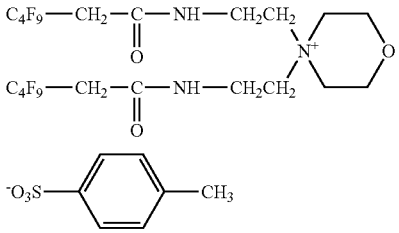
FS-64
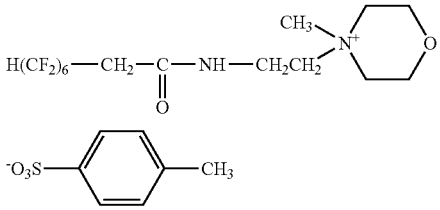
FS-65
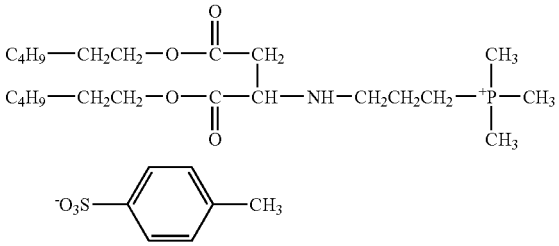
FS-66
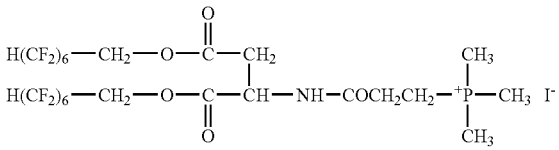
The compounds represented by formula (1) and (1-a) can be synthesized from a fumaric acid derivative, a maleic acid derivative, an itaconic acid derivative, a glutamic acid derivative, or an aspartic acid derivative serving as a starting material. For example, when a fumaric acid derivative, amaleic acid derivative or an itaconic acid derivative is used as the starting material, compounds can be synthesized by conduting Michael addition reaction between nuclearphilic species and the double bond of the starting material and then making the resultant a cation with an alkylating agent.

The fluorinated compound in the invention may also have an anionic hydrophilic group.

The anionic hydrophilic group is an acidic group with pKa of 7 or less and an alkali metal salt or an ammonium salt thereof. Specifically, examples thereof include a sulfo group, a carboxyl group, a phosphonate group, a carbamoylsulfamoyl group, a sulfamoylsulfamoyl group, an acylsulfamoyl group and salts thereof. Among them, a sulfo group, a carboxyl group, a phosphonate group and salts thereof are preferable and a sulfonate group and salts thereof are more preferable. Cationic species that form salts with the anion can be, for example, lithium, sodium, potassium, cesium, ammonium, tetramethylammonium, tetrabutylammonium or methylpyridinium and preferably lithium, sodium, potassium or ammonium.

A preferred fluorinated compound having the anionic hydrophilic group in the invention is represented by the following formula (3).

Formula 3

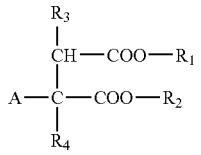

In the formula, $R^1$ and $R^2$ independently represent an alkyl group, provided at least one of them represents the Rf group. When $R^1$ and $R^2$ each represent an alkyl group other than the fluorinated alkyl group, the alkyl group preferably has 2 to 18 carbon atoms and more preferably 4 to 12 carbon atoms. $R^3$ and $R^4$independently represent a hydrogen atom or a substituted or unsubstituted alkyl group.

Specific examples of the fluorinated alkyl group represented by $R^1$ and $R^2$ include those described above and the preferred structure thereof is also identical to the structure represented by formula (A) described above. Further, a more preferred structure among them is also identical to those of the fluoroalkyl group described above. Each of the alkyl groups represented by $R^1$ and $R^2$ is preferably the fluoroalkyl group described above.

The substituted or unsubstituted alkyl group represented by $R^3$ and $R^4$ may have a linear, branched or cyclic structure. The substituent of the substituted alkyl group is not limited, however an alkenyl group, an aryl group, an alkoxy group, a halogen atom (preferably a chlorine atom), a carbonate group, a carbonamide group, a carbamoyl group, an oxycarbonyl group, and a phosphate group are preferable.

A represents $-L_b-SO_3M$ in which M represents a cation. The cation represented by M is preferably, for example, an alkali metal ion (a lithium ion, a sodium ion, or a potassium ion), an alkaline earth metal ion (a barium ion, or a calcium ion), or an ammonium ion. Among them, more preferred are a lithium ion, a sodium ion, a potassium ion and an ammonium ion, and still more preferred are a lithium ion, a sodium ion and a potassium ion. A can be selected properly depending on the total number of carbon atoms, the substituent and the degree of branching of the alkyl group of the compound represented by formula (3). When the total number of carbon atoms of $R^1$, $R^2$, $R^3$ and $R^4$ is 16 or more, M is preferably a lithium ion in view of the compatibility between the solubility of the compound (particularly in water) and the antistatic performance or the uniformness of coating.

$L_b$ represents a single bond or a substituted or unsubstituted alkylene group. The examples of the substituent when $R^3$ is a substituted alkyl group is preferable as the substituent when $L_b$ is a substituted alkylene group. When $L_b$ is an alkylene group, the alkylene group preferably has 2 or less carbon atoms. $L_b$ is preferably a single bond or $—CH_2—$ group and most preferably $—CH_2—$ group.

In formula (3), it is preferable to combine the preferred examples of each component described above.

Specific examples of the fluorinated compound used in the invention are shown below but the invention is not restricted at all by the following specific examples.

In the structure of the compounds exemplified below, an alkyl group and a perfluoroalkyl group have a linear structure unless otherwise specified.

(F-1)

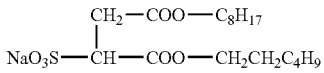

(F-2)

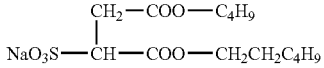

(F-3)

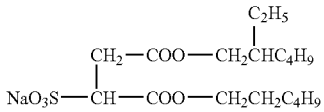

(F-4)

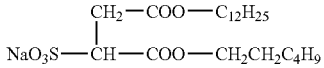

(F-5)

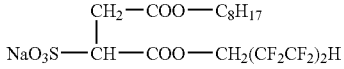

(F-6)

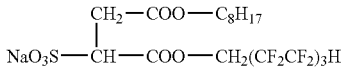

(F-7)

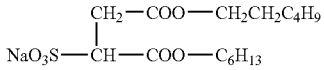

(F-8)

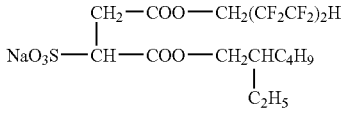

(F-9)

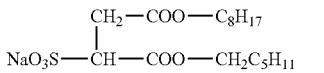

(F-10)

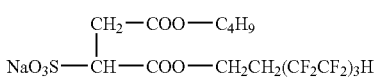

(F-11)

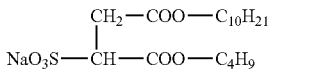

(F-12)

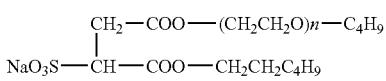

n = 5 ~ 15

-continued (F-13)

$NaO_3SCH_2-CH(CH_2-COO-C_8H_{17})-COO-CH_2CH_2C_4H_9$ (F-14)

$NaO_3SCH_2-CH(CH_2-COO-CH_2CH_2C_4H_9)-COO-C_{12}H_{25}$ (F-15)

$NaO_3SCH_2-CH(CH_2-COO-C_8H_{17})-COO-CH_2(CF_2CF_2)_2H$ (F-16)

$NaO_3SCH_2-CH(CH_2-COO-CH_2(CF_2CF_2)_3H)-COO-CH_2CH(C_2H_5)C_4H_9$ (F-17)

$NaO_3S-CH(CH_2-COO-CH_2CH_2C_4F_9)-COO-CH_2CH_2C_4F_9$ (F-18)

$NaO_3S-CH(CH_2-COO-CH_2CH_2C_3F_7)-COO-CH_2CH_2C_3F_7$ (F-19)

$NaO_3S-CH(CH_2-COO-CH_2CH_2C_5F_{11})-COO-CH_2CH_2C_5F_{11}$ (F-20)

$NaO_3S-CH(CH_2-COO-CH_2C_4F_9)-COO-CH_2C_4F_9$ (F-21)

$NaO_3S-CH(CH_2-COO-C_4F_9)-COO-C_4F_9$ (F-22)

$NaO_3S-CH(CH_2-COO-C_4F_9)-COO-CH_2CH_2C_4F_9$ (F-23)

$NaO_3S-CH(CH_2-COO-CH_2CH_2CF(CF_3)_2)-COO-CH_2CH_2CF(CF_3)_2$ (F-24)

$NaO_3S-CH(CH_2-COO-CH_2CH_2C_2F_5)-COO-CH_2CH_2C_4F_9$ (F-25)

$NaO_3S-CH(CH_2-COO-CH_2(CF_2CF_2)_2H)-COO-CH_2(CF_2CF_2)_2H$ (F-26)

$NaO_3S-CH(CH_2-COO-CH_2(CF_2CF_2)_3H)-COO-CH_2(CF_2CF_2)_3H$ (F-27)

$NaO_3S-CH(CH_2-COO-CH_2CF_2CF_2H)-COO-CH_2(CF_2CF_2)_3H$ (F-28)

$NaO_3S-CH(CH_2-COO-(CH_2CH_2O)nC_4H_9)-COO-(CH_2CH_2O)nC_4H_9$ n = 5 ~ 15

(F-29)

$NaO_3SCH_2-CH(CH_2-COO-CH_2CH_2C_4H_9)-COO-CH_2CH_2C_4H_9$ (F-30)

$NaO_3SCH_2-CH(CH_2-COO-CH_2CH_2C_3H_7)-COO-CH_2CH_2C_3H_7$

-continued (F-31)

$NaO_3SCH_2-CH(CH_2-COO-CH_2CH_2C_5F_{11})-COO-CH_2CH_2C_5F_{11}$ (F-32)

$NaO_3SCH_2-CH(CH_2-COO-CH_2CH_2C_6F_{12}H)-COO-CH_2CH_2C_6F_{12}H$ (F-33)

$NaO_3SCH_2-CH(CH_2-COO-CH_2(CF_2CF_2)_2H)-COO-CH_2(CF_2CF_2)_2H$ (F-34)

$NaO_3SCH_2-CH(CH_2-COO-CH_2(CF_2CF_2)_3H)-COO-CH_2(CF_2CF_2)_3H$ (F-35)

$NaO_3SCH_2-CH(CH_2-COO-CH_2CF_2CF_2H)-COO-CH_2(CF_2CF_2)_3H$ (F-36)

$NaO_3SCH_2-CH(CH_2-COO-CH_2CH_2CF(CF_3)_2)-COO-CH_2CH_2CF(CF_3)_2$ (F-37)

$NaO_3SCH_2-CH(CH_2-COO-CH_2CH(C_2F_5)_2)-COO-CH_2CH(C_2F_5)_2$ (F-38)

$NaO_3S-CH(CH_3)-CH(COO-CH_2CH_2C_4F_9)-COO-CH_2CH_2C_4F_9$ (F-39)

$NaO_3S-CH(CH(COO-CH_2CH_2C_4F_9)-CH(COO-CH_2CH_2C_4F_9))-COO-CH_2CH_2C_4F_9$ (F-40)

$NaO_3S-CH(CH(COO-CH_2(CF_2C_2F)_2H)-CH(COO-CH_2(CF_2CF_2)_2H))-COO-CH_2(CF_2CF_2)_2H$ (F-41)

$NaO_3SCH_2CH_2-CH(CH(COO-CH_2CH_2C_4F_9))-COO-CH_2CH_2C_4F_9$ (F-42)

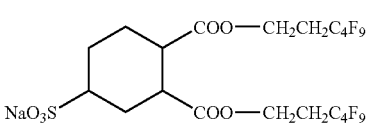

(F-43)

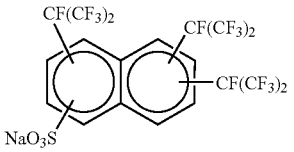

(F-44)

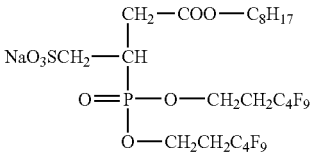

(F-45)

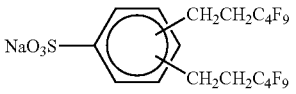

-continued (F-46)

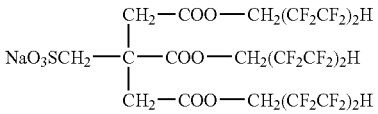

(F-47)

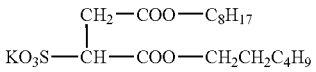

(F-48)

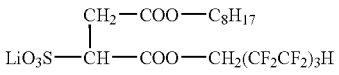

(F-49)

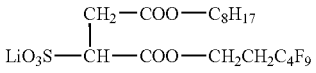

(F-50)

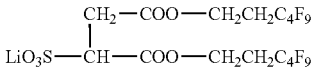

(F-51)

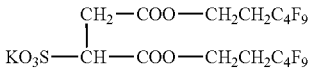

(F-52)

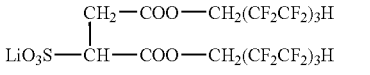

(F-53)

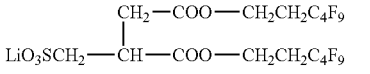

(F-54)

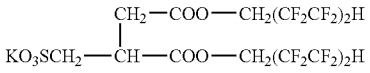

(F-55)

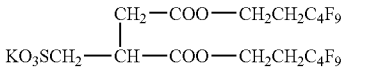

(F-56)

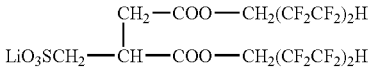

The fluorinated compound in the invention may have a nonionic hydrophilic group.

The nonionic hydrophilic group means a group which can be dissolved in water without dissociating into ions. Specific examples therof include, but are not limited to, a poly (oxyethylene) alkyl ether and a polyhydric alcohol.

In the invention, preferred nonionic fluorinated compounds are represented by the following formula (4).

Formula (4)

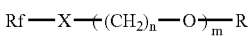

In formula (4), Rf is the fluoroalkyl group described above, specific examples of Rf include those described above, and a preferred structure thereof is the same as the structure represented by formula (A) described above. Further, more preferred structures among them are also identical to those of the Rf group.

X in formula (4) represents a bivalent connection group and any bivalent connection group can be used. However, examples thereof include the following groups.

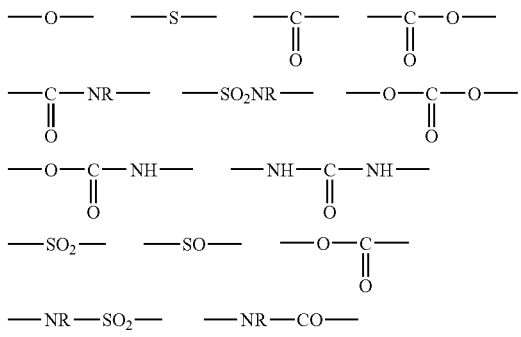

In formula (4), n represents an integer of 2 or 3 and m represents an integer of 1 to 30. R represents a hydrogen atom, an alkyl group, an aryl group, a heterocyclic ring group or the Rf group, or a group having one or more Rf group as the substituent.

Specific examples of the nonionic fluorinated compound used in the invention are exemplified below but the invention is not restricted at all by the following specific examples.

FN-1

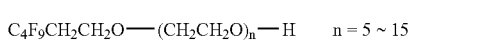

FN-2

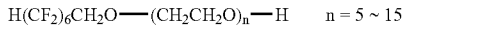

FN-3

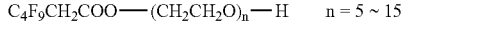

FN-4

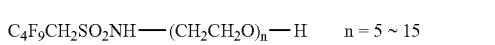

FN-5

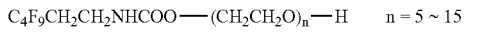

FN-6

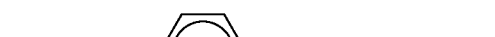

FN-7

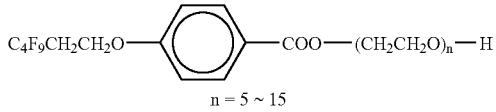

FN-8

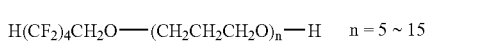

FN-9

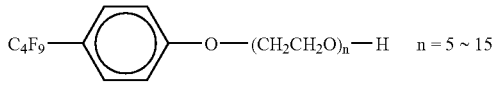

FN-10

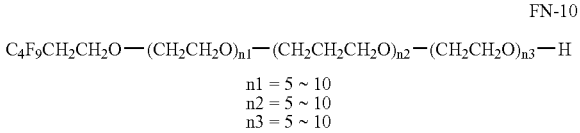

FN-11

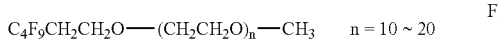

FN-12

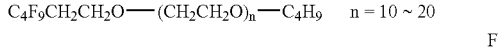

FN-13

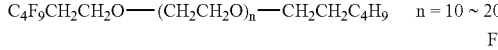

FN-14

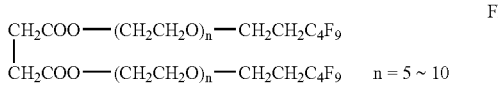

-continued

FN-15

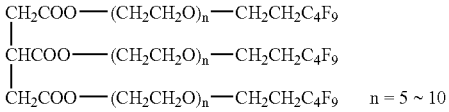

FN-16

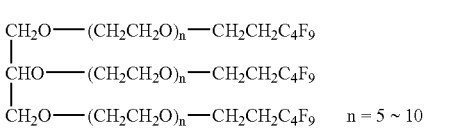

FN-17

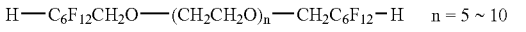

FN-18

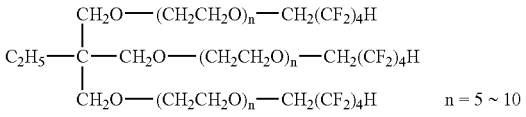

The fluorinated compound used in the invention is preferably employed as a surfactant in a coating composition for forming any of layers provided at the image forming layer side. The use of the fluorinated compound in the formation of the outermost layer of the photosensitive material is particularly preferable since effective antistatic performance and uniformness of coating can be obtained. While the fluorinated compound used in the invention is useful for providing the antistatic performance and the uniformness of coating, it is also effective for improvement of storage stability and dependence on working circumstance.

There is no particular restriction on the amount of the fluorinated compound used in the invention, and the amount may be determined in accordance with the structure of the fluorinated compound used, a place where it is used, and the kind or amount of other materials contained in the composition. For example, when it is used as the coating liquid for the outermost layer of the heat-developable photosensitive material, the coating amount of the fluorinated compound in the coating composition is preferably 0.1 to 100 mg/m$^2$, and more preferably 0.5 to 20 mg/m$^2$.

In the invention, one fluorinated compound may be used alone or two or more kinds of the compounds may be used in admixture. Further, other fluorinated compound than the above-mentioned fluorinated compound in the invention may be used together. In addition, a surfactant other than the fluorinated compound in the invention may be used together with the fluorinated compound.

Others

The surface protection film is also described in JP-A No. 11-65021, paragraphs 0119 to 0120, and JP-A No. 2000-171936.

Description of the Layer Adjacent to the Outermost Layer

In order to improve the coatability of a binder containing the latex of a hydrophobic polymer not having a setting property, a binder that gels due to temperature reduction is preferably used in a layer adjacent to the outermost layer in the invention. Such a binder may be a water-soluble polymer derived from animal proteins such as gelatin, a hydrophobic polymer including a gellant, or a water-soluble polymer not derived from animal proteins including a gellant.

That is, a binder having a setting property is used in the layer adjacent to the outermost layer to suppress fluidity of the outermost layer and improve coatability of the coating liquid for the layer. The above binder improves the coatability extremely. Since the surface state of the photosensitive material has a significant effect on image formation and image storability, improvement of the coatability contributes much to provision of a heat-developable photosensitive material having good storage stability before image formation, less fluctuation of sensitivity and excellent storage stability in a dark place after image formation.

In other words, since the fluidity of the layer formed by application is lost by geling of the layer, the surface of the image forming layer less undergoes the effect of drying blow in the drying step conducted after the coating step, and a heat-developable photosensitive material having a uniform coating surface state can be obtained.

It is important that the coating liquid does not gel at the time of coating. In view of easy operation, the coating liquid has fluidity during coating and the binder in the coating liquid gels to make the formed layer lose the fluidity after the coating and before the drying step.

The viscosity of the coating liquid during coating is preferably from 5 mPa·s to 200 mPa·s, and more preferably 10 mPa·s to 100 mPa·s.

In the invention, a water-based solvent is used as the solvent of the coating liquid. The water-based solvent is water or a mixture of water and 70 mass % or less of a water-miscible organic solvent. Examples of the water-miscible organic solvent include alcohols such as methyl alcohol, ethyl alcohol, and propyl alcohol, cellosolves such as methyl cellosolve, ethyl cellosolve, and butyl cellosolve, ethyl acetate, and dimethyl formamide.

It is difficult to measure the viscosity of the formed layer after coating and before the drying step (since the layer has geled at this time) but the viscosity is estimated to be about 2000 mPa·s to about 5000 mPa·s and preferably 500 mPa·s to 5000 mPa·s.

While there is no particular restriction on the temperature at which the binder gels, the geling temperature is preferably near room temperature in view of efficiency of the coating operation. This is because, when the geling tempetarue is close to room temperature, ordinaryily heating the coating liquid can easily increase the fluidity thereof in order to facilitate coating, it is easy to maintain the increased fluidity (in other words, it is easy to maintain the elevated temperature), and it is easy to cool the formed layer in order to lose the fluidity. Specifically, a preferred geling temperature is 0° C. to 40° C. and more preferably 0° C. to 35° C.

There is no particular restriction on the temperature of the coating liquid during coating so long as it is higher than the geling temperature. Moreover, there is no particular restriction on the cooling temperature after the coating and before the drying step so long as it is lower than the geling temperature. However, when the difference between the temperature of the coating liquid and the cooling temperature is small, the geling of the formed layer starts in the course of coating, making it impssoble to form a uniform coating. Further, when the temperature of the coating liquid is excessively high in order to increase the difference, the solvent of the coating liquid evaporizes, changing the viscosity of the coating liquid. Accordingly, the temperature difference is preferably set to 5° C. to 50° C. and more preferably 10° C. to 40° C.

Description of Gellant

A gellant in the invention is a substance which, when cooled, causes an aqueous solution of a water-soluble polymer not derived from animal proteins or an aqueous latex solution of a hydrophobic polymer, to which the gellant is added, to gel, or a substance which causes the aqueous solution or the aqueous latex solution to gel when used in combination with a geling accelerator. The geling of the coated layer remarkably lowers the fluidity thereof.

Specific examples of the gellant include water-soluble polysaccharides, such as agar, κ-carrageenan, ι-carrageenan, alginic acid, alginates, agarose, furcellaran, gellan gum, glucono delta lacton, azodobactor vinelandii gum, xanthan gum, low methoxyl pectin, pectin, guar gum, locust been gum, tara gum, cassia gum, glucomannan, tragacanth gum, karaya gum, pullulan, arabic gum, arabino galactan, dextran, carboxymethyl cellulose sodium salt, methyl cellulose, psyllium seed gum, starch, chitin, chitosan, and curdlan.

The substance that gels by cooling after heat-melting it can be agar, carrageenan or gellan gum.

Among the gellnats, κ-carrageenan (for example, K-9F manufactured by Taito Co., Ltd., and K-15, K-21 to 24, and I-3 manufactured by Nitta Gelatin Inc.), ι-carrageenan, and agar are more preferable, and κ-carrageenan is particularly preferable.

The gellant is preferably used in an amount of from 0.01 mass % to 10.0 mass %, preferably 0.02 mass % to 5.0 mass % and more preferably 0.05 mass % to 2.0 mass % based on the binder polymer.

The gellant is preferably used together with a geling accelerator. The geling accelerator in the invention is a compound for accelerating geling when brought into contact with the gellant and exhibits its function in a specific combination with the gellant. In the invention, the following combinations can be used as a combination of the gellant and the geling accelerator.

(1) a combination of, as the geling accelerator, ions of an alkali metal such as potassium, or an alkaline earth metal such as calcium or magnesium, and, as the gellant, carrageenan, alginate, gellan gum, azodobactor vinelandii gum, xanthan gum, pectin or sodium carboxymethyl cellulose
(2) a combination of, as the geling accelerator, boric acid or other boron compounds, and, as the gellant, guar gum, locust bean gum, tara gum, or cassia gum
(3) a combination of, as the geling accelerator, acid or alkali and, as the gellant, alginate, glucomannan, pectin, chitin, chitosan, or curdlan
(4) A water-soluble polysaccharide which reacts with the gellant to form a gel is used as the geling accelerator. Specifically, a combination of xanthan gum as the gellant and cassia gum as the geling accelerator and a combination of carrageenan as the gellant and locust bean gum as the geling accelerator can be used.

Specific examples of the combination of the gellant and the geling accelerator include the following (a)-(g).

(a) a combination of κ-carrageenan and potassium
(b) a combination of ι-carrageenan and calcium
(c) a combination of low methoxyl pectin and calcium
(d) a combination of sodium alginate and calcium
(e) a combination of gellan gum and calcium
(f) a combination of gellan gum and acid
(g) a combination of locust bean bum and xanthan gum These combinations may be used in combination.

The geling accelerator may be added to a layer to which the gellant is added but it is preferable to add the accelerator to a layer different from the layer which the gellant is added. More preferably, the accelerator is added to a layer which is not directly adjacent to the layer including the gellant. That is, it is more preferable to dispose a layer containing neither the gellant nor the geling accelerator between the layer containing the gellant and the layer containing the geling accelerator.

The geling accelerator is preferably used in an amount of 0.1 mass % to 200 mass % and preferably 1.0 mass % to 100 mass % based on the gellant.

Description of Image Forming Layer

The heat-developable photosensitive material of the invention has an image forming layer containing a photosensitive silver halide, a non-photosensitive organic silver salt, a reducing agent and a binder on at least one surface of a support. The image forming layer in the invention has at least one layer on the support. When the image forming layer is one layer, it includes the organic silver salt, the photosensitive silver halide, the reducing agent and the binder and optionally contains additional materials such as a color toning agent, a covering aid and other auxiliary agents as required. When the image forming layer has at least two layers, it is necessary that a first image forming layer (usually, a layer adjacent to the support) contains the organic silver salt and the photosensitive silver halide and that some of other ingredients are contained in a second image forming layer or in both of the first and second image forming layers. The multi-color heat-developable photosensitive material may have such a combination of two layers for each color or, as described in U.S. Pat. No. 4,708,928, may include all the ingredients in a single layer. In the case of multi-dye multi-color heat-developable photosensitive material, a functional or non-functional barrier layer is disposed between each of the image forming layers (emulsion layers), as described in U.S. Pat. No. 4,460,681.

Description of Organic Silver Salt

1) Composition

The organic silver salt usable in the invention is relatively stable to light and functions as a silver ion donor when heated at 80° C. or higher in the presence of an exposed photosensitive silver halide and a reducing agent, to form silver images. The organic silver salt may be any organic substance capable of supplying silver ions that can be reduced by the reducing agent. The non-photosensitive organic silver salt is described, for example, in JP-A No. 10-62899, paragraphs 0048 to 0049, EP-A No. 0803764 A1, from page 18, line 24 to page 19, line 37, EP-A No. 0962812 A1, and JP-A Nos. 11-349591, 2000-7683 and 2000-72711. Among them, silver salts of organic acids, particularly silver salts of long chain aliphatic carboxylic acids (those having 10 to 30 carbon atoms, and preferably 15 to 28 carbon atoms) are preferable. Typical examples of the fatty acid silver salts include silver lignocerate, silver behenate, silver arachidate, silver stearate, silver oleate, silver laurate, silver caproate, silver myristate, silver palmitate, silver erucate and mixtures thereof. In the invention, it is preferable to use, among the fatty acid silver salts, fatty acid silver salts with a silver behenate content of preferably 50 mol % to 100 mol %, more preferably 85 mol % to 100 mol %, and still more preferably 95 mol % to 100 mol %. Further, it is preferable to use fatty acid silver salts with a silver erucate content of 2 mol % or less, more preferably 1 mol % or less and still more preferably 0.1 mol % or less.

2) Shape

There is no particular restriction on the shape of the organic silver salt usable in the invention and the shape may be any of needle-like, bar-like, tabular or scale-like shape.

The grain size distribution of the organic silver salt is preferably mono-dispersion. Mono-dispersion is such that the percentage of a value obtained by dividing the standard deviations of the lengths of the minor axes and the major axes of grains by the lengths of the minor axis and the major axis of each grain, respectively, is preferably at most 100%, more preferably at most 80%, and even more preferably at most 50%. The shape of the organic silver salt grain can be determined from the image of an organic silver salt dispersion taken by using a transmission electronic microscope. Another method for measuring the mono-dispersing properties of the organic silver salt includes determining the standard deviation of the volume weighted mean diameter of the salt grains. In the method, the percentage of a value obtained by dividing the standard deviation by the volume weighted mean diameter of the salt grain (coefficient of variation) is preferably at most 100%, more preferably at most 80%, and even more preferably at most 50%. Concretely, for example, a sample of the organic silver salt is dispersed in a liquid, the resulting dispersion is exposed to laser rays, and the self-correlation function of the fluctuation of the scattered rays relative to time change is obtained. Based on this, the grain size (volume weighted mean diameter) of the salt grains is obtained.

3) Preparation

In preparing and dispersing the organic acid silver salts for use in the invention, any known method can be used. Specifically, methods disclosed in, for example, JP-A No. 10-62899; EP-A Nos. 0803763A1 and 0962812A1; and JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868 can be used.

It is preferable that the organic silver salt is dispersed substantially in the absence of a photosensitive silver salt, since the photosensitive silver salt, if any, in the dispersing system, is fogged and its sensitivity significantly decreases. In the invention, the amount of the photosensitive silver salt that may be contained in the water dispersion of the organic silver salt is preferably at most 1 mol %, and more preferably at most 0.1 mol % relative to one mol of the organic acid silver salt therein. It is even more preferable that no photosensitive silver salt is positively added to the water dispersion.

An organic silver salt water dispersion may be mixed with a photosensitive silver salt water dispersion to prepare a heat-developable photosensitive material of the invention. The blend ratio of the organic silver salt to the photosensitive silver salt in the mixture may be suitably determined depending on the object of the invention. The blend ratio of the photosensitive silver salt to the organic silver salt in the mixture is preferably 1 to 30 mol %, more preferably 2 to 20 mol %, and even more preferably 3 to 15 mol %. Mixing two or more different types of organic silver salt water dispersions with two or more different types of photosensitive silver salt water dispersions is preferred for controlling the photographic properties of the resulting heat-developable photosensitive material.

4) Addition Amount

The organic silver salt used in the invention can be used in a desired amount. The total coating amount of silver, including silver halide, is preferably from 0.1 to 5.0 g/m$^2$, more preferably from 0.3 to 3.0 g/m$^2$ and still more preferably from 0.5 to 2.0 g/m$^2$. In particular, in order to improve image storability, the total coating amount of silver is preferably 1.8 g/m$^2$ or less and more preferably 1.6 g/m$^2$ or less. When a preferred reducing agent in the invention is used, sufficient image density can be obtained even at such a low silver content.

Explanation of Reducing Agent

The heat-developable photosensitive material of the invention preferably contains a heat-developing agent which is a reducing agent for the organic silver salt. The reducing agent for the organic silver salt may be any substance capable of reducing silver ions into metal silver, but is preferably an organic substance. Examples of the reducing agent are described in JP-A No. 11-65021, paragraphs 0043 to 0045 and in EP-A No. 0803764A1, from page 7, line 34 to page 18, line 12.

Hindered phenols having a substituent in an ortho position relative to the phenolic hydroxyl group therein, or bisphenols are preferable for the reducing agent for use in the invention; and compounds of the following formula (R) are more preferable.

Formula (R)

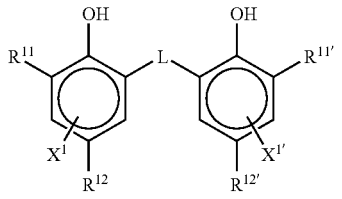

In formula (R), $R^{11}$ and $R^{11'}$ each independently represent an alkyl group having 1 to 20 carbon atoms; $R^{12}$ and $R^{12'}$ each independently represent a hydrogen atom, or a substituent which can bond to a benzene ring; L represents a group of —S— or —CHR$^{13}$—; $R^{13}$ represents a hydrogen atom or an alkyl group having 1 to 20 carbon atoms; $X^1$ and $X^{1'}$ each independently represent a hydrogen atom, or a substituent which can bond to a benzene ring.

Compounds of formula (R) will be described in detail.

1) $R^{11}$ and $R^{11'}$ $R^{11}$ and $R^{11'}$ each independently represent a substituted or unsubstituted alkyl group having 1 to 20 carbon atoms. The substituent of the substituted alkyl group is not specifically limited, but is preferably, for example, an aryl group, a hydroxyl group, an alkoxy group, an aryloxy group, an alkylthio group, an arylthio group, an acylamino group, a sulfonamido group, a sulfonyl group, a phosphoryl group, an acyl group, a carbamoyl group, an ester group, an ureido group, an urethane group, or a halogen atom.

2) $R^{12}$ and $R^{12'}$, $X^1$ and $X^{1'}$ $R^{12}$ and $R^{12'}$ each independently represent a hydrogen atom, or a substituent which can bond to a benzene ring; and $X^1$ and $X^{1'}$ each independently represent a hydrogen atom, or a substituent which can bond to a benzene ring. Typical examples of the substituent which can bond to a benzene ring include an alkyl group, an aryl group, a halogen atom, an alkoxy group, and an acylamino group.

3) L

L represents a group of —S— or —CHR$^{13}$—. $R^{13}$ represents a hydrogen atom or an alkyl group having 1 to 20 carbon atoms. The alkyl group may be substituted. Examples of the unsubstituted alkyl group represented by $R^{13}$ include a methyl group, an ethyl group, a propyl group, a butyl group, a heptyl group, an undecyl group, an isopropyl group, a 1-ethylpentyl group and a 2,4,4-trimethylpentyl group. Examples of the substituent of the substituted alkyl group may be the same as those for $R^{11}$, and include a halogen atom, an alkoxy group, an alkylthio group, an aryloxy group, an arylthio group, an acylamino group, a sulfonamido group, a sulfonyl group, a phosphoryl group, an oxycarbonyl group, a carbamoyl group, and a sulfamoyl group.

4) Typical Substituents $R^{11}$ and $R^{11'}$ are preferably a secondary or tertiary alkyl group having 3 to 15 carbon atoms. Specific examples thereof include an isopropyl group, an isobutyl group, a t-butyl group, a t-amyl group, a t-octyl group, a cyclohexyl group, a cyclopentyl group, a 1-methylcyclohexyl group and a 1-methylcyclopropyl group. $R^{11}$ and $R^{11'}$ are more preferably a tertiary alkyl group having 4 to 12 carbon atoms, and even more preferably a t-butyl group, a t-amyl group and a 1-methylcyclohexyl group. A t-butyl group is the most preferable.

$R^{12}$ and $R^{12'}$ are preferably an alkyl group having 1 to 20 carbon atoms. Specific examples thereof include amethyl group, an ethyl group, apropyl group, abutyl group, an isopropyl group, a t-butyl group, a t-amyl group, a cyclohexyl group, a 1-methylcyclohexyl group, a benzyl group, a methoxymethyl group and a methoxyethyl group. A methyl group, an ethyl group, a propyl group, an isopropyl group and a t-butyl group are more preferable.

$X^1$ and $X^{1'}$ are preferably a hydrogen atom, a halogen atom and an alkyl group, and more preferably a hydrogen atom.

L is preferably —$CHR^{13}$—.

$R^{13}$ is preferably a hydrogen atom or an alkyl group having 1 to 15 carbon atoms. Typical examples of the alkyl group include a methyl group, an ethyl group, a propyl group, an isopropyl group and a 2,4,4-trimethylpentyl group. More preferably, $R^{13}$ is a hydrogen atom, a methyl group, an ethyl group, a propyl group or an isopropyl group.

When $R^{13}$ is a hydrogen atom, $R^{12}$ and $R^{12'}$ each are preferably an alkyl group having 2 to 5 carbon atoms, more preferably an ethyl group or a propyl group, and most preferably an ethyl group.

When $R^{13}$ is a primary or secondary alkyl group having 1 to 8 carbon atoms, $R^{12}$and $R^{12'}$ are preferably methyl groups. The primary or secondary alkyl group having 1 to 8 carbon atoms for $R^{13}$ are preferably a methyl group, an ethyl group, a propyl group and an isopropyl group, and more preferably a methyl group, an ethyl group and a propyl group.

When $R^{11}$, $R^{11'}$, $R^{12}$ and $R^{12'}$ are all methyl groups, $R^{13}$ is preferably a secondary alkyl group. The secondary alkyl group for $R^{13}$ is preferably an isopropyl group, an isobutyl group or a 1-ethylpentyl group, and more preferably an isopropyl group.

Depending on the combination of the groups $R^{11}$, $R^{11'}$, $R^{12}$, $R^{12'}$ and $R^{13}$, the reducing agents exhibit different heat-developability and produce different silver tone. Combining two or more different types of the reducing agents makes it possible to control the heat-developability and to produce a controlled silver tone. Therefore, combining two or more different types of the reducing agents in the heat-developable photosensitive material is preferred, depending on the object of the material.

Specific examples of the reducing agents including the compounds represented by formula (R) in the invention are shown below but the invention is not restricted to them.

(R-1)

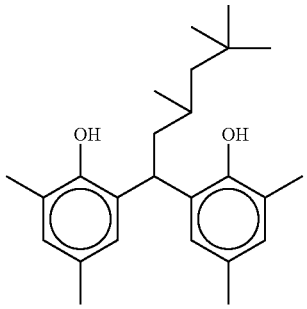

(R-2)

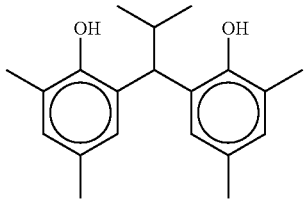

(R-3)

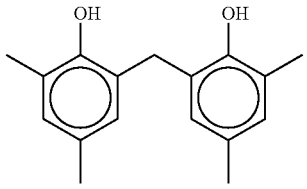

(R-4)

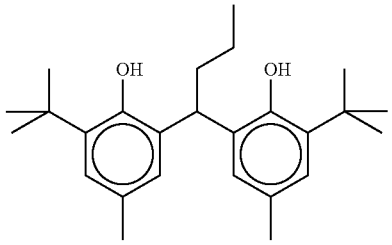

(R-5)

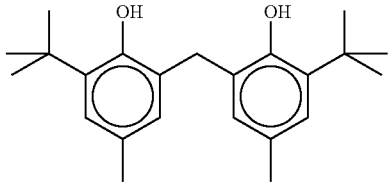

(R-6)

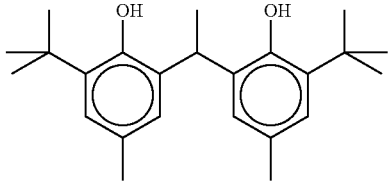

(R-7)

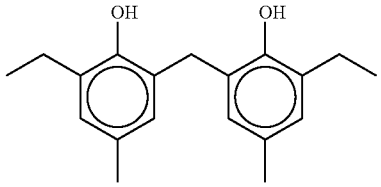

-continued
(R-8)
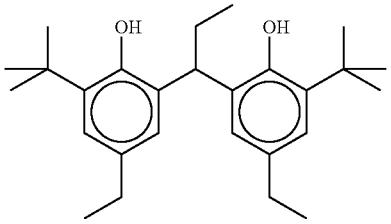
(R-9)
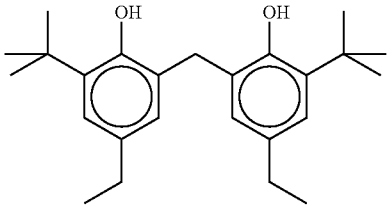
(R-10)
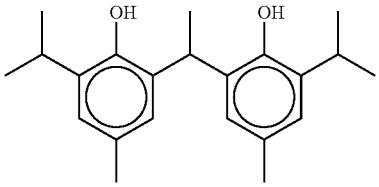
(R-11)
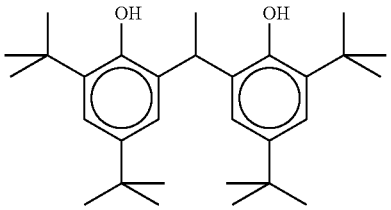
(R-12)
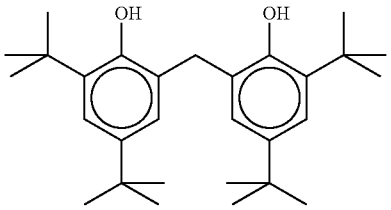
(R-13)
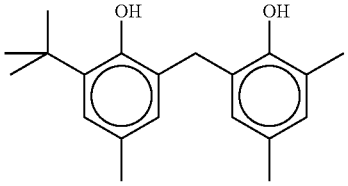
(R-14)
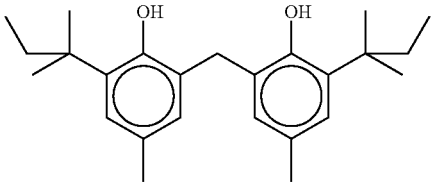
-continued
(R-15)
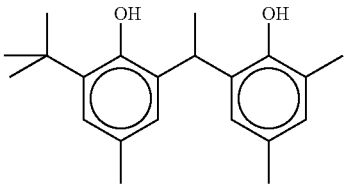
(R-16)
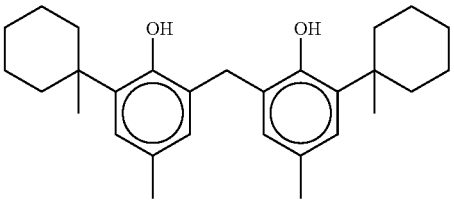
(R-17)
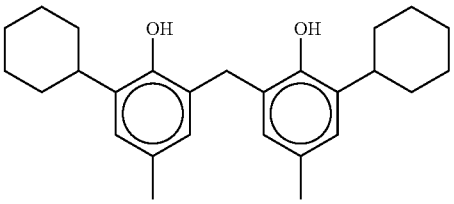
(R-18)
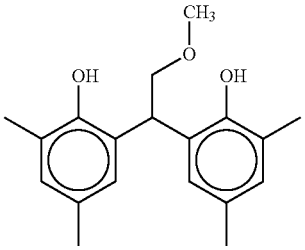
(R-19)
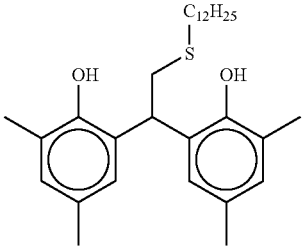
(R-20)
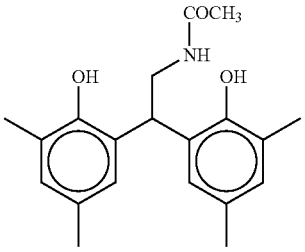
(R-21)
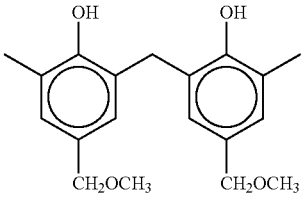

-continued
(R-22)
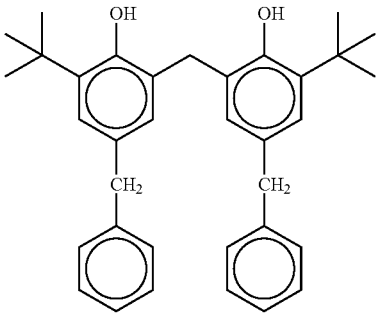
(R-23)
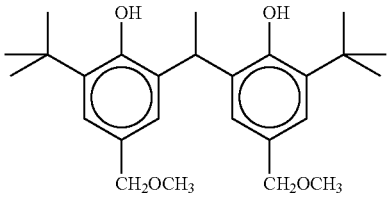
(R-24)
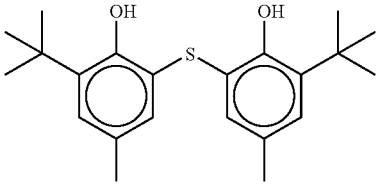
(R-25)
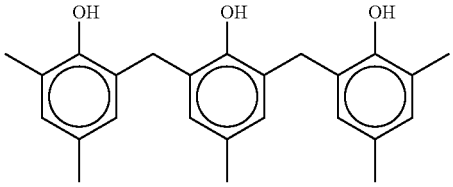
(R-26)
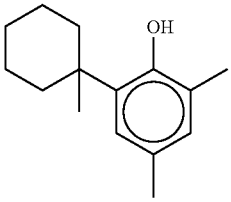
(R-27)
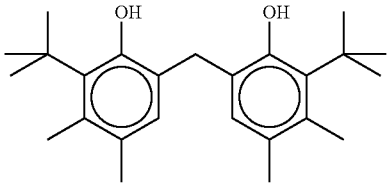
(R-28)
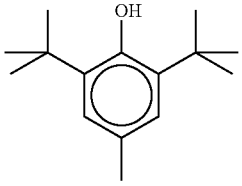
-continued
(R-29)
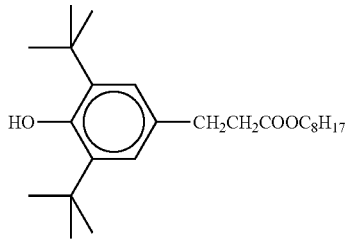
(R-30)
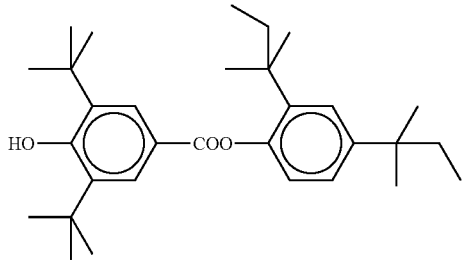
(R-31)
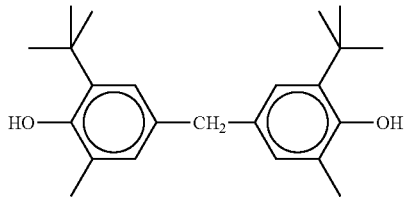
(R-32)
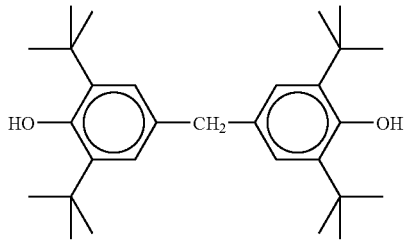
(R-33)
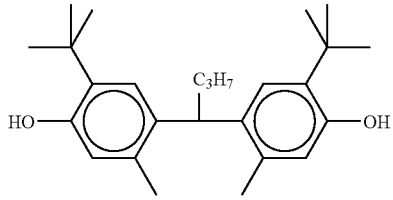
(R-34)
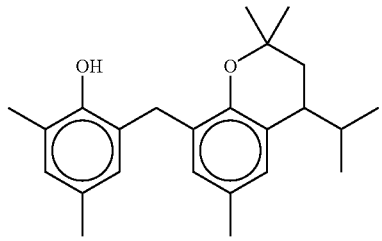
Typical examples of the reducing agents in the invention other than those described above are compounds described in JP-A Nos. 2001-188314, 2001-209145, 2001-350235, and 2002-156727.

The addition amount of the reducing agent in the invention is preferably from 0.1 to 3.0 g/m$^2$, more preferably from 0.2 to 1.5 g/m$^2$, and still more preferably from 0.3 to 1.0 g/m$^2$. The reducing agent is contained preferably in an amount of 5 to 50 mol %, more preferably 8to 30 mol % and still more preferably from 10 to 20 mol % based on 1 mol of silver in the surface having the image forming layer. The reducing agent in the invention is preferably contained in the image forming layer.

The reducing agent may be in any form of a solution, an emulsified dispersion and a fine solid particle dispersion, and may be added to the coating liquid in any known method so as to be incorporated into the heat-developable photosensitive material of the invention.

One well known method of emulsification-dispersing the reducing agent includes dissolving the reducing agent in an oily solvent such as dibutyl phthalate, tricresyl phosphate, glyceryl triacetate, or diethyl phthalate, or in an auxiliary solvent such as ethyl acetate or cyclohexanone, and then mechanically emulsification-dispersing the resultant into a dispersion.

In order to prepare a fine solid particle dispersion of the reducing agent, methods that include dispersing a powder of the reducing agent in water or in any other suitable solvent by using a ball mill, a colloid mill, a vibration ball mill, a sand mill, a jet mill or a roller mill, or ultrasonic wave to thereby prepare an intended solid dispersion of the reducing agent can be used. In these methods, a protective colloid (e.g., polyvinyl alcohol), and a surfactant (e.g., an anionic surfactant such as sodium triisopropylnaphthalenesulfonate, a mixture of isomers that differ in point of the substituting positions of the three isopropyl groups) may be used. In these mills, beads of zirconia or the like that serve as a dispersion medium are generally used. Zr or the like may dissolve out of the beads and often contaminates the dispersion formed. Depending on dispersion conditions, the contaminant content of the dispersion formed is generally 1 ppm to 1000 ppm. So far as the Zr content of the heat-developable photosensitive material is not larger than 0.5 mg per gram of silver in the material, the contaminant causes no practical problem.

Preferably, the water dispersion contains a preservative (e.g., sodium benzoisothiazolinone).

Preparing a solid particle dispersion of the reducing agent is particularly preferable. In the preparation, the mean particle size of the reducing agent particles is preferably from 0.01 μm to 10 μm, more preferably from 0.05 μm to 5 μm, and even more preferably from 0.1 μm to 2 μm. In the invention, it is preferable that the particle sizes of the other solid dispersions are also within the range.

Description of Development Accelerator

Preferably, the heat-developable photosensitive material of the invention contains a development accelerator. Typical examples of the development accelerator include sulfonamidophenol compounds disclosed in JP-A Nos. 2000-267222 and 2000-330234 (formula (A)); hindered phenol compounds of formula (II) in JP-AN No. 2001-92075; hydrazine compounds in JP-A Nos. 10-62895, 11-15116 (compounds of formula (I)), 2002-156727 (formula (D)) and 2002-278017 (formula (1)); and phenol or naphthol compounds of formula (2) in JP-A No. 2001-264929. The amount of the development accelerator to be contained in the material is 0.1 to 20 mol %, preferably 0.5 to 10 mol %, and more preferably 1 to 5 mol % relative to the reducing agent therein. The development accelerator may be introduced into the material in the same manner as the method used for introducing the reducing agent thereinto. However, the development accelerator is preferably added to the material in the form of its solid dispersion or emulsified dispersion. When the development accelerator is added to the material in the form of its emulsified dispersion, the emulsified dispersion thereof is preferably prepared by emulsification-dispersing the development accelerator in a mixed solvent of a high boiling point solvent that is solid at oridnary temperature and an auxiliary solvent having a low boiling point, or the emulsified dispersion is preferably an oilless dispersion with no high boiling point solvent therein.

The development accelerator for use in the invention is especially preferably a hydrazine compound of formula (D) in JP-A No. 2002-156727, a phenol or naphthol compound of formula (2) in JP-A No. 2001-264929.

Particularly preferred examples of the development accelerator for use in the invention include compounds of the following formulae (A-1) and (A-2):

$$Q_1\text{-NHNH-}Q_2 \qquad \text{Formula (A-1)}$$

wherein $Q_1$ represents an aromatic or heterocyclic group bonding to NHNH-$Q_2$ via its carbon atom; $Q_2$ represents a carbamoyl group, an acyl group, an alkoxycarbonyl group, an aryloxycarbonyl group, a sulfonyl group, or a sulfamoyl group.

In formula (A-1), the aromatic or heterocyclic group represented by $Q_1$ is preferably a 5- to 7-membered unsaturated ring. Tyical examples thereof include a benzene ring, a pyridine ring, a pyrazine ring, a pyrimidine ring, a pyridazine ring, a 1,2,4-triazine ring, a 1,3,5-triazine ring, a pyrrole ring, an imidazole ring, apyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isoxazole ring, and a thiophene ring, and condensed rings of any of those rings are also preferable.

These rings may be substituted, and when they have 2 or more substituents, the substituents may be the same or different. Examples of the substituent include a halogen atom, an alkyl group, an aryl group, a carbonamido group, an alkylsulfonamido group, an arylsulfonamido group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. When these substituents are substitutable ones, they may have a further substituent. Typical examples of the substituent include a halogen atom, an alkyl group, an aryl group, a carbonamido group, an alkylsulfonamido group, an arylsulfonamido group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ preferably has 1 to 50 carbon atoms, and more preferably 6 to 40 carbon atoms. Examples thereof include an unsubstituted carbamoyl group, a methylcarbamoyl group, an N-ethylcarbamoyl group, an N-propylcarbamoyl group, an N-sec-butylcarbamoyl group, an N-octylcarbamoyl group, an N-cyclohexylcarbamoyl group, an N-tert-butylcarbamoyl group, an N-dodecylcarbamoyl group, an N-(3-dodecyloxypropyl)carbamoyl group, an N-octadecylcarbamoyl group, an N-{3-(2,4-tert-pentylphenoxy)propyl}carbamoyl group, an N-(2-hexyldecyl)carbamoyl group, an N-phenylcarbamoyl group, an N-(4-dodecyloxyphenyl)carbamoyl group, an N-(2-chloro-5-dodecyloxycarbonylphenyl)carbamoyl group, an N-naphthylcarbamoyl group, an N-3-pyridylcarbamoyl group, and an N-benzylcarbamoyl group.

The acyl group represented by $Q_2$ preferably has 1 to 50 carbon atoms, and more preferably 6 to 40 carbon atoms. Examples thereof include a formyl group, an acetyl group, a 2-methylpropanoyl group, a cyclohexylcarbonyl group, an octanoyl group, a 2-hexyldacanoyl group, a dodecanoyl group, a chloroacetyl group, a trifluoroacetyl group, a benzoyl group, a 4-dodecyloxybenzoyl group, and a 2-hydroxymethylbenzoyl group. The alkoxycarbonyl group represented by $Q_2$ preferably has 2 to 50 carbon atoms, and more preferably 6 to 40 carbon atoms. Examples thereof include a methoxycarbonyl group, an ethoxycarbonyl group, an isobutyloxycarbonyl group, an cyclohexyloxycarbonyl group, a dodecyloxycarbonyl group, and a benzyloxycarbonyl group.

The aryloxycarbonyl group represented by $Q_2$ preferably has 7 to 50 carbon atoms, and more preferably 7 to 40 carbon atoms. Examples thereof include a phenoxycarbonyl group, a 4-octyloxyphenoxycarbonyl group, a 2-hydroxymethylphenoxycarbonyl group, and a 4-dodecyloxyphenoxycarbonyl group. The sulfonyl group represented by $Q_2$ preferably has 1 to 50 carbon atoms, and more preferably 6 to 40 carbon atoms. Examples thereof include a methylsulfonyl group, a butylsulfonyl group, an octylsulfonyl group, a 2-hexadecylsulfonyl group, a 3-dodecyloxypropylsulfonyl group, a 2-octyloxy-5-tert-octylphenylsulfonyl group, and a 4-dodecyloxyphenylsulfonyl group.

The sulfamoyl group represented by $Q_2$ preferably has 0 to 50 carbon atoms, and more preferably 6 to 40 carbon atoms. Examples thereof include an unsubstituted sulfamoyl group, an N-ethylsulfamoyl group, an N-(2-ethylhexyl)sulfamoyl group, an N-decylsulfamoyl group, an N-hexadecylsulfamoyl group, an N-{3-(2-ethylhexyloxy)propyl}sulfamoyl group, an N-(2-chloro-5-dodecyloxycarbonylphenyl)sulfamoyl group, and an N-(2-tetradecyloxyphenyl)sulfamoyl group. The group represented by $Q_2$ may be optionally substituted at their substitutable position with any of those mentioned hereinabove for the substituents of the 5- to 7-membered unsaturated rings represented by $Q_1$. When the group has 2 or more such substituents, the substituents may be the same or different.

Preferred embodiments of the compounds of formula (A-1) are mentioned below. $Q_1$ is preferably a 5- or 6-membered unsaturated ring. Typical examples thereof include a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isoxazole ring, and condensed rings of any of those rings with a benzene ring or an unsaturated heterocyclic ring. $Q^2$ is preferably a carbamoyl group, and more preferably a carbamoyl group having a hydrogen atom on the nitrogen atom.

Formula (A-2)

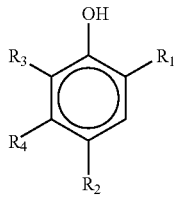

In formula (A-2), $R_1$ represents an alkyl group, an acyl group, an acylamino group, a sulfonamido group, an alkoxycarbonyl group, or a carbamoyl group. $R_2$ represents a hydrogen atom, a halogen atom, an alkyl group, an alkoxy group, an aryloxy group, an alkylthio group, an arylthio group, an acyloxy group, or a carbonate group. $R_3$ and $R_4$ each represent a group which can bond to a benzene ring such as those mentioned hereinabove for the substituents in formula (A-1). $R_3$ and $R_4$ may bond to each other to form a condensed ring.

$R_1$ is preferably an alkyl group having 1 to 20 carbon atoms (e.g., a methyl group, an ethyl group, an isopropyl group, a butyl group, a tert-octyl group, or a cyclohexyl group), an acylamino group (e.g., an acetylamino group, a benzoylamino group, a methylureido group, or a 4-cyanophenylureido group), or a carbamoyl group (e.g., a n-butylcarbamoyl group, an N,N-diethylcarbamoyl group, a phenylcarbamoyl group, a 2-chlorophenylcarbamoyl group, or a 2,4-dichlorophenylcarbamoyl group), and is more preferably an acylamino group (including an ureido group and an urethane group).

$R_2$ is preferably a halogen atom (more preferably, a chlorine atom, or a bromine atom), an alkoxy group (e.g., a methoxy group, a butoxy group, a n-hexyloxy group, a n-decyloxy group, a cyclohexyloxy group, or a benzyloxy group), or an aryloxy group (e.g., a phenoxy group, or a naphthoxy group).

$R_3$ is preferably a hydrogen atom, a halogen atom, an alkyl group having 1 to 20 carbon atoms, and is most preferably a halogen atom. $R_4$ is preferably a hydrogen atom, an alkyl group, or an acylamino group, and more preferably an alkyl group or an acylamino group. Examples of preferred substituents of these may be the same as those for $R_1$. When $R_4$ is an acylamino group, it is also preferable that $R_4$ bonds to $R_3$ to form a carbostyryl ring.

In formula (A-2), when $R_3$ and $R_4$ bond to each other to form a condensed ring, the condensed ring is especially preferably a naphthalene ring. The naphthalene ring may be substituted with any substituent of those mentioned hereinabove for formula (A-1). When the compound of formula (A-2) is a naphthol compound, $R_1$ is preferably a carbamoyl group, and more preferably a benzoyl group. $R_2$ is preferably an alkoxy group, or an aryloxy group, and more preferably an alkoxy group.

Preferred examples of the development accelerator in the invention are shown below. However, the invention is not restricted to them.

(A-1)

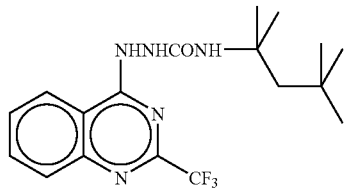

(A-2)

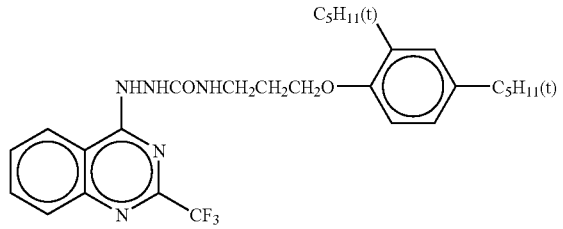

-continued (A-3)

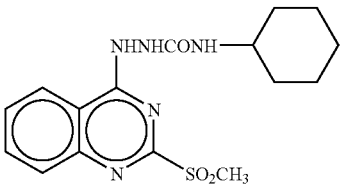

(A-4)

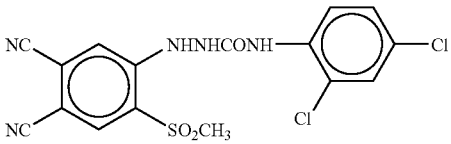

A-5

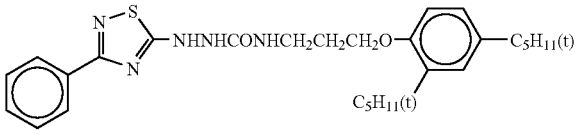

(A-6)

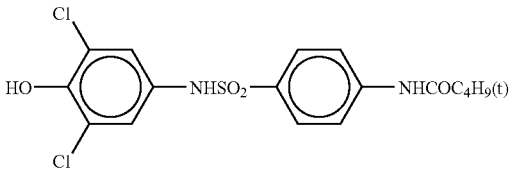

(A-7)

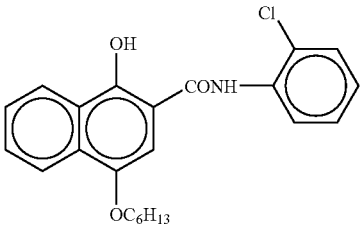

(A-8)

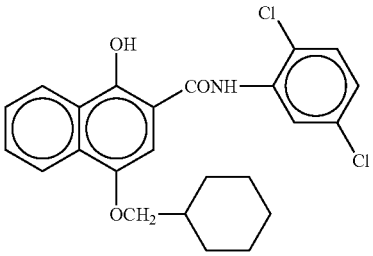

A-9

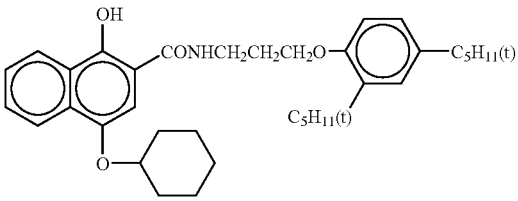

-continued (A-10)

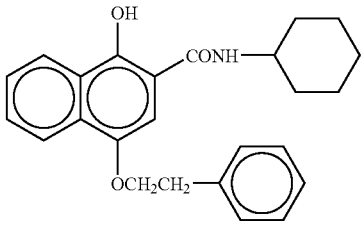

(A-11)

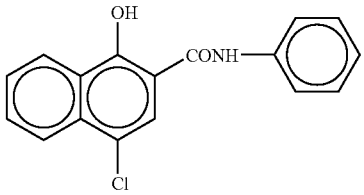

(A-12)

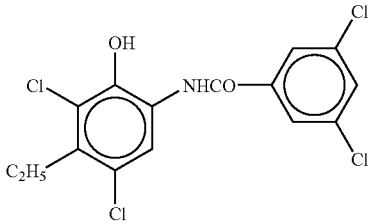

Description of Hydrogen Bonding Compound

When the reducing agent for use in the invention has an aromatic hydroxyl group (—OH) or an amino group (—NHR wehrein R is a hydrogen atom or an alkyl group), especially when the reducing agent is any of the above-mentioned bisphenols, the reducing agent is preferably used in combination with a non-reducing compound that has a group capable of forming a hydrogen bond with the aromatic hydroxyl group or the amino group of the reducing agent.

Examples of the group capable of forming a hydrogen bond with the hydroxyl group or the amino group of the reducing agent include a phosphoryl group, a sulfoxide group, a sulfonyl group, a carbonyl group, an amido group, an ester group, an urethane group, an ureido group, a tertiary amino group, and a nitrogen-containing aromatic group. Among those, a phosphoryl group, a sulfoxide group, an amido group (not having a group of >N—H but is blocked to form >N—Ra, in which Ra is a substituent except hydrogen), an urethane group (not having a group of >N—H but is blocked to form >N—Ra, in which Ra is a substituent except hydrogen), and an ureido group (not having a group of >N—H but is blocked to form >N—Ra, in which Ra is a substituent except hydrogen) are preferable.

An especially preferred example of the hydrogen bonding compound for use in the invention is a compound of the following formula (D).

Formula (D)

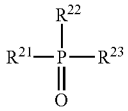

In formula (D), $R^{21}$ to $R^{23}$ each independently represent an alkyl group, an aryl group, an alkoxy group, an aryloxy group, an amino group or a heterocyclic group, and these may be unsubstituted or substituted.

When the groups represented by $R^{21}$ to $R^{23}$ has a substituent, examples of the substituent include a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group and a phosphoryl group. Among the substituents, an alkyl group and an aryl group, including a methyl group, an ethyl group, an isopropyl group, a t-butyl group, a t-octyl group, a phenyl group, a 4-alkoxyphenyl group and a 4-acyloxyphenyl group, are preferable.

Examples of the alkyl group represented by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group and a 2-phenoxypropyl group.

Examples of the aryl group include a phenyl group, a cresyl group, a xylyl group, a naphthyl group, a 4-t-butylphenyl group, a 4-t-octylphenyl group, a 4-anisidyl group and a 3,5-dichlorophenyl group.

Examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group.

Examples of the aryloxy group include a phenoxy group, a cresyloxy group, an isopropylphenoxy group, a 4-t-butylphenoxy group, a naphthoxy group and a biphenyloxy group.

Examples of the amino group include a dimethylamino group,a diethylamino group, a dibutylamino group, a dioctylamino group, an N-methyl-N-hexylamino group, a dicyclohexylamino group, a diphenylamino group and an N-methyl-N-phenylamino group.

$R^{21}$ to $R^{23}$ are preferably an alkyl group, an aryl group, an alkoxy group or an aryloxy group. From the viewpoint of the effect of the invention, it is preferable that at least one of $R^{21}$ to $R^{23}$ is an alkyl group or an aryl group. It is more preferable that at least two of them are any of an alkyl group and an aryl group. Even more preferably, $R^{21}$ to $R^{23}$ are the same group, since such a compound is inexpensive.

Specific examples of the compound of formula (D) and other hydrogen bonding compounds usable in the invention are shown below, however, the invention is not limited thereto.

(D-1)

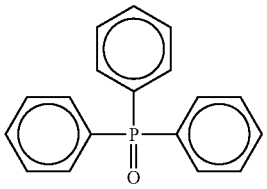

(D-2)

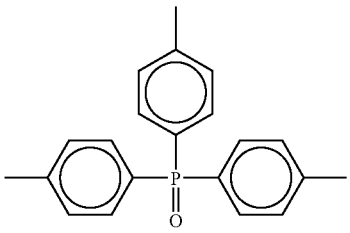

-continued (D-3)

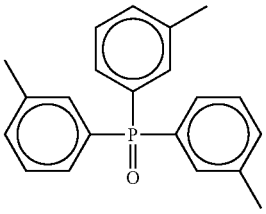

D-4

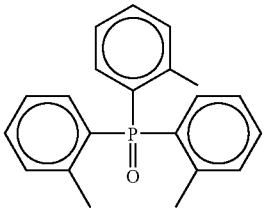

(D-5)

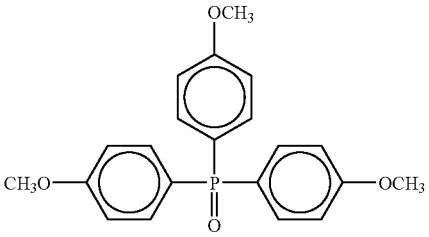

(D-6)

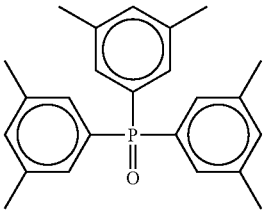

(D-7)

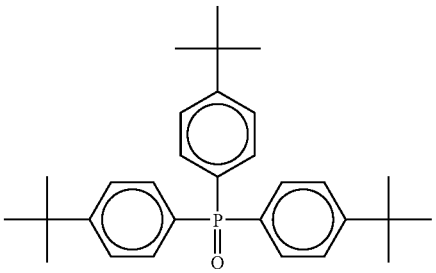

(D-8)

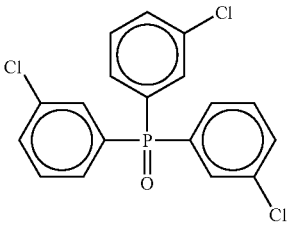

(D-9)

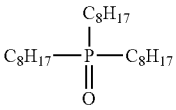

-continued (D-10)

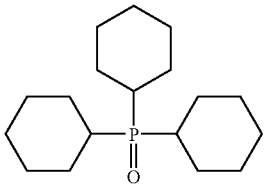

(D-11)

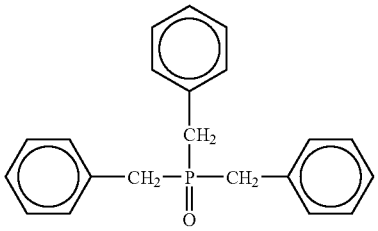

(D-12)

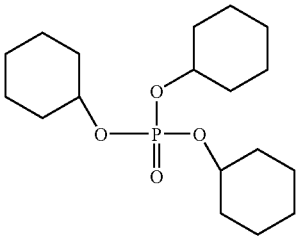

(D-13)

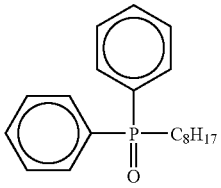

(D-14)

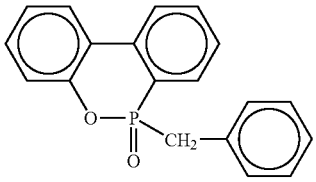

(D-15)

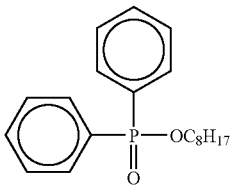

(D-16)

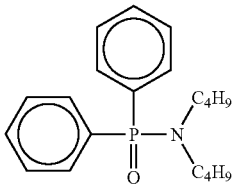

-continued (D-17)

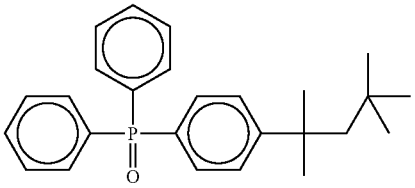

(D-18)

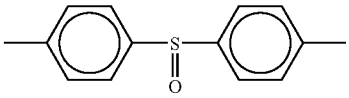

(D-19)

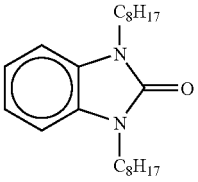

(D-20)

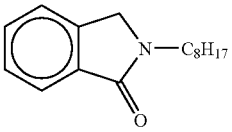

(D-21)

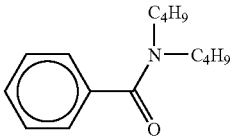

Apart from the above, other hydrogen bonding compounds such as those described in EP No. 1096310, JP-A Nos. 2002-156727 and 2002-318431 are also usable herein.

Like the reducing agent mentioned above, the compound of formula (D) may be added to the coating liquid for the heat-developable photosensitive material of the invention, for example, in the form of a solution, an emulsified dispersion or a solid particle dispersion, but is preferably used in the form of a solid particle dispersion. In its solution, the compound of formula (D) forms a hydrogen-bonding complex with a compound having a phenolic hydroxyl group or an amino group. Depending on the combination of the reducing agent and the compound of formula (D) for use herein, the crystal of the complex may be isolated.

The isolated crystal powder may be formed into its solid particle dispersion, and the dispersionis especially preferred for use in the invention in order to stabilize the heat-developable photosensitive material of the invention. Moreover, powders of the reducing agent and the compound of formula (D) may be mixed with a suitable dispersant in a sand grinder mill or the like to thereby form an intended complex at the time of dispersion. The method is also preferred in the invention.

The amount of the hydrogen bonding compound is preferably 1 to 200 mol %, more preferably 10 to 150 mol % and still more preferably 20 to 100 mol % based on the reducing agent.

Description of Silver Halide

1) Halogen Composition

The photosensitive silver halide used in the invention has any halogen composition, and silver chloride, silver chlorobromide, silver bromide, silver iodobromide, silver iodochlorobromide and silver iodide can be used. Among them, silver bromide, silver iodobromide and silver iodide are preferable. The distribution of the halogen composition in each particle may be uniform, or the halogen composition may change stepwise or continuously. Further, silver halide particles having a core/shell structure can also be used preferably. Specifically, the silver halide particles having a core/shell structure preferably has a 2- to 5-layered structure and more preferably a 2- to 4-layered structure. Further, a technique of localizing silver bromide or silver iodide on the surfaces of silver chloride, silver bromide or silver chlorobromide particles can also be used preferably.

2) Method of Forming Silver Halide Particles

Methods of forming the photosensitive silver halides are well known in the art, and, for example, methods in Research Disclosure 17029 (June 1978), and U.S. Pat. No. 3,700,458 are employable in the invention. Concretely, a silver source compound and a halogen source compound are added to gelatin or any other polymer solution to prepare a photosensitive silver halide, and the photosensitive silver halide is then mixed with an organic silver salt. This method is preferred for the invention. The method described in JP-A No. 11-119374, paragraphs 0217 to 0244; and the methods described in JP-A Nos. 11-352627 and 2000-347335 are also preferable.

3) Particle Size

The particle size of the photosensitive silver halide is preferably small in order to suppress clouding after image formation. Specifically, the particle size is preferably 0.20 μm or less, more preferably 0.01 μm to 0.15 μm and still more preferably 0.02 μm to 0.12 μm. The particle size referred to herein means a diameter of a circular image having the same area as the projected area of each silver halide particle (the projected area of a main plane in the case of a tabular particle)

4) Particle Shape

The shape of the silver halide particles usable in the invention can be, for example, cube, octahedron, a tabular particle, sphere, a rod-like particle or a potato-like particle. In the invention, cubic particles are particularly preferred. Silver halide particles having rounded corners can also be preferably used. There is no particular restriction on the surface index (mirror index) of the outer surface of the photosensitive silver halide particles and it is preferable that the percentage of [100] face having high spectral sensitization efficiency when a spectral sensitizing dye adsorbs the photosensitive silver halide particles is high. The percentage is preferably 50% or more, more preferably 65% or more and still more preferably 80% or more. The percentage of the mirror index [100] face can be determined by the method utilizing the adsorption dependence of [111] face and [100] face in the adsorption of the sensitizing dye, described in J. Imaging Sci., 29, 165 (1985) by T. Tani.

5) Heavy Metal

The photosensitive silver halide grains for use in the invention may contain a metal or a metal complex of Groups 8 to 10 of the Periodic Table including Groups 1 to 18. The metal, or the center metal of the metal complex, which belongs to any of Groups 8 to 10, is preferably rhodium, ruthenium or iridium. In the invention, one metal complex may be used alone, or two or more metal complexes of the same type of metal or different types of metals may also be used in combination. The metal or metal complex content of the grains is preferably $1\times10^{-9}$ mols to $1\times10^{-3}$ mols per mol of silver. Such heavy metals and metal complexes, and methods of adding them to silver halide grains are described in, for example, JP-A No. 7-225449; JP-A No. 11-65021, paragraphs 0018 to 0024; and JP-A No. 11-119374, paragraphs 0227 to 0240.

Silver halide grains having a hexacyano-metal complex in their outermost surfaces are preferred for use in the invention. Examples of the hexacyano-metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. The hexacyano-Fe complexes are preferred in the invention.

As the hexacyano-metal complexes exist in the form of ions in their aqueous solutions, their counter cations are of no importance. However, the counter cations for the complexes are preferably any of alkali metal ions such as sodium, potassium, rubidium, cesium and lithium ions; ammonium ions, and alkylammonium ions (e.g., tetramethylammonium, tetraethylammonium, tetrapropylammonium and tetra(n-butyl)ammonium ions), as they are well miscible with water and are favorable to the operation of precipitating silver halide emulsions.

The hexacyano-metal complex may be added to silver halide grains in the form of a solution thereof including water or a mixed solvent of water and an organic solvent miscible with water (for example, alcohols, ethers, glycols, ketones, esters, or amides), or in the form of a mixture thereof with gelatin.

The amount of the hexacyano-metal complex to be added to the silver halide grains is preferably $1\times10^{-5}$ mols to $1\times10^{-2}$ mols per mol of silver of the grains and more preferably $1\times10^{-4}$ mols to $1\times10^{-3}$ mols.

In order to make the hexacyano-metal complex exist in the outermost surface of the silver halide grains, the complex is directly added to a reaction system after an aqueous silver nitrate solution for forming the silver halide grains is added to the reaction system but before the grains formed are subjected to chemical sensitization such as chalcogen sensitization with sulfur, selenium or tellurium or noble metal sensitization with gold or the like. More specifically, it is directly added to the system before completion of addition of raw materials, during a rinsing step, during a dispersing step, or before the chemical sensitization step. To prevent the silver halide grains formed from growing too much, it is preferable that the hexacyano-metal complex is added to the system immediately after grains are formed. Preferably, the complex is added thereto before completion of addition of raw materials.

Adding the hexacyano-metal complex to the system may be started after 96% by mass, preferably 98% by mass, and more preferably 99% by mass of the total of silver nitrate for forming the grains has been added to the reaction system.

The hexacyano-metal complex added to the system after an aqueous solution of silver nitrate to be added to the system just before completion of grain formation has been added to the reaction system is well adsorbed by the grains formed, and may well exist in the outermost surfaces of the grains. Most of the complex added in that manner forms a refractory salt with the silver ions existing in the surfaces of the grains. The silver salt of hexacyano-iron (II) is more refractory than AgI, and the fine grains formed are prevented from re-dissolving. Accordingly, intended fine silver halide grains having a small grain size can be formed.

The metal atoms (e.g., in $[Fe(CN)_6]^{4-}$) that may be contained in the silver halide grains for use in the invention, and the methods of desalting or chemical sensitization of the silver halide emulsions are described, for example, in JP-A No. 11-84574, paragraphs 0046 to 0050, JP-A No. 11-65021, paragraphs 0025 to 0031, and JP-A No. 11-119374, paragraphs 0242 to 0250.

6) Gelatin

Any gelatin may be used in the photosensitive silver halide emulsions for use in the invention. For better dispersion of the photosensitive silver halide emulsion in an organic silver salt-containing coating liquid, gelatin having a molecular weight of from 10,000 to 1,000,000 is preferable. Moreover, the substituent of gelatin is preferably phthalized. The gelatin can be used during grain formation or at the time of dispersing the grains after the grains are desalted, and is preferably used during grain formation.

7) Sensitizing Dye

Sensitizing dyes usable in the invention are those which, after adsorbing silver halide grains, can spectrally sensitize the grains within a desired wavelength range. Depending on the spectral characteristics of the light source to be used for exposure, favorable sensitizing dyes having good spectral sensitivity are selected for use in the heat-developable photosensitive material of the invention. As for the details of sensitizing dyes usable herein and methods for adding them to the heat-developable photosensitive material of the invention, paragraphs 0103 to 0109 in JP-A No. 11-65021; compounds of formula (II) in JP-A No. 10-186572; dyes of formula (I) and paragraph 0106 in JP-A No. 11-119374; dyes described in U.S. Pat. Nos. 5,510,236, and 3,871,887 (Example 5); dyes described in JP-A Nos. 2-96131 and 59-48753; from page 19, line 38 to page 20, line 35 of EP-A No. 0803764A1; JP-A Nos. 2001-272747, 2001-290238 and 2002-23306 are referred to. One or more such sensitizing dyes may be used herein either alone or in combination. In the invention, the sensitizing dye is preferably added to the silver halide emulsion after desalting and before coating, and more preferably after desalting and before the completion of chemical sensitization.

The amount of the sensitizing dye in the invention depends on the sensitivity and the fogging preventive property of the material. In general, the amount is preferably $10^{-6}$ to 1 mol, and more preferably $10^{-4}$ to $10^{-1}$ mols per mol of the silver halide in the image forming layer.

In order to improve spectral sensitization efficiency, the heat-developable photosensitive material of the invention may contain a supersensitizer. Examples of the supersensitizer usable in the invention include compounds described in EP-A No. 587338, U.S. Pat. Nos. 3,877,943 and 4,873,184, and JP-A Nos. 5-341432, 11-109547 and 10-111543.

8) Chemical Sensitization

The photosensitive silver halide particles in the invention are preferably chemically sensitized by sulfur sensitization, selenium sensitization or tellurium sensitization. As the compound preferably used for sulfur sensitization, selenium sensitization and tellurium sensitization, known compounds, for example, compounds described in JP-A No. 7-128768 can be used. In particular, tellurium sensitization is preferred in the invention and compounds described in the documents cited in JP-A No. 11-65021, paragraph 0030 and compounds represented by formulae (II), (III), and (IV) in JP-A No. 5-313284 are more preferred.

The photosensitive silver halide particles in the invention are preferably chemically sensitized by gold sensitization alone or in combination with the chalcogen sensitization described above. As a gold sensitizer, those including gold with a valence of +1 or +3 are preferred and gold compounds used conventionally are preferred as such a gold sensitizer. Typical examples thereof include chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyltrichloro gold. Further, gold sensitizers described in U.S. Pat. No. 5,858,637 and JP-A No. 2002-278016 are also preferably used.

In the invention, chemical sensitization can be conducted at any time so long as it is conducted after particle formation and before coating. The chemical sensitizationt can be conducted after desalting, and (1) before spectral sensitization, (2) simultaneously with spectral sensitization, (3) after spectral sensitization and (4) just before coating.

The amount of sulfur, selenium or tellurium sensitizer used in the invention depends on silver halide particles used, chemical ripening conditions and the like. However, the amount is preferably about $10^{-8}$ mol to about $10^{-2}$ mol and more preferably $10^{-7}$ mol to $10^{-3}$ mol per mol of the silver halide.

The addition amount of the gold sensitizer depends on various conditions and is generally about $10^{-7}$ mol to $10^{-3}$ mol and preferably $10^{-6}$ mol to $5\times10^{-4}$ mol per mol of the silver halide.

There is no particular restriction on conditions of the chemical sensitization in the invention. However, pH is about 5 to about 8, pAg is about 6 to about 11 and the temperature is at about 40 to about 95° C.

A thiosulfonic acid compound may be added to the silver halide emulsion used in the invention by a method disclosed in EP-A No. 293917.

The photosensitive silver halide particles in the invention preferably include a reducing agent. A specific compound used in reduction sensitization is preferably ascorbic acid, thiourea dioxide, stannous chloride, aminoiminomethanesulfonic acid, a hydrazine derivative, a borane compound, a silane compound, or a polyamine compound. The reduction sensitizer may be added to a reaction system at any stage of a photosensitive emulsion production process from crystal growth to a preparation step just before coating. Further, it is preferable to conduct reduction sensitization by ripening the emulsion while keeping pH of the emulsion at 7 or higher or pAg of the emulsion at 8.3 or lower. It is also preferable to conduct reduction sensitization by introducing a single addition portion of silver ions during particle formation.

The photosensitive silver halide emulsion in the invention preferably contains an FED sensitizer (Fragmentable Electron Donating Sensitizer) as a compound generating two electrons with one photon. As the FED sensitizer, compounds described in U.S. Pat. Nos. 5,747,235, 5,747,236, 6,054,260 and 5,994,051, and Japanese Patent Application No. 2001-86161 are preferable. The FED sensitizer may be added preferably at any stage of the photosensitive emulsion production process from crystal growth to the preparation step just before coating. The addition amount depends on various conditions. However, the amount is about $10^{-7}$ mol to $10^{-1}$ mol, more preferably $10^{-6}$ mol to $5\times10^{31\ 2}$ mol per mol of the silver halide.

9) Combined Use of Silver Halides

The heat-developable photosensitive material of the invention may contain only one type or two or more different types of photosensitive silver halide emulsions (these may differ in their mean grain size, halogen composition or crystal habit, or in conditions of their chemical sensitization) Combining two or more types of photosensitive silver halides differing in their sensitivity enables control of gradation. Such technique is disclosed in, for example, JP-A Nos. 57-119341, 53-106125, 47-3929, 48-55730, 46-5187, 50-73627 and 57-150841. Combining silver halides is preferably conducted such that the diference between sensitivities of the respective emulsions is at least 0.2 log E.

10) Coating Amount

The addition amount of the photosensitive silver halide (coating amount of silver per 1 $m^2$ of the photosensitive material) is preferably from 0.03 to 0.6 $g/m^2$, more preferably 0.05 to 0.4 $g/m^2$ and still more preferably 0.07 to 0.3 $g/m^2$. The photosensitive silver halide is preferably used in an amount of 0.01 mol to 0.5 mol, more preferably 0.02 mol to 0.3 mol and still more preferably 0.03 mol to 0.2 mol per mol of the organic silver salt.

11) Mixing of Photosensitive Silver Halide and Organic Silver Salt

Mixing method and mixing conditions of the photosensitive silver halide and the organic silver salt is not limited as long as the effect of the invention can be sufficiently exhibited. However, a method of mixing the silver halide grains and the organic silver salt prepared separately by using a high speed stirrer, a ball mill, a sand mill, a colloid mill, a vibration mill or a homogenizer, or a method of mixing the photosensitive silver halide which has been prepared with an organic silver salt which is being prepared at any timing can be used. Mixing two or more kinds of water dispersions of organic silver salts and two or more kinds of water dispersions of photosensitive silver salt is preferable for controlling photographic characteristics of the photosensitive material.

12) Addition of Silver Halide to Coating Liquid

The silver halide is preferably added to the coating liquid for forming an image-forming layer during a period starting from 180 minutes before coating and ending immediately before coating, preferably during a period starting from 60 minutes to 10 seconds before coating. However, there is no specific limitation on mixing methods and mixing conditions, so far as the method and the conditions employed to add the grains to the coating liquid ensure the advantages of the invention. Specific examples of mixing methods include a method of adding the grains to the coating liquid in a tank in such a controlled manner that the mean residence time in the tank, which is calculated from the addition amount of the grains and the flow rate of the coating liquid to a coater, can be a desired period of time; and a method of mixing them with a static mixer disclosed in *Liquid Mixing Technology*, Chapter 8 (written by N. Harnby, M. F. Edwards & A. W. Nienow, translated by Koji Takahasi, and published by Nikkan Kogyo Shinbun in 1989).

Description of Binder

The binder to be included in the layer containing the organic silver salt in the invention may be any polymer, but is preferably transparent or translucent and is generally colorless. The binder is preferably a natural resin, a natural polymer, a natural copolymer, a synthetic resin, a synthetic polymer, a synthetic copolymer and other film-forming medium. Specific examples thereof include gelatins, rubbers, polyvinyl alcohols, hydroxyethylcelluloses, cellulose acetates, cellulose acetate butyrates, polyvinylpyrrolidones, casein, starch, polyacrylic acids, polymethylmethacrylic acids, polyvinyl chlorides, polymethacrylic acids, styrene-maleic anhydride copolymers, styrene-acrylonitrile copolymers, styrene-butadiene copolymers, polyvinylacetals (e.g., polyvinylformal, or polyvinylbutyral), polyesters, polyurethanes, phenoxy resins, polyvinylidene chlorides, polyepoxides, polycarbonates, polyvinyl acetates, polyolefins, cellulose esters, and polyamides. To prepare a coating liquid of the binder, water or an organic solvent or an emulsion may be used.

The glass transition temperature of the binder that can be used in the layer including the organic silver salt is 0° C. to 80° C. (hereinafter sometimes referred to as a high Tg binder) The glass transition temperature is more preferably 10° C. to 70° C. and still more preferably 15° C. to 60° C.

The glass transition temperature Tg is the same as that explained in the descriptions of the binder of the outermost layer.

One binder may be used alone, or two or more different types of binders may be used in combination. For example, a binder having a glass transition temperature of 20° C. or higher and a binder having a glass transition temperature of lower than 20° C. may be combined. When at least two polymers having different Tgs are blended for use herein, it is preferable that the weight-average Tg of the resulting blend is within the range described above.

In the invention, it is preferable that the organic silver salt-containing layer is formed by applying a coating liquid, in which at least 30% by mass of solvents is water, onto a support, and drying the resultant coating.

When the organic silver salt-containing layer in the invention is formed by using such a coating liquid in which at least 30% by mass of the solvents is water and by drying the resultant coating, and when the binder in the organic silver salt-containing layer is soluble or dispersible in an aqueous solvent (watery solvent), especially when the binder in the organic silver salt-containing layer is a polymer latex that has an equilibrium moisture content at 25° C. and 60% RH of at most 2% by mass, the heat-developable photosensitive material having such a layer has improved properties. Most preferably, the binder for use in the invention is so designed that its ionic conductivity is at most 2.5 mS/cm. In order to prepare such a binder, for example, a method of purifying a prepared binder polymer through an advanced separation membrane is employable.

The aqueous solvent in which the polymer binder is soluble or dispersible is water or a mixed solvent of water and at most 70% by mass of a water-miscible organic solvent. Examples of the water-miscible organic solvent include alcohols such as methyl alcohol, ethyl alcohol, or propyl alcohol; cellosolves such as methyl cellosolve, ethyl cellosolve, or butyl cellosolve; ethyl acetate, and dimethylformamide.

The terminology "aqueous solvent" referred to herein can also be used for polymer systems in which the polymer is not thermodynamically dissolved but is dispersed.

The "equilibrium moisture content at 25° C. and 60% RH" referred to herein is represented by the following equation, in which $W_1$ indicates the weight of a polymer in humidity-conditioned equilibrium at 25° C. and 60% RH, and $W_0$ indicates the absolute dry weight of the polymer at 25° C.

$$\text{Equilibrium moisture content at 25° C. and 60\% RH} = [(W_1 - W_0)/W_0] \times 100 \text{ (mass \%)}$$

As for the details of the definition of moisture content and the method for measuring it, for example, *Polymer Engineering*, Lecture 14, Test Methods of Polymer Materials (by the Polymer Society of Japan, Chijin Shokan Publishing) is referred to.

The equilibrium moisture content at 25° C. and 60% RH of the binder polymer for use in the invention is preferably at most 2% by mass, more preferably from 0.01 to 1.5% by mass, and even more preferably from 0.02 to 1% by mass.

Polymers that serve as the binder in the invention are preferably dispersible in aqueous solvents. Examples of a polymer dispersion include latex in which water-insoluble hydrophobic fine polymer particles are dispersed, and a dispersion in which polymer molecules or micelles of polymer molecules are dispersed. Any of these are usable herein, but latex is preferable. The particles in the polymer dispersion preferably have a mean particle size of 1 to 50000 nm, more preferably 5 to 1000 nm, even more preferably 10 to 500 nm, and still more preferably 50 to 200 nm. The particle size distribution of the dispersed polymer particles is not specifically limited. For example, the dispersed polymer particles may have a broad particle size distribution, or may have a particle size distribution of monodispersion. If desired, two or more different types of polymer particle monodispersions may be combined for use herein, and it is preferable for controlling the physical properties of coating liquids.

Preferred embodiments of the polymer dispersible in an aqueous solvent in the invention are described above (the descriptions of the latex usable in the outermost layer), and specific examples thereof include those described above. Those suitable for the image forming layer may be different from those for use in non-photosensitive layers including the outermost layer.

The polymer latexes may be used alone or two or more of them may be blended as required.

As the polymer latex used in the invention, the latex of a styrene-butadiene copolymer is particularly preferred. The mass ratio of the styrene monomer unit and the butadiene monomer unit in the styrene-butadiene copolymer is preferably 40:60 to 95:5. Further, the proportion of the styrene monomer unit and the butadiene monomer unit in the copolymer is preferably 60 to 99 mass %. The polymer latex in the invention preferably contains acrylic acid or methacrylic acid by 1 to 6 mass % and more preferably 2 to 5 mass % to the sum of styrene and butadiene. The polymer latex of the invention preferably contains acrylic acid. A preferred range of the molecular weight of the copolymer is similar to that described above.

Typical examples of the latex of the styrene-butadiene copolymer used in the invention include P-3 to P-8, 15 described above and Lacstar-3307B, 7132C, Nipol Lx416 which are commercially available.

The image forming layer of the heat-developable photosensitive material of the invention may optionally contain a hydrophilic polymer such as gelatin, polyvinyl alcohol, methyl cellulose, hydroxypropyl cellulose or carboxymethyl cellulose. The amount of the hydrophilic polymer is preferably at most 30% by mass, and more preferably at most 20% by mass of all the binder in the image forming layer.

Preferably, the organic silver salt-containing layer (that is, the image-forming layer) of the heat-developable photosensitive material of the invention includes a polymer latex as a binder. The amount of the binder in the organic silver salt-containing layer is such that the mass ratio of total binder /organic silver salt is 1/10 to 10/1, more preferably 1/3 to 5/1, and even more preferably 1/1 to 3/1.

The organic silver salt-containing layer is generally an image forming layer (emulsion layer) containing a photosensitive silver salt, that is, a photosensitive silver halide. In the layer, the mass ratio of total binder/silver halide is preferably 5 to 400, and more preferably 10 to 200.

The overall amount of the binder in the image-forming layer of the heat-developable photosensitive material of the invention is preferably 0.2 to 30 g/m$^2$, more preferably 1 to 15 g/m$^2$, and even more preferably2 to 10 g/m$^2$. The image-forming layer may optionally contain a crosslinking agent, and a surfactant which is used to improve the coating properties of the coating liquid for the layer.

Preferred Solvent of Coating Liquid

Preferably, the solvent of the coating liquid for the organic silver salt-containing layer of the heat-developable photosensitive material of the invention is an aqueous solvent that contains at least 30% by mass of water. The components other than water of the aqueous solvent may be any organic solvent that is miscible with water, including, for example, methyl alcohol, ethyl alcohol, isopropyl alcohol, methyl cellosolve, ethyl cellosolve, dimethylformamide, and ethyl acetate. The moisture content of the solvent of the coating liquid is preferably at least 50% by mass, and more preferably at least 70% by mass. Preferred examples of the solvent composition include water alone, a mixture of water and methyl alcohol at a mass ratio of 90/10, a mixture of water and methyl alcohol at a mass ratio of 70/30, a mixture of water, methyl alcohol and dimethylformamide at a mass ratio of 80/15/5, a mixture of water, methyl alcohol and ethyl cellosolve at a mass ratio of 85/10/5, and a mixture of water, methyl alcohol and isopropyl alcohol at a mass ratio of 85/10/5.

Description of Antifoggant

An antifoggant, a stabilizer and a stabilizer precursor usable in the invention are described, for example, in JP-A No. 10-62899, paragraph 0070; EP-A No. 0803764A1, from page 20, line 57 to page 21, line 7; JP-A Nos. 9-281637 and 9-329864; U.S. Pat. No. 6,083,681; and EP No. 1048975. The antifoggants preferred for use in the invention are organic halides. These are described, for example, in JP-A No. 11-65021, paragraphs 0111 to 0112. Organic halogen compounds of formula (P) in JP-A No. 2000-284399; organic polyhalogen compounds of formula (II) in JP-A No. 10-339934; and organic polyhalogen compounds in JP-A Nos. 2001-31644 and 2001-33911 are especially preferable.

1) Description of Polyhalogen Compound

An organic polyhalogen compound preferred for use in the invention will be described concretely. Preferably, the polyhalogen compound for use in the invention is represented by the following formula (H).

$$Q\text{-}(Y)n\text{-}C(Z_1)(Z_2)X \qquad \text{Formula (H)}$$

In the formula, Q represents an alkyl group, an aryl group or a heterocyclic group; Y represents a divalent connection group; n indicates 0 or 1; $Z_1$ and $Z_2$ each represent a halogen atom; and X represents a hydrogen atom or an electron-attractive group.

In formula (H), Q is preferably an aryl group or a heterocyclic group.

When Q in formula (H) is a heterocyclic group, the heterocyclic grouop is preferably a nitrogen-containing one that contains one or two nitrogen atoms, and more preferably a 2-pyridyl group or a 2-quinolyl group.

When Q in formula (H) is an aryl group, the aryl group is preferably a phenyl group substituted with an electron-attractive group having a positive Hammett's substituent constant $\sigma_p$. As for the Hammett's substituent constant, for example, *Journal of Medicinal Chemistry*, 1973, Vol. 16, No. 11, 1207-1216 is referred to. Typical examples of the electron-attractive group include halogen atoms (a fluorine atom with $\sigma_p$ of 0.06, a chlorine atom with $\sigma_p$ of 0.23, a bromine atom with $\sigma_p$ of 0.23, or an iodine atom with $\sigma_p$ of 0.18), trihalomethyl groups (a tribromomethyl group with $\sigma_p$ of 0.29, a trichloromethyl group with $\sigma_p$ of 0.33, or a trifluoromethyl group with $\sigma_p$ of 0.54), a cyano group (with $\sigma_p$ of 0.66), a nitro group (with $\sigma_p$ of 0.78), aliphatic, aryl or heterocyclic sulfonyl groups (e.g., a methanesulfonyl group with $\sigma_p$ of 0.72), aliphatic, aryl or heterocyclic acyl groups (e.g., an acetyl group with $\sigma_p$ of 0.50, or a benzoyl group with $\sigma_p$ of 0.43), alkynyl groups (e.g., C≡CH with $\sigma_p$ of 0.23), aliphatic, aryl or heterocyclic oxycarbonyl groups (e.g., a methoxycarbonyl group with $\sigma_p$ of 0.45, or a phenoxycarbonyl group with $\sigma_p$ of 0.44), a carbamoyl group (with $\sigma_p$ of 0.36), a sulfamoyl group (with $\sigma_p$ of 0.57), a sulfoxide group, heterocyclic groups, and a phosphoryl group. The $\sigma_p$ of the electron-attractive group is preferably 0.2 to 2.0, and more preferably 0.4 to 1.0. Among the preferred examples of the electron-attractive group mentioned above, a carbamoyl group, an alkoxycarbonyl group, an alkylsulfonyl group, and an alkylphosphoryl group are more preferred, and a carbamoyl group is the most preferred.

X is preferably an electron-attractive group, more preferably a halogen atom, an aliphatic, aryl or heterocyclic sulfonyl group, an aliphatic, aryl or heterocyclic acyl group, an aliphatic, aryl or heterocyclic oxycarbonyl group, a carbamoyl group, or a sulfamoyl group, and even more preferably a halogen atom. The halogen atom represented by X is preferably a chlorine atom, a bromine atom or an iodine atom, and more preferably a chlorine atom or a bromine atom, and even more preferably a bromine atom.

Y is preferably —C(=O)—, —SO— or —$SO_2$—, more preferably —C(=O)— or —$SO_2$—, and even more preferably —$SO_2$—. n is 0 or 1, and preferably 1.

Specific examples of the compounds of formula (H) for use in the invention are shown below.

(H-1)

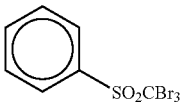

(H-2)

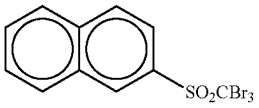

(H-3)

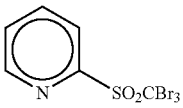

(H-4)

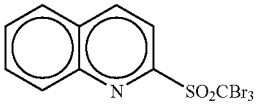

(H-5)

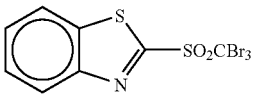

(H-6)

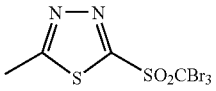

-continued (H-7)

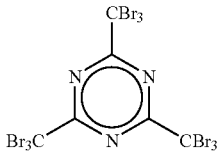

(H-8)

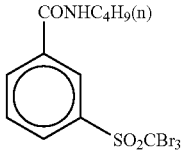

(H-9)

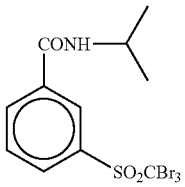

(H-10)

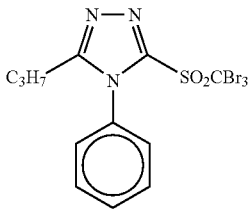

(H-11)

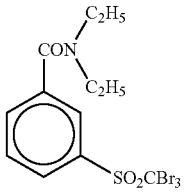

(H-12)

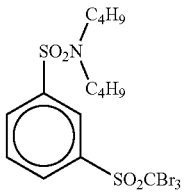

(H-13)

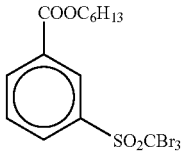

(H-14)

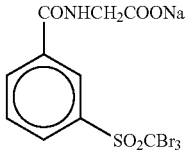

-continued (H-15)

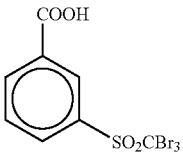

(H-16)

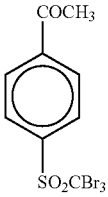

(H-17)

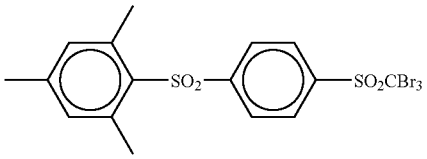

(H-18)

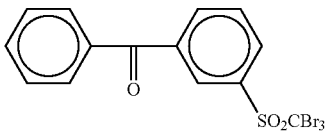

(H-19)

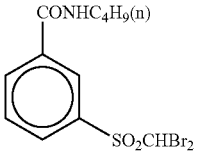

(H-20)

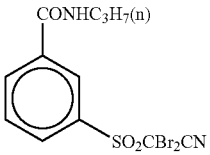

(H-21)

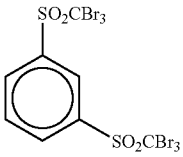

(H-22)

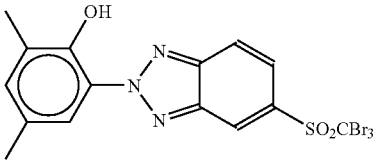

(H-23)

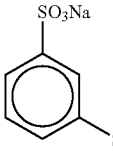

-continued (H-24)

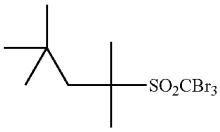

Preferred polyhalogen compounds usable herein other than the above compounds are described in JP-A 2001-31644, 2001-56526 and 2001-209145.

The amount of the compound of formula (H) is $10^{-4}$ to 1 mol, more preferably $10^{-3}$ to 0.5 mols, and even more preferably $1\times10^{-2}$ to 0.2 mols per mol of the non-photosensitive silver salt in the image-forming layer of the material.

The antifoggant may be incorporated into the heat-developable photosensitive material of the invention in the same manner as that mentioned hereinabove for incorporating the reducing agent thereinto. Preferably, the organic polyhalogen compound is in the form of a fine solid particle dispersion when it is incorporated into the material.

2) Other Antifoggant

Other antifoggant usable herein is mercury (II) salts in JP-A No. 11-65021, paragraph 0113; benzoic acids in JP-A No. 11-65021, paragraph 0114; salicylic acid derivatives in JP-A No. 2000-206642; formalin scavenger compounds of formula (S) in JP-A No. 2000-221634; triazine compounds recited in claim 9 in JP-A No. 11-352624; compounds of formula (III) in JP-A No. 6-11791; and 4-hydroxy-6-methyl-1,3,3a,7-tetrazaindene.

The heat-developable photosensitive material of the invention may also contain an azolium salt in order to prevent fogging. Examples of the azolium salt include compounds of formula (XI) in JP-A No. 59-193447, compounds in JP-B No. 55-12581, and compounds of formula (II) in JP-A No. 60-153039. The azolium salt may be present in any site of the heat-developable photosensitive material, but is preferably in a layer or layers at an image forming layer side of the material. More preferably, it is added to the organic silver salt-containing layer of the material. Regarding the time at which the azolium salt is added to the material, it may be added to the coating liquid at any stage of preparing the liquid. When it is to be present in the organic silver salt-containing layer, the azolium salt may be added to any of systems to prepare the organic silver salt or the system to prepare the coating liquid at any stage of preparing them. Preferably, however, it is added to the system after the stage of preparing the organic silver salt and just before the stage of applying the liquid. The azolium salt to be added may be in any form of a powder, a solution or a fine particle dispersion. It maybe added along with other additives such as a sensitizing dye, a reducing agent and a color toning agent, for example, in the form of their solution. The amount of the azolium salt to be added to the heat-developable photosensitive material of the invention is not specifically limited, but is preferably $1\times10^{-6}$ mols to 2 mols, and more preferably $1\times10^{-3}$ mols to 0.5 mols, per mol of silver in the material.

Other Additives

1) Mercapto Compound, Disulfide Compound and Thione Compound

The heat-developable photosensitive material of the invention may optionally contain any of a mercapto compound, a disulfide compound and a thione compound in order to retard, accelerate or control development, or to enhance the spectral sensitivity efficiency of the material, or to improve the storability thereof before and after development. Examples of these compounds are disclosed in, for example, JP-A No. 10-62899, paragraphs 0067 to 0069; compounds of formula (I) in JP-A No. 10-186572, and their examples in paragraphs 0033 to 0052; and EP-A No. 0803764A1, page 20, lines 36 to 56. The mercapto-substituted hetero-aromatic compounds described in JP-A Nos. 9-297367, 9-304875, 2001-100358, 2002-303954 and 2002-303951 are preferable.

2) Color Toning Agent

The heat-developable photosensitive material of the invention preferably contains a color toning agent. Examples thereof are described in JP-A No. 10-62899, paragraphs 0054 to 0055, EP-A No. 0803764A1, page 21, lines 23 to 48; and JP-A Nos. 2000-356317 and 2000-187298. Phthalazinones (phthalazinone, phthalazinone derivatives and their metal salts, e.g., 4-(1-naphthyl)phthalazinone, 6-chlorophthalazinone, 5,7-dimethoxyphthalazinone, or 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and their metal salts, e.g., 4-(1-naphthyl)phthalazine, 6-isopropylphthalazine, 6-tert-butylphthalazine, 6-chlorophthalazine, 5,7-dimethoxyphthalazine, or 2,3-dihydrophthalazine); combinations of phthalazines and phthalic acids are preferred for use herein. Combinations of phthalazines and phthalic acids are particuarly preferable. Among such combinations, a combination of 6-isopropylphthalazine and phthalic acid or 4-methylphthalic acid is more preferable.

3) Plasticizer and Lubricant

A plasticizer and a lubricant that may be used in the image forming layer in the invention are described in, for example, JP-A No. 11-65021, paragraph 0117. Lubricants are disclosed in JP-A No. 11-84573, paragraphs 0061 to 0064; and Japanese Patent Application No. 11-106881, paragraphs 0049 to 0062.

4) Dye and Pigment

The heat-developable photosensitive material of the invention may contain any dye and/or pigment (e.g., C.I. Pigment Blue 60, C.I. Pigment Blue 64, or C.I. Pigment Blue 15:6) in order to improve color tone, prevent interference fringes during laser exposure, and prevent irradiation.

As the dye or pigment used in the invention, a metal phthalocyanine compound is preferred. In particular, a water-soluble metal phthalocyanine compound can be used more preferably.

The "metal phthalocyanine compound" usable in the invention will be described.

The metal phthalocyanine compound is a metal complex salt of phthalocyanine nucleus not containing a metal in which the central metal may be any of metal elements such as Na, K, Be, Mg, Mn, Ca, Ba, Cd, Hg, Cr, Fe, Co, Ni, Zn, Pt, Pd, Cu, Ti, V, Si, Sr, Mo, B, Al, Pb, and Sn that can stably form the complex salt. A transition metal element is preferred and example thereof include chromium, manganese, iron, cobalt, nickel, copper, and zinc. Copper is particularly preferred.

The phthalocyanine carbocyclic aromatic ring of the metal phthalocyanine compound in the invention may be substituted with a water-soluble group directly or by way of a connection group. Examples of the water-soluble group include dissociating groups or salts thereof having pKa 6 or less such as a sulfonic acid group or salts thereof or a carboxylic acid group or salts thereof, which bond directly or by way of a connection group to the phthalocyanine carbocyclic aromatic ring. Specifically, the water-soluble group can be, for example, —$SO_2NHSO_2R$, —CONHCOOR, and —$SO_2NHCOR$.

Further, compounds in which a metal phthalocyanine compound is connected as pendant group to the main chain of a water-soluble polymer can also be used.

The compound represented by the following formula (Pc-X) is a water-insoluble metal phthalocyanine usable for blue background color.

Formula (Pc-X)

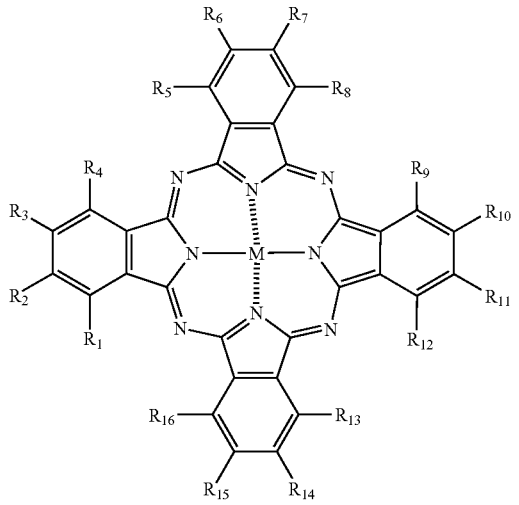

(I)

In the formula, M represents a polyvalent metal atom.

$R_1$, $R_4$, $R_5$, $R_8$, $R_9$, $R_{12}$, $R_{13}$ and $R_{16}$ each independently represent a hydrogen atom or a substituted or unsubstituted, branched or linear alkyl group.

$R_2$, $R_3$, $R_6$, $R_7$, $R_{10}$, $R_{11}$, $R_{14}$ and $R_{15}$ each independently represent a hydrogen atom, a halogen atom, an alkyl group, an aryl group, an alkoxy group, or an aryloxy group. They may have a substituent and may be branched or linear.

One or more adjacent pairs of $R_1$ and $R_2$, $R_2$ and $R_3$, $R_3$ and $R_4$, $R_5$ and $R_6$, $R_6$ and $R_7$, $R_7$ and $R_8$, $R_8$ and $R_9$, $R_9$ and $R_{10}$, $R_{10}$ and $R_{11}$, $R_{11}$ and $R_{12}$, $R_{13}$ and $R_{14}$, $R_{14}$ and $R_{15}$, and $R_{15}$ and $R_{16}$ may bond to eath other to form a substituted or unsubstituted aromatic or hetero aromatic ring.

Further, as the water-soluble metal phthalocyanine, commercially available acid dyes, direct dyes, and reactive dyes described in *Dye Handbook* (Published from Maruzen in 1975) or in *Color Index* International third edition (1992, The Society of Dye and Colourists) can be used. Specifically, C.I. Acid Blue 185, 197, 228, 242, 243, 249, 254, 255, 275, 279, 283, C. I. Direct Blue 86, 87, 189, 199, 262, 264, and 276, C.I. Reactive Blue 3, 7, 11, 14, 15, 18, 21, 23, 25, 30, 35, 38, 41, 48, 57, 58, 63, 71, 72, 77, 80, 85, 88, 91, 92, 95, 105, 106, 107, 117, 118, 123, 124, 136, 140, 143, 148, 151, 152, 153, 190, 197, 207, 215, 227, 229, and 231 can be used.

Specific examples of C. I. Direct Blue 86 include those commercial products such as Aizen Primula Turquoise Blue GLH (Hodogaya Chemical), Cupro Cyanine Blue GL (Toyo Ink), Daivogen Turquoise Blue S (Dai Nippon Ink), Direct Fast Cyanine Blue GL (Takaoka Chemical), Kayafect Blue GT, Kayafect Blue T, Kayarus Turquiose Blue GL (Nippon Kayaku), Kiwa Turquiose Blue GL (Kiwa Chemical), Nankai Direct Fast Cyanine Blue GL (Nankai Dye), Phthalocyanine Blue G conc. (Usu Chemical), Sanyo Turquoise Blue BLR (Sanyou Shikiso), Sanyo Cyanine Blue SBL conc. -B (Sanyo Shikiso), Sumilight Supra Turquiose Blue G conc., Sumilight Supra Turquoise Blue FB conc. (Sumitomo Chemical), Sirius Supra Turquoise Blue GL (Bayer), Diazol Light Turquoise JL (ICI), Lurantin Light Turquoise Blue GL (BASF), Solar Turquoise Blue GLL (Sandoz).

Specific examples of C.I. Direct blue 199 include those products such as Solar Turquoise Blue FBL (Sandoz), Lurantin Light Turquoise Blue FBL (BASF), Diazol Light Turquoise JRL (ICI), Levacell Fast Turquoise Blue BLN, Levacell Fast Turquoise Blue FBL (Bayer), Kayafect Turquoise RN (Nippon Kayaku), Sumilight Supra Turquoise Blue FB (Sumitomo Chemical), Jay Direct Turquoise Blue CGL, Jay Direct Turquoise Blue FBL (Jay Chemical).

The phthalocyanine dyes having preferred color tone and large association absorption is preferably a dye having a hydrogen bonding substituent such as a sulfamoyl group, a carbamoyl group and a hydroxyl group in the molecule and preferred are those represented by formula Pc-1.

$MPc(SO_3H)n(SO_2NHR)m$ Formula Pc-1:

In formula Pc-1, Pc represents a phthalocyanine skeleton and R represents an alkyl group, an aryl group, or a heterocyclic group, each of which may have a substituent. n represents an integer of 0 to 4 and m represents an integer of 1 to 4. M represents a hydrogen atom, a metal atom, or an oxide, a hydroxide or a halide thereof.

M is preferably Cu, Ni, Zn, or Al, Cu is the most preferred. In formula Pc-1, the sulfo group is represented as a free form but it may be a salt.

The phthalocyanine dye represented by formula Pc-1 is water-soluble and has at least one ionic hydrophilic group in the molecule. Examples of the ionic hydrophilic group include a sulfo group, a carboxyl group, a phosphono group, and a quaternary ammonium group. As the ionic hydrophilic group, a carboxylic group, a phosphono group, and a sulfono group are preferred, and a carboxylic group and a sulfo group are particularly preferred. The carboxylic group, phosphono group, and sulfo group may be in the form of a salt. Examples of a counter ion which forms the salt with the above group include an ammonium ion, an alkali metal ion (for example, a lithium ion, a sodium ion, or a potassium ion), and an organic cation (for example, a tetramethylammonium ion, a tetramethylguanidium ion, and a tetramethylphosphonium ion).

In addition, reactive dyes having a triazinyl group and dyes obtained by hydrolyzing a triazinyl reactive group are also preferred.

Further, so-called "phthalocyanine dyes" having a specified substituent at a β-position represented by the following formula Pc-2, as described in JP-A No. 2000-303009, Japanese Patent Application Nos. 2001-96610, 2001-226275, 2001-47013, 2001-57063, and 2001-76689, are preferably used in that they provide large association absorption.

Formula Pc-2

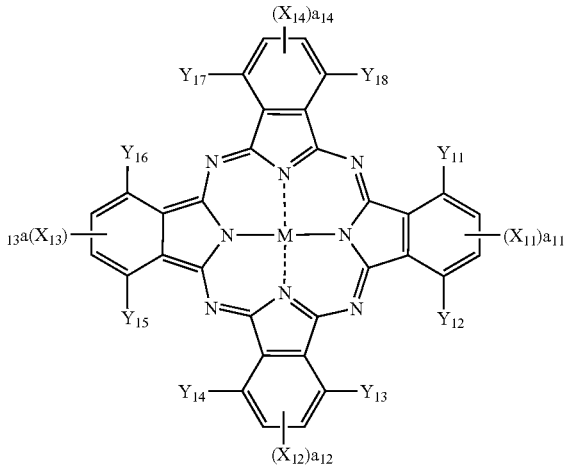

$X_{11}$ to $X_{14}$, $Y_{11}$ to $Y_{18}$ each independently represent —SO-Z, —$SO_2$-Z, —$SO_2NR^1R^2$, a sulfo group, –$CONR^1R^2$, or $CO_2R^1$. Z represents an alkyl group, a cycloalkyl group, an alkenyl group, an aralkyl group, an aryl group or a hetero cyclic group. They may have a substituent or may be branched or linear. $R^1$ and $R^2$ each independently represent a hydrogen atom, an alkyl group, a cycloalkyl group, an alkenyl group, an aralkyl group, an aryl group, or a hetero cyclic ring. They may have a substituent or may be branched or linear.

$Y_{11}$, $Y_{12}$, $Y_{13}$ and $Y_{14}$ each independently represent a monovalent substituent.

M is preferably Cu, Ni, Zn, or Al, Cu ing the most preferred.

$a_{11}$ to $a_{14}$ each independently represent an integer of 1 or 2 and preferably satisfy the relationship of $4 \leqq a_{11}+a_{12}+a_{13}+a_{14} \leqq 6$. It is particularly preferable that $a_{11}$ to $a_{14}$ are all 1.

Each of $X_{11}$, $X_{12}$, $X_{13}$, and $X_{14}$ may be the same substituent. Alternatively, $X_{11}$, $X_{12}$, $X_{13}$, and $X_{14}$ may be substituents which are similar to eath other but have a partially different potion. For example, all of $X_{11}$, $X_{12}$, $X_{13}$, and $X_{14}$ may be —$SO_2$-Z in which Zs are different from each other. Alternatively, $X_{11}$, $X_{12}$, $X_{13}$, and $X_{14}$ may contain a substituent different from each other. For example, —$SO_2$-Z and —$SO_2NR^1R^2$ simultaneously bond to the carbocyclic group of the phthalocyanine compound.

The phthalocyanine dye represented by formula Pc-2 is water-soluble and has at least one ionic hydrophilic group in the molecule. Examples of the ionic hydrophilic group include those mentioned in the descriptions of formula Pc-1.

Preferrred examples of the dyes represented by formulae Pc-1 and Pc-2 are shown below. In the followings, all ionic hydrophilic groups are represented in a free form but they may be salts.

(I) C.I. Direct Blue 199

Dyes represented by CuPc $(SO_3H)n(SO_2NHR)m$ (I-1) n=1, m=3 R=$CH_2CH_2SO_3H$ (I-2) n=2, m=2 R=$CH_2CO_2H$ (I-3) n=3, m=1 R=$CH_2CH_2CO_2H$ (I-4) n=3, m=1 R=$CH_2CH_2OH$ (I-5) n=3, m=1 R=$CH_2CH(OH)CH_3$ (I-6) n=3, m=1 R=$CH_2CH_2OCH_2CH_2OH$ (II) Dyes represented by formula Pc-2 in which $Y_{11}$ to $Y_{18}$ are H and $a_{11}$ to $a_{14}$ are 1

(II-1) $X_{11}$ to $X_{14}$=$SO_2NHCH_2CH_2SO_3H$ (II-2) $X_{11}$ to $X_{14}$=$CONHCH_2CO_2H$ (II-3) $X_{11}$ to $X_{14}$=$SO_2CH_2CH_2CH_2SO_3H$ (II-4) $X_{11}$ to $X_{14}$=$SO_3H$ (II-5) $X_{11}$ to $X_{14}$=$CO_2H$ (II-6) $X_{11}$ to $X_{14}$=$CONHCH_2CH_2SO_3H$ (II-7) $X_{11}$ to $X_{14}$=$CONHCH_2SO_3H$ (II-8) $X_{11}$ to $X_{14}$=$SO_2CH_2CH(OH)CH_2SOH$

Further, dyes described in Japanese Patent Applications Nos. 2001-96610, 2001-226275, 2001-47013, 2001-57063, and 2001-76689 can be used.

In the invention, since free ions of the same type as the central metal of the metal phthalocyanine compound generally has influence on the photographic properties of silver halide photosensitive materials, the content thereof in the heat-developable photosensitive material is preferably less than 200 mol %, preferably 100 mol % or less, and more preferably 40 mol % or less based on the content of the phthalocyanine compound.

In the invention, the metal phthalocyanine compound is preferably one of cyan dyes having aborption spectra of the following three properties.

The absorption spectra is measured, for example, based on JIS K 0115 "General Rule for Absorptiometry".

(1) A cyanine dye having absorption spectrum peaks at a wavelength within the range of 590 nm to 640 nm and at a wavelength within the range of 650 nm to 710 nm.

(2) A cyanine dye having an absorption spectrum peak at a wavelength within the range of 590 nm to 640 nm but not having another absorption spectrum peak at a wavelength within the range of 650 nm to 710 nm (excluding shoulders not forming an absorption maximum).

(3) A cyanine dye having an absorption spectrum peak at a wavelength within the range of 650 nm to 710 nm but not having another absorption spectrum peak at a wavelength within the range of 590 nm to 640 nm (excluding shoulders not forming an absorption maximum).

It is known that dyes having the same color index number may also have a different substituent or the different number and/or different positions of substituents and therefore may have a different position and different magnitude of their absorption spectrum peak.

A phthalocyanine dye generally has an absorption peak of a monomer in the wavelength range of 650 nm to 710 nm and preferably 650 nm to 690 nm, and an absorption peak of an aggregate in the wavelength range of 590 nm to 650 nm and preferably 590 nm to 600 nm. When the monomer absorption is excessively strong, the resultant tone becomes greenish. This is not acceptable for obtaining a blue color tone preferred in the field of medical photography.

Since the cyan dye having the above properties (1) has absorption over a wide wavelength range, it is extremely preferred in that the dye can have versatile functions such as color tone control, antiirradiation, antihalation and a safe light filter.

Given that, in the absorption spectrum in the film, A indicates the value of an absorption spectrum peak in the wavelength of 590 nm to 640 nm, and that B indicates the value of an absorption spectrum peak in the wavelength of 650 nm to 710 nm, the preferred ratio of these values with respect to the following points can be shown below.

In view of possibility of color tone control and decreased decline of the sensitivity of a red color-sensitive photosensitive material, B/A is preferably 1.0 or less, more preferably 0.9 or less and most preferably 0.8 or less.

On the contrary, when importance is attached to antiirradiation and antihalation functions, B/A is preferably more than 1.0, and, in view of well balance between these functions, preferably satisfies the relation of $0.5<B/A<1.8$, and particularly preferably satisfies the relation of $0.8<B/A<1.3$ In a metal phalocyanine compound having absorption spectrum peaks in the wavelength range of 590 nm to 640 nm and in the wavelength range of 650 nm to 710 nm, the ratio between the two peak values is different depending on the type of the compound. The difference is caused by the type and/or the position of a substituent and/or the number of substituents.

Further, the cyan dye having the above properties (2) has sharp absorption and much absorption in the visible region. Therefore, the cyan dye is preferable in that it can effectively function as a color tone controlling compound or a safe light filter in the photosensitive material even when the content thereof is small. The state where an absorption spectrum peak is not present in the wavelength range between 650 nm and 710 nm is also different depending on the type of the compound. The difference is caused by the type and/or the position of a substituent and/or the number of substituents.

Further, the cyan dye having the above properties (3) has sharp absorption and little or a little absorption in the visible region. Therefore, the cyan dye is preferred in that it can be useful for such functions as antiirradiation and antihalation in the photosensitive material even when the content thereof is small. The state where an absorption spectrum peak is not present in the wavelength range between 590 nm and 640 nm is also different depending on the type of the compound. The difference is caused by the type and/or the position of a substituent and/or the number of substituents.

The absorbance of the metal phthalocyanine compound is preferably such that the maximum absorbance of a solution obtained by diluting, with water, an aqueous 2 mass % solution of the compound to 1000 times is 0.3 or more and less than 1.2 in the wavelength range of from 400 nm to 800 nm.

In the invention, the metal phthalocyanine compound is preferably used as an aqueous solution or a fine particle dispersion liquid thereof previously prepared by using water as a medium in the preparation of a photosensitive material. In the invention, the content of the metal phthalocyanine compound in the solution is about 0.1 to 30 mass %, preferably 0.5 to 20 mass %, and more preferably 1 to 8 mass %. The solution may further contain a water-soluble organic solvent or an auxiliary additive. The content of the water-soluble organic solvent is 0 to 30 mass %, and preferably 5 to 30 mass %. The content of the auxiliary additive is 0 to 5 mass %, and preferably 0 to 2 mass %.

In the invention, specific examples of the water-soluble organic solvent which can be used in preparing the aqueous solution or the fine particle dispersion liquid of the metal phthalocyanine compound include alkanoles having one to four carbon atoms such as methanol, ethanol, propanol, isopropanol, butanol, isobutanol, secandary butanol, and tertiary butanol; carboxylic acid amides such as N,N-dimethylformamide and N,N-dimethylacetoamide; lactams such as ε-caprolactam and N-methylpyrrolidin-2-one; urea and cyclic urea such as 1,3-dimethylimidazolidin-2-one and 1,3-dimethylhexahydropyrimid-2-one; ketons and ketoalcohols such as acetone, methyl ethyl ketone, 2-methyl-2-hydroxypentan-4-one, ethers such as tetrahydrofuran, and dioxane; mono-, oligo- or polyalkylene glycol and thio glycols having an alkyle unit with two to six carbon atoms such as ethylene glycol, 1,2- or 1,3-propylene glycol, 1,2- or 1,4-butylene glycol, 1,6-hexylene glycol, diethylene glycol, triethylene glycol, dipropylene glycol, thiodiglycol, polyethylene glycol, and polypropylene glycol; polyols (triols) such as glycerin, and hexane-1,2,6-triol; C1-C4 alkyl ethers of polyhydric alcohols such as ethylene glycol monomethyl ether, ethylene glycol monoethyl ether, diethylene glycol monomethyl ether, diethylene glycol monoethyl ether, triethylene glycol monomethyl ether, and triethylene glycol monoethyl ether; γ-butyrolacton; and dimethylsulfoxide. Tow or more of such water-soluble organic solvents may be used together.

Among the above-described water-soluble organic solvents, urea, N-methylpyrrolidine-2-on, mono- di- or trialkylene glycol having an alkylene unit of 2 to 6 carbon atoms are preferred and mono-, di-, or triethylene glycol, dipropylene glycol, and dimethyl sulfoxide are used preferably. In particular, use of N-methylpyrrolidine-2-on, diethylene glycol, dimethyl sulfoxide or urea is preferred and urea is particularly preferred.

In the invention, the aqueous solution of the metal phthalocyanine dye is further diluted by mixing it with various chemicals during preparation of the photosensitive material. A method of incorporating a water-soluble organic solvent, apart from the aqueous solution, in an amount of 1 mol to 500 mol based on one mol of the metal phthalaocyanine compound content also is preferably used.

The addition amount of the dye is determined in considaration of silver color tone or color tone provided by other additives, in order to obtain iamges having blue color tone after heat development. Generally, the dye is used such that the optical density (absorbance) thereof does not exceed 0.5 when measured at a desired wavelength (measured at 600 nm in the case of a cyanine dye). The optical density is from 0.01 to 0.5, preferably 0.01 to 0.1 and more preferably 0.01 to 0. 05. In order to obtain such an optical density, the amount of the dye is generally 0.5 to 150 mg/m$^2$, preferably 0.5 to 30 mg/m$^2$, and more preferably 0.5 to 15 mg/m$^2$.

5) Super-High Contrasting Agent

In ordr to form super-high contrast images suitable to printing plates, the image-forming layer preferably contains a super-high contrasting agent. The super-high contrasting agent, the method of adding the same, and an amount thereof are disclosed in, for example, JP-A No. 11-65021, paragraph 0118; JP-A No. 11-223898, paragraphs 0136 to 0193; compounds of formula (H), those of formulae (1) to (3) and those of formulae (A) and (B) in Japanese Patent Application No. 11-87297; and compounds of formulae (III) to (V) in Japanese Patent Application No. 11-91652, especially concrete compounds in Formula 21 to Formula 24 therein. A contrasting accelerator is disclosed in JP-A No. 11-65021, paragraph 0102; and JP-A No. 11-223898, paragraphs 0194 to 0195.

When formic acid or its salt is used as a strong fogging agent in the invention, it may be contained in the side of the heat-developable photosensitive material that has an image-forming layer including photosensitive silver halide, and the amount thereof is preferably at most 5 mmols, and more preferably at most 1 mmol per mol of silver.

When a super-high contrasting agent is used in the heat-developable photosensitive material of the invention, it is preferably combined with an acid formed through hydration of diphosphorus pentoxide or its salt. Examples of the acid formed through hydration of diphosphorus pentoxide and its salts include metaphosphoric acid (and its salts), pyrophosphoric acid (and its salts), orthophosphoric acid (and its salts), triphosphoric acid (and its salts), tetraphosphoric acid (and its salts), and hexametaphosphoric acid (and its salts). The acid formed through hydration of diphosphorus pentoxide and its salts is preferably orthophosphoric acid (or its salt), or hexametaphosphoric acid (or its salt). Specific examples thereof include sodium orthophosphate, sodium dihydrogen orthophosphate, sodium hexametaphosphate, and ammonium hexametaphosphate.

The amount of the acid formed through hydration of diphosphorus pentoxide or its salt to be used herein (that is, the amount thereof per m$^2$ of the heat-developable photosensitive material) depends on the sensitivity, the fogging and other properties of the material. However, the amount is preferably 0.1 to 500 mg/m$^2$, and more preferably 0.5 to 100 mg/m$^2$.

In the invention, the reducing agent, the hydrogen-bonding compound, the development accelerator and the polyhalogen compound are preferably used in the form of their solid dispersions, and preferred production methods of these solid dispersions are descried in JP-A No. 2002-55405.

Preparation of Coating Liquid and Application Thereof

The temperature at which the coating liquid for the image-forming layer is prepared is preferably 30° C. to 65° C., more preferably at least 35° C. but lower than 60° C., and even more preferably 35° C. to 55° C. Moreover, the temperature of the coating liquid is preferably kept at 30° C. to 65° C. immediately after a polymer latex is added thereto.

Layer Configuration and Constituent Components

1) Intermediate Layer

An intermediate layer is preferably disposed between the surface protection layer including the outermost layer and the image forming layer in order to obtain good state of coated surfaces. Intermediate layers described in JP-A Nos. 10-186571, 11-119375, and 11-288058 can be used. In the invention, at least two intermediate layers are preferably disposed between the outermost layer and the image forming layer. In particular, in the invention, since the content of a latex with no setting property in the binder of the outermost layer is 50 mass % or more, it is preferred that the intermediate layer adjacent to the outermost layer contains a polymer having a setting property (for example, a water-soluble polymer derived from animal protein, such as gelatin, or polysaccharides derived from plants such as carrageenan).

2) Antihalation Layer

In the heat-developable photosensitive material of the invention, an antihalation layer may be disposed farther from the light source than the image forming layer.

The antihalation layer is described in, for example, JP-A No. 11-65021, paragraphs 0123 to 0124; JP-A Nos. 11-223898, 9-230531, 10-36695, 10-104779, 11-231457, 11-352625 and 11-352626.

The antihalation layer contains an antihalation dye capable of absorbing the light to which the heat-developable photosensitive material is exposed. When the heat-developable photosensitive material is exposed to IR rays, an IR-absorbing dye may be used for antihalation. In this case, it is preferable that the dye does not absorb visible light.

On the other hand, when a visible light-absorbing dye is used for antihalation, it is preferable that the dye used is substantially decolored after image formation. For this, a decoloring means that decolors the dye when heated in the step of heat development can be used. Preferably, a thermal decoloring dye and a base precursor are contained in a non-photosensitive layer to function as an antihalation layer. The details of this technique are described in, for example, JP-A No. 11-231457.

The amount of the decoloring dye depends on the use of the dye. In general, its amount is so determined that the dye added can ensure an optical density (absorbance), measured at an intended wavelength, of larger than 0.1. The optical density is preferably 0.15 to 2, and more preferably 0.2 to 1. The amount of the dye capable of ensuring the optical density within the range may be generally from 0.001 to 1 $g/m^2$.

Decoloring the dye in the heat-developable photosensitive material in that manner can lower the optical density of the material to 0.1 or less after heat development. Two or more different types of decoloring dyes may be contained in the thermodecoloring recording material or the heat-developable photosensitive material. Similarly, two or more different types of base precursors may be contained in the material.

In the thermodecoloring material that contains such a decoloring dye and a base precursor, it is preferable, in view of the thermodecoloring ability of the material, that the base precursor therein is combined with a substance which, when mixed with the base precursor, can lower the melting point of the mixture by at least 3° C. (e.g., diphenylsulfone, 4-chlorophenyl(phenyl)sulfone, or 2-naphthyl benzoate), as shown in JP-A No. 11-352626.

3) Back Layer

A back layer applicable to the invention is described in JP-A No. 11-65021, paragraphs 0128 to 0130.

In the invention, the heat-developable photosensitive material can include a coloring agent having an absorption maximum in the range of 300 and 450 nm in order to improve silver tone and reduce change of image over time. The coloring agent is described in, for example, JP-A Nos. 62-210458, 63-104046, 63-103235, 63-208846, 63-306436, 63-314535, 01-61745, and 2001-100363.

In general, the amount of the coloring agent to be contained in the material is 0.1 $mg/m^2$ to 1 $g/m^2$. Preferably, it is contained in the back layer that is opposite to the image forming layer of the material.

Moreover, the heat-developable photosensitive material of the invention preferably contains a dye that has an absorption peak within the range of from 580 to 680 nm in order to control the base color tone of the material. The dye for that purpose is preferably those having a low absorption intensity in the short wavelength side, and more specifically oil-soluble azomethine dyes in JP-A Nos. 4-359967 and 4-359968 and water-soluble phthalocyanine dyes in Japanese Patent Application No. 2002-96797. The dye may be included in any layer of the material, but preferably in the non-photosensitive layer at an emulsion layer side or in a back face side.

4) Undercoating Layer

In the invention, an undercoating layer can be disposed between the image forming layer and the support.

5) Matting Agent

The heat-developable photosensitive material of the invention preferably contains a matting agent in order to improve the transporting properties of the material. The matting agent is described in JP-A No. 11-65021, paragraphs 0126 to 0127. The amount of the matting agent (the coating amount per $m^2$ of the heat-developable photosensitive material) is preferably 1 to 400 $mg/m^2$, and more preferably 5 to 300 $mg/m^2$.

Regarding its shape, the matting agent for use in the invention may have any form including regular or irregular form, but regular particles are preferable, and spherical particles are more preferable. The mean particle size of the particles is preferably 0.5 to 10 μm, more preferably 1.0 to 8.0 μm, and still more preferably 2.0 to 6.0 μm. The fluctuation coefficient of the particle size distribution of the particles is preferably at most 50%, more preferably at most 40%, and even more preferably at most 30%. The particle size fluctuation coefficient is represented by (standard deviation of particle size)/(mean value of particle size)×100. Two different types of matting agents having a small fluctuation coefficient and differing from each other in that the ratio of the mean particle sizes of the two is more than 3 are also preferably combined.

The matting degree at the surface of the emulsion layer is not specifically limited, so far as the matted layer surface is free from star dust defects. However, the Beck's smoothness of the matted surface is preferably 30 seconds to 2000 seconds, and more preferably 40 seconds to 1500 seconds. The Beck's smoothness is readily obtained according to JIS P8119 (method of testing surface smoothness of paper and paperboard with Beck tester), and TAPPI Standard T479, which are incorporated by referene herein.

Regarding the matting degree of the back layer of the heat-developable photosensitive material of the invention, the Beck's smoothness of the matted back layer is preferably 10 seconds to 1200 seconds, more preferably 20 seconds to 800 seconds, and even more preferably 40 seconds to 500 seconds.

The heat-developable photosensitive material of the invention preferably contains the matting agent in the outermost surface layer, or in a layer functioning as an outermost surface layer, or in a layer near the outermost surface of the material. The heat-developable photosensitive material may also preferably contain the matting agent in a layer that functions as a protective layer.

6) Film Surface pH

The heat-developable photosensitive material of the invention preferably has a film surface pH of at most 7.0, and more preferably at most 6.6 before heat development. The lowermost limit of the pH is not specifically limited, but may be about 3. Most preferably, the pH is within the range of 4 to 6.2. In order to control the film surface pH of the heat-developable photosensitive material, nonvolatile acids, for example, organic acids such as phthalic acid derivatives or sulfuric acid, or volatile bases such as ammonia can be used. These are preferred since they are effective for reducing the film surface pH of the material. In particular, ammonia is preferable to attain a low film surface pH, since it is highly volatile, and therefore can be readily removed during coating or before heat development.

Combining ammonia with a nonvolatile base such as sodium hydroxide, potassium hydroxide or lithium hydroxide is also preferable. A method for measuring the film surface pH of the heat-developable photosensitive material is described in JP-A No. 2000-284399, paragraph 0123.

7) Film Hardener

A hardener may be contained in the image forming layer, the protective layer, the back layer and other layers of the heat-developable photosensitive material of the invention. The details of the hardener applicable to the invention are described in "*The Theory of the Photographic Process*", 4th Edition, written by T. H. James (Macmillan Publishing Co., Inc., 1977), pp. 77-87. Examples thereof include chromium alum, 2,4-dichloro-6-hydroxy-s-triazine sodium salt, N,N-ethylenebis(vinylsulfonacetamide), N,N-propylenebis (vinylsulfonacetamide); polyvalent metal ions described on page 78 of that reference; polyisocyanates described in U.S.

Pat. No. 4,281,060 and JP-A No. 6-208193; epoxy compounds described in U.S. Pat. No. 4,791,042; and vinylsulfone compounds described in JP-A No. 62-89048.

The hardener is added to the coating liquids in the form of its solution. The hardener is preferably added to the coating liquid for forming the protective layer during a period starting from 180 minutes before coating and ending immediately before coating, preferably during a period starting from 60 minutes to 10 seconds before coating. There is no specific limitation on mixing methods and mixing conditions, so far as the method and the conditions ensure the advantages of the invention. Specific examples of mixing methods include a method of adding the hardener to the coating liquid in a tank in such a controlled manner that the mean residence time in the tank, which is calculated from the addition amount of the hardener and the flow rate of the coating liquid to a coater, can be a desired period of time; and a method of mixing them with a static mixer disclosed in *Liquid Mixing Technology*, Chapter 8 (written by N. Harnby, M. F. Edwards & A. W. Nienow, translated by Koji Takahasi, and published by Nikkan Kogyo Shinbun in 1989).

8) Surfactant

Surfactants applicable to the invention can be the same compound as that mentioned in the descriptions of the outermost layer.

The surfactant may be used in any of the emulsion-coated surface and the back surface of the heat-developable photosensitive material of the invention, but is preferably used in both these surfaces of the material. More preferably, the surfactant is combined with the above-mentioned conductive layer containing a metal oxide. In this case, even when the amount of the fluorine-containing layer in the conductive layer side is reduced or removed, the heat-developable photosensitive material of the invention still has good properties.

The amount of the fluorine-containing surfactant is preferably from 0.1 mg/m$^2$ to 100 mg/m$^2$, more preferably from 0.3 mg/m$^2$ to 30 mg/m$^2$, and even more preferably from 1 mg/m to 10 mg/m$^2$ in each of the emulsion-coated face and the back face of the material. In particular, the fluorine-containing surfactants described in Japanese Patent Application No. 2001-264110 are significantly effective, and the amount of the surfactant is preferably from 0.01 mg/m$^2$ to 10 mg/m$^2$, and more preferably from 0.1 mg/m$^2$ to 5 mg/m$^2$.

9) Antistatic Agent

The heat-developable photosensitive material of the invention preferably has as an antistatic layer an electrically conductive layer that contains a metal oxide or an electrically conductive polymer. The antistatic layer may also serve as an undercoating layer or a back surface-protective layer, but may be provided separately from them. The electrically conductive material of the antistatic layer is preferably a metal oxide having increased electroconductivity by introducing an oxygen defect or a different metal atom into the metal oxide. Preferred examples of the metal oxide include ZnO, $TiO_2$ and $SnO_2$. It is preferable to add Al or In to ZnO, add Sb, Nb, P or a halogen element to $SnO_2$, and add Nb or Ta to $TiO_2$. In particular, $SnO_2$ with Sb added thereto is preferred. The amount of the different metal atom added is preferably from 0.01 to 30 mol %, and more preferably from 0.1 to 10 mol %. The shape of the metal oxide may be any one of spherical form, needle-like form and plate-like form but, in view of its electroconductivity, a needle-like particle having a long axis/short axis ratio of 2.0 or more, preferably from 3.0 to 50 is preferable. The amount of the metal oxide used is preferably from 1 to 1000 mg/m$^2$, more preferably from 10 to 500 mg/m$^2$, and even more preferably from 20 to 200 mg/m$^2$. In the invention, the antistatic layer may be disposed either on the emulsion surface side or on the back surface side but is preferably between the support and the back layer. Specific examples of the antistatic layer that may be used in the invention are described in JP-A No. 11-65021, paragraph 0135; JP-A Nos. 56-143430, 56-143431, 58-62646 and 56-120519; JP-A No. 11-84573, paragraphs 0040 to 0051; U.S. Pat. No. 5,575,957; and JP-A No. 11-223898, paragraphs 0078 to 0084.

10) Support

The support of the heat-developable photosensitive material of the invention may be a transparent support. Biaxially-oriented polyester films (especially polyethylene terephthalate) which have been heated at a temperature of 130 to 185° C. are preferable as the transparent support. The heat treatment is conducteed to remove the internal strain that may remain in the biaxially-oriented films and to prevent the film supports from thermally shrinking during heat development of the material. When the heat-developable photosensitive material is one for medical treatment, the transparent support thereof may be colored with a blue dye (for example, with Dye-1 used in Examples in JP-A No. 8-240877), or may not be colored. Preferably, the support of the heat-developable photosensitive material of the invention is undercoated, for example, with a water-soluble polyester of JP-A No. 11-84574; a styrene-butadiene copolymer of JP-A No. 10-186565; or a vinylidene chloride copolymer of JP-A No. 2000-39684 or Japanese Patent Application No. 11-106881, paragraphs 0063 to 0080. When the support is coated with an emulsion layer or a back layer, the moisture content of the support is preferably at most 0.5% by weight.

11) Other Additives

The heat-developable photosensitive material of the invention may optionally contain an antioxidant, a stabilizer, a plasticizer, a UV absorbent and/or a coating aid. Such additives may be contained in any of the image forming layer and the non-photosensitive layers of the material. The additives are described in WO 98/36322, EP-A No. 803764A1, and JP-A Nos. 10-186567 and 10-18568.

12) Coating Method

To fabricate the heat-developable photosensitive material of the invention, the coating liquids may be applied onto the support in any desired manner. Concretely, various types of coating techniques are employable herein, including, for example, extrusion coating, slide coating, curtain coating, dip coating, knife coating, and flow coating. Various types of hoppers for extrusion coating employable herein are described in U.S. Pat. No. 2,681,294. Extrusion coating or slide coating described in "*Liquid Film Coating*" wirrten by Stephen F. Kistler & Petert M. Schweizer (Chapman & Hall, 1997), pp. 399-536 is preferable for the formation of the heat-developable photosensitive material of the invention. Slide coating is more preferable. One example of the shape of a slide coater for slide coating is shown in FIG. 11b-1, on page 427 of that reference. If desired, two or more layers may be formed at the same time, for example, according to the methods described from page 399 to page 536 of that reference, or to the methods described in U.S. Pat. No. 2,761,791 and British Patent No. 837,095. Coating methods particularly preferred for the invention are described in, for example, JP-A Nos. 2001-194748, 2002-153808, 2002-153803 and 2002-182333.

Preferably, the coating liquid for the organic silver salt-containing layer in the invention is a thixotropic fluid. As for such fluid, the technique described in JP-A No. 11-52509 can be referred to. Preferably, the coating liquid for the organic silver salt-containing layer in the invention has a viscosity of 400 mPa·s to 100,000 mPa·s, and more preferably of 500 mPas to 20,000 mPa·s, at a shear rate of 0.1 $sec^{-1}$. The viscosity is preferably 1 mPa·s to 200 mPa·s, and more preferably 5 mPa·s to 80 mPa·s, at a shear rate of 1000 $sec^{-1}$.

When two liquids are mixed to prepare the coating liquid in the invention, a known in-line mixer or an in-plant mixer is preferably used. An in-line mixer preferred for the invention is described in JP-A No. 2002-85948; and an in-plant mixer preferred for the invention is in JP-A 2002-90940.

The coating liquid is preferably defoamed to improve the state of the surface coated with it. For example, the defoaming method described in JP-A 2002-66431 is preferred for the invention.

It is also preferable that the charge of the support is, before the support is coated with coating liquids, eliminated to prevent the support from attracting dust and others. For example, the charge elimination method preferred for the invention is described in JP-A No. 2002-143747.

In the invention, it is important to accurately control the drying air and the drying temperature in drying the coating liquid for a non-setting image-forming layer. The drying method preferred for the invention is described in detail in JP-A Nos. 2001-194749 and 2002-139814.

It is preferable that, after the coating liquids have been applied to the support to form the layers thereon and dried, the thus-fabricated material is heated to improve the film-forming properties of the coating liquids. The heating temperature measured on the film surface is preferably from 60° C. to 100° C., and the heating time is preferably from 1 second to 60 seconds. More preferably, the heating temperature is from 70 to 90° C. and the heating time is from 2 to 10 seconds. The heating method preferred for the invention is described in JP-A No. 2002-107872.

For stable and continuous fabrication of the heat-developable photosensitive material of the invention, the fabrication methods described in JP-A Nos. 2002-156728 and 2002-182333 are preferable.

Preferably, the heat-developable photosensitive material of the invention is monosheet type one. The monosheet type material does not require any additional sheet such as an image-receiving material, and may directly form images on itself.

13) Packaging Material

13) Packaging Material

The photographic material of the invention is preferably packaged with a material having a low oxygen and/or moisture permeability to prevent its photographic properties from varying and to prevent it from curling or from having a curling habit while stored as unprocessed stocks. The oxygen permeability at 25° C. of the packaging material for use herein is preferably at most 50 ml/atm·$m^2$·day, more preferably at most 10 ml/atm·$m^2$·day, and even more preferably at most 1.0 ml/atm·$m^2$·day. The moisture permeability thereof is preferably at most 10 g/atm·$m^2$·day, more preferably at most 5 g/atm·$m^2$·day, and even more preferably at most 1 g/atm·$m^2$·day.

Preferred examples of the packaging material having a low oxygen and/or moisture permeability for use herein are described, for example, in JP-A Nos. 8-254793 and 2000-206653.

14) Other Employable Techniques

Other techniques applicable to the heat-developable photosensitive material of the invention are described, for example, in EP-A Nos. 803764A1 and 883022A1, WO 98/36322; JP-A Nos. 56-62648,58-62644, 9-43766, 9-281637,9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2000-187298, 2000-10229, 2000-47345, 2000-206642, 2000-98530, 2000-98531, 2000-112059, 2000-112060, 2000-112104, 2000-112064 and 2000-171936.

When the heat-developable photosensitive material of the invention is a multi-color heat-developable photosensitive material, a functional or non-functional barrier layer is disposed between adjacent emulsion layers (image forming layers), as disclosed in U.S. Pat. No. 4,460,681.

Regarding its configuration, the multi-color heat-developable photosensitive material may have combinations of the two layers for each color, or may contain all the necessary ingredients in a single layer, as disclosed in U.S. Pat. No. 4,708,928.

Image Forming Method

1) Exposure

He—Ne laser emitting red-infrared light, a red light-emitting semiconductor laser, or $Ar^+$, He—Ne, He—Cd laser emitting blue to green light, and a blue light-emitting semiconductor laser can be used for exposure. A red-infrared semiconductor laser is preferred. The peak wavelength of the laser light is 600 nm to 900 nm and, and preferably 620 nm to 850 nm. Meanwhile, a module in which an SHG (Second Harmonic Generator) device and a semiconductor laser are integrated and a blue light-emitting semiconductor laser have been developed in recent years, and a laser output device of a short wavelength region has been highlighted. Since the blue light-emitting semiconductor laser can record images highly precisely and can increase a recording density and has a long life and can obtain stable output, it is expected that the demand therefor will increase in the feature. The peak wavelength of the blue light-emitting laser light is preferably 300 nm to 500 nm and more preferably 400 nm to 500 nm.

In addition, laser rays that oscillate in a longitudinal multi mode through high-frequency superimposition are also preferred for use in the invention.

2) Heat Development

The heat-developable photosensitive material of the invention may be developed in any manner. In general, after imagewise exposure, the material is developed with heat. The temperature of the heat development is preferably 80 to 250° C., more preferably 100 to 140° C., and even more preferably 110 to 130° C. The development time is preferably 1 to 60 seconds, more preferably 3 to 30 seconds, even more preferably 5 to 25 seconds, and still more preferably 7 to 15 seconds.

Any of a drum heater system and a plate heater system can be used for heat development of the heat-developable photosensitive material but a plate heater system is preferable. A heat development method with the plate heater system is preferably a method described in JP-A No. 11-133572. In the plate heater system described therein, a heat-developable photosensitive material which has been exposed to light to form a latent image thereon is brought into contact with a heating unit in a heat development zone to thereby convert the latent image into a visible image. In this system, the heating unit comprises a plate heater, and multiple press rolls are disposed facing one surface of the plate heater. The exposed heat-developable photosensitive material is heated and developed while it is passing between the multiple press rolls and the plate heater. The plate heater may be sectioned into 2 to 6 stages. In this case, it is preferable that the temperature of the top stage is kept lower by 1 to 10° C. than that of the others. For example, four plate heaters whose temperatures are independently controllable may be used, and the temperatures thereof are set at 112° C., 119° C., 121° C. and 120° C., respectively. Such a system is described in JP-A No. 54-30032. In the plate heater system, water and the organic solvent that remain in the heat-developable photosensitive material can be removed out of the material. In addition, deformation of the support caused by rapid heating thereof can be prevented.

For the miniaturization of a heat-developing device and for shortening of heat development time, it is preferable that the heaters used can be controlled more stably. In addition, it is also preferable that heat development of the exposed front portion of a sheet type material is started before exposure of the rear portion of the material has been finished. Imagers that enable rapid processing favorably for the invention are described in, for example, JP-A Nos. 2002-289804 and 2002-287668. Use of the imager having a plate type heater with three stages whose temperatures are controlled at 107° C., 121° C. and 121° C., respectively enables heat development for 14 seconds and can shorten output time necessary for output the first sheet to about 60 seconds.

3) System

Examples of laser imagers for medical treatment equipped with an exposure unit and a heat development unit include Fuji Medical Dry Laser Imager FM-DP L and Dry PIX 7000. The system FM-DP L is described in Fuji Medical Review No. 8, pp. 39-55. The technique disclosed therein is applicable to laser imagers for the heat-developable photosensitive material of the invention. In addition, the heat-developable photosensitive material of the invention can be processed with the laser imager in the AD Network which Fuji Film Medical has proposed as a network system adapted to DICOM Standards.

Applications of the Invention

The heat-developable photosensitive material and image forming method of the invention form a monochromatic image based on a silver image, and are favorable for use in medical diagnosis, industrial photography, printing, and COM.

EXAMPLE

The present invention will be described concretely by way of examples but the invention is not restricted to them.

Example 1

Preparation of PET Support

1) Film Preparation

PET was made of terephthalic acid and ethylene glycol in an ordinary manner, having an intrinsic viscosity, IV, of 0.66 (measured in a mixture of phenol and tetrachloroethane at a weight ratio of 6/4 at 25° C.). This was pelletized, and the resultant was dried at 130° C. for 4 hours, and melted at 300° C. The PET melt was extruded out from a T-die, and rapidly cooled. Thus, anon-oriented film whose thickness was so controlled that the thickness after thermal fixation was 175 μm was prepared.

The film was longitudinally oriented by rolls rotating at different circumferencial speeds at 110° C. so that the longitudinal length thereof after the orientation was 3.3 times as long as the original longitudinal length thereof. Next, the film was laterally oriented by a tenter at 130° C. so that the lateral length thereof after the orientation was 4.5 times as long as the original lateral length thereof. Next, the oriented film was thermally fixed at 240° C. for 20 seconds, and then laterally relaxed by 4% at the same temperature. Next, the chuck of the tenter was slitted, the both edges of the film were knurled, and the film was rolled up at 4 kg/cm$^2$. The rolled film had a thickness of 175 μm.

2) Surface Corona Discharging Treatment

Both surfaces of the support were subjected to corona treatment at room temperature at a speed of 20 m/minute with a Pillar's solid-state corona processor, Model 6KVA. From the data of the current and the voltage read, it was seen that the support had been processed at 0.375 kV·A·min/m$^2$. The treatment frequency was 9.6 kHz, and the gap clearance between the electrode and the dielectric roll was 1.6 mm.

3) Undercoating Treatment

Preparation of Coating Liquid for Undercoating Layer

Formulation <1> (for Undercoating Layer Below Image-Forming Layer)

Takamatsu Yushi's Pesuresin A-520 (30 mass % solution) 59 g

Polyethylene glycol monononylphenyl ether (mean number of ethylene oxides: 8.5, 10 mass % solution) 5.4 g Soken Chemical's MP-1000 (polymer particles having a mean particle size of 0.4 μm) 0.91 g Distilled water 935 ml Formulation <2> (for First Layer on Back Surface)

Styrene-butadiene copolymer latex (solid content: 40 mass %, mass ratio of styrene and butadiene: 68/32) 158 g 2,4-Dichloro-6-hydroxy-S-triazine sodium salt (8 mass % aqueous solution) 20 g Sodium laurylbenzenesulfonate (1 mass % aqueous solution) 10 ml Distilled water 854 ml Formulation <3> (for Second Layer on Back Surface)

$SnO_2$/SbO (mass ratio: 9/1, meanparticle size: 0.038 μm, 17mass % dispersion) 84 g Gelatin (10 mass % aqueous solution) 89.2 g Shin-etsu Chemical's Metolose TC-5 (2 mass % aqueous solution) 8.6 g Soken Chemical's MP-10000.01 g Sodium dodecylbenzenesulfonate (1 mass % aqueous solution) 10 ml NaOH (1 mass %) 6 ml Proxel (from ICI) 1 ml Distilled water 805 ml 2) Undercoating Both surfaces of the biaxially oriented polyethylene terephthalate support (thickness: 175 μm) were subjected to corona discharge treatment in the above manner. One surface (to have an iamge forming layer thereon) of the support was coated with the coating liquid of undercoating layer formulation <1> by using a wire bar so that the wet application amount of the coating liquid was 6.6 ml/m$^2$ (per one surface), and the coating was dried at 180° C. for 5 minutes. Next, the other surface (back surface) of the support was coated with the coating liquid of unercoating layer formulation <2> by using a wire bar so that the wet application amount of the coating liquid was 5.7 ml/m$^2$, and the coating was dried at 180° C. for 5 minutes. The back surface thus coated was further coated with the coating liquid of undercoating layer formulation <3> by using a wire bar so that the wet application amount of the coating liquid was 7.7 ml/m$^2$, and the coating was dried at 180° C. for 6 minutes. In that manner, the support was undercoated.

Back Layer

1) Preparation of Back Layer Coating Liquid

Preparation of Fine Solid Particle Liquid Dispersion (a) of Base Precursor 2.5 kg of abase precursor compound 1, 300 g of a surfactant (Demol N™ from Kao Corporation), 800 g of diphenylsulfone, 1.0 g of benzothiazolinone sodium salt were mixsed with eath other and distilled water was added to the resultant mixture so as to make the total amount of the resultant 8.0 kg, and the resultant mixture was dispersed with a horizontal sand mill (UVM-2; manufactured by IMEX Co., Ltd.) including beads. In the dispersion, the mixture was fed by a diaphragm pump to UVM-2 including zirconia beads with an average diameter of 0.5 mm and dispersed at an internal pressure of 50 hPa or higher until a desired average particle size was obtained.

The dispersion was dispersed until the ratio of absorbance at 450 nm and absorbance at 650 nm (D450/650) in the spectral absorption of the dispersion reached 3.0 when spectral absorptiometry was conducted. The obtained dispersion was diluted with distilled water such that the concentration of the base precursor was 25% by mass and filtered through a polyprolylene filter with an average pore size of 3 μm in order to remove dusts and put into practical use.

2) Preparation of Fine Solid Dye Particle Liquid Dispersion 6.0 kg of cyanine dye compound-1, 3.0 kg of sodium p-dodecylbenzenesulfonate, 0.6 kg of surfactant Demol SNB (manufactured by Kao Corporation) and 0.15 kg of a defoamer (Surfinol 104E™ manufactured by Nisshin Kagaku Co.) were mixed with distilled water to make the total amount of the resultant mixutre 60 kg. The mixture was dispersed with zirconia beads having a diameter of 0.5 mm by using the horizontal sand mill (UVM-2 manufactured by IMEX Co., Ltd.).

The dispersion was dispersed untll the ratio of absorbance at 650 nm and absorbance at 750 nm (D650/750) in the spectral absorption of the dispersion became 5.0 ore more when spectral absorptiometry was conducted. The obtained dispersion was diluted with distilled water such that the concentration of the cyanine dye was 6% by mass and filtered through a filter with an average pore size of 1 μm in order to remove dusts and put into practical use.

3) Preparation of Antihalation Layer Coating Liquid

The vessel was kept at 40° C. and charged with 40 g of gelatin, 20 g of monodispersed fine polymethyl methacrylate particles having an average particle size of 8 μm and a particle size standard deviation of 0.4, 0.1 g of benzoisothiazolinone, and 490 ml of water and gelatin was dissolved. Further, 2.3 ml of a 1 mol/l aqueous solution of sodium hydroxide, 40 g of the fine solid dye particle liquid dispersion, 90 g of fine solid particle liquid dispersion of the base precursor (a), 12 ml of a 3% aqueous solution of sodium polystyrenesulfonate and 180 g of a 10% SBR latex were mixed with the resultant solution. 80 ml of a 4% aqueous solution of N,N-ethylene bis(vinylsulfoneacetoamide) was mixed with the resultant mixture just before coating to prepare an antihalation coating liquid.

4) Preparation of Back Surface Coating Liquid

A vessel was kept at 40° C. and charged with 40 g of gelatin, 35 mg of benzoisothiazolinone and 840 ml of water and gelatin was dissolved. Further, 5.8 ml of a 1 mol/l aqueous solution of sodium hydroxide, 1.5 g of liquid paraffin emulsion as a liquid paraffin, 10 ml of a 5 mass % aqueous solution of sodium di(2-ethylhexyl)sulfosuccinate, 20 ml of a 3 mass % aqueous solution of sodium polystyrenesulfonate, 2.4 ml of a 2 mass % solution of fluorinated surfactant (F-3), 2.4 ml of a 2 mass % solution of fluorianted surfactant (F-4), and 32 g of a 19 mass % solution of a methyl methacrylate/styrene/butyl acrylate/hydroxyethyl methacrylate/acrylic acid copolymer (copolymerization mass ratio: 57/8/28/5/2) latex were mixed with the resultant solution. Just before coating, 25 ml of a 4 mass % aqueous solution of N,N-ethylene bis(vinylsulfoneacetamide) was mixed with the resultant mixture to prepare a coating liquid for a protecting layer of the back surface.

5) Coating of Back Layer

The back surface of the undercoated support was simultaneously coated with the antihalation layer coating liquid such that the gelatin coating amount was 0.52 g/m$^2$ and the coating liquid for the protective layer on the back surface such that the gelatin coating amount was 1.7 g/m$^2$, simultaneously and the coatings were dried and a back layer was prepared.

Image Forming Layer, Intermediate Layer and Surface Protective Layer

1. Preparation of Coating Material

1) Silver Halide Emulsion

Preparation of Silver Halide Emulsion 1

A solution obtained by adding 3.1 ml of a 1 mass % potassium iodide solution, 3.5 ml of sulfuric acid having a concentration of 0.5 mol/l and 31.7 g of gelatin phthalide to 1421 ml of distilled water was kept at 30° C. in a stainless steel reactor while the solution was stirred. 95.4 ml of a solution A containing 22.22 g of silver nitrate diluted with distilled water, and 97.4 ml of a solution B containing 15.3 g of potassium bromide and 0.8 g of potassium iodide diluted with distilled water were added to the above solution at constant flow rates over 45 seconds. Then, 10 ml of a 3.5 mass % aqueous solution of hydrogen peroxide and 10.8 ml of a 10 mass % aqueous solution of benzoimidazole were added to the above solution. Next, 317.5 ml of a solution C containing 51.86 g of silver nitrate diluted with distilled water, and 400 ml of a solution D containing 44.2 g of potassium bromide and 2.2 g of potassium iodide diluted with distilled water were added to the resultant by a controlled double jet method. At this time, the solution C was added thereto over 20 minutes at a constant flow rate. Meanwhile, the solution D was added thereto so that pAg of the system was kept at 8.1. When 10 minutes lapsed from the start of the addition of the solutions C and D to the system, $1\times10^{-4}$ mols, per mol of silver in the system, of potassium hexachloroiridate(III) was added to the system. When five seconds lapsed from the end of the addition of the solution C, $3\times10^{-4}$ mols, per mol of silver in the system, of an aqueous iron (II) potassium hexacyanide solution was added to the system. Sulfuric acid (0.5 mol/liter) was added to the system to adjust the pH of the system at 3.8. Then, stirring the system was stopped, and steps of precipitating, desalting and washing with water were conducted. Sodium hydroxide (1 mol/liter) was added to the system to adjust the pH of the system at 5.9. A silver halide dispersion having pAg of 8.0 was thus prepared.

The silver halide dispersion was kept at 38° C. while the dispersion was stirred. Five ml of a 0.34 mass % methanol solution of 1,2-benzoisothiazoline-3-one was added to the dispersion. 40 minutes later, the resultant dispersion was heated to 47° C. When 20 minutes lapsed after the heating, $7.6\times10^{-5}$ mol, per mol of silver, of sodium benzenethiosulfonate was added to the resultant in the form of a methanol solution thereof. Five minutes later, $2.9\times10^{-4}$ mol, per mol of silver, of a tellurium sensitizer C was added to the resultant in the form of a methanol solution thereof and the resultant was aged for 91 minutes. Then, a methanol solution of a spectral sensitizing dye A and a sensitizing dye B at a molar ratio of 3:1 was added to the resultant so that the total amount of the sensitizing dyes A and B was $1.2\times10^{-3}$ mol per mol of silver. One minute later, 1.3 ml of a 0.8 mass % methanol solution of N,N'-dihydroxy-N",N"-diethylmelamine was added to the resultant. Further 4 minutes later, 5-methyl-2-mercaptobenzoimidazole was added to the resultant system in the form of a methanol solution thereof in an amount of $4.8\times10^{-3}$ mol per mol of silver and 1-phenyl-2-heptyl-5-mercapto-1,3,4-triazole was added to the system in the form of a methanol solution thereof in an amount of $5.4\times10^{-3}$ mol per mol of silver and 1-(3-methylureidophenyl-5-mercapto-tetrazole was added to the system in the form of an aqueous solution thereof in an amount of $8.5\times10^{-3}$ mol per mol of silver to prepare silver halide emulsion 1.

The particles in the silver halide emulsion thus prepared were silver iodobromide particles homogeneously containing 3.5 mol % of iodide and having an average sphere-equivalent diameter of 0.042 μm and a fluctuation coefficient of a sphere equivalent diameter of 20%. The particle size and the like were determined by sampling 1000 particles, measuring the particle sizes thereof with an electron microscope and obtaining the average the particle sizes. The {100} face ratio of the particles was determined by the Kubelka-Munk method and was 80%.

Preparation of Silver Halide Emulsion 2

A silver halide emulsion 2 was prepared in the same manner as the preparation of silver halide emulsion 1, except that the liquid temperature at the time of particle formation was changed from 30° C. to 47° C., that 97.4 ml of a solution B including 15.9 g of potassium bromide diluted with distilled water and 400 ml of a solution D including 45.8 g of potassium bromide diluted with distilled water were used, that the addition time of the solution C was changed to 30 minutes, that iron (II) potassium hexacyanide was eliminated, that the addition amount of the tellurium sensitizer C was changed to $1.1\times10^{-4}$ mol per mol of silver, that the total addition amount of the methanol solution of the spectra sensitizing dyes A and B at a molar ratio of 3:1 was changed to $7.0\times10^{31\ 4}$ mol per mol of silver, that the addition amount of 1-phenyl-2-heptyl-5-mercapto-1,3,4-triazole was changed to $3.3\times10^{-3}$ mol per mol of silver, and that the addition amount of 1-(3-methylureidophenyl)-5-mercaptotetrazole was changed to $4.7\times10^{-3}$ mol per mol of silver. The emulsion particles of the silver halide emulsion 2 were pure silver bromide cubic particles with an average sphere-equivalent diameter of 0.080 μm and a fluctuation coefficient of the sphere-equivalent diameter of 20%.

Preparation of Silver Halide Emulsion 3

A silver halide emulsion 3 was prepared in the same manner as the preparation of the silver halide emulsion 1 except that the liquid temperature at the time of particle formation was changed from 30° C. to 27° C., that the addition of the spectral sensitizing dyes A and B was conducted in the form of a solid dispersion thereof (aqueous gelatin solution) at a molar ratio of 1:1 in a total amount of $6\times10^{-3}$ mol per mol of silver, that the addition amount of the tellurium sensitizing agent C was changed to $5.2\times10^{-4}$ mol per mol of silver, and that $5\times10^{31\ 4}$ mol, per mol of silver, of bromoauric acid and $2\times10^{-3}$ mol, per mol of silver, of potassium thiocyanate were added to the system when 3 minutes lapsed after the addition of the tellurium sensitizing agent. The emulsion particles of the silver halide emulsion 3 were silver iodobromide particles homogeneously containing 3.5 mol % of iodide and having an average sphere-equivalent diameter of 0.034 μm and a fluctuation coefficient of sphere-equivalent diameter of 20%.

Preparation of Mixed Emulsion A for Coating Liquid 70 mass % of the silver halide emulsion 1, 15 mass % of the silver halide emulsion 2 and 15 mass % of silver halide emulsion 3 were melted, and $7\times10^{-3}$ mol, per mol of silver, of a 1 mass % aqueous solution of benzothiazolium iodide was added to the resultant solution. Further, water was added to the resultant mixture such that the content of silver in the silver halide per kg of the mixed emulsion for coating liquid was 38.2 g. Then, 0.34 g, per kg of the mixed emulsion for coating liquid, of 1-(3-methylureidophenyl)-5-mercaptotetarzole was added to the resultant mixture.

2) Preparation of Dispersion of Silver Salt of Fatty Acid

Preparation of Dispersion A of Silver Salt of Fatty Acid 87.6 kg of behenic acid (Edenor C22-85 R™ available from Henkel Corporation), 423 liters of distilled water, 49.2 liters of an aqueous NaOH solution having a concentration of 5 mol/L and 120 liters of t-butyl alcohol were mixed and reacted at 75° C. for one hour while the resultant system was stirred. Thus, a sodium behenate solution A was obtained. Separately, 206.2 liters of an aqueous solution (pH 4.0) containing 40.4 kg of silver nitrate was prepared and kept at 10° C. A reaction vessel containing 635 liters of distilled water and 30 liters of t-butyl alcohol was kept at 30° C. The entire amount of the sodium behenate solution A and the entire amount of the aqueous solution of silver nitrate were added to the content of the vessel at constant flow rates over 93 minutes and 15 seconds, and 90 minutes, respectively while the content in the vessel was sufficiently stirred. At this time, only the aqueous solution of silver nitrate was added for 11 minutes after starting the addition of the aqueous solution of silver nitrate, addition of sodium behenate solution A was started subsequently, and only the sodium behenate solution A was added for 14 minutes and 15 seconds after the completion of the addition of the aqueous solution of silver nitrate. At this time, the internal temperature of the reaction vessel was kept at 30° C. and the external temperature was controlled such that the liquid temperature was constant. The pipe line for the sodium behenate solution A was a double-walled pipe and thermally insulated by circulating hot water through the interspace of the double-walled pipe, and the temperature of the solution at the outlet of the nozzle tip was adjusted at 75° C. The pipe line for the aqueous silver nitrate solution was also a double-walled pipe and thermally insulated by circulating cold water through the interspace of the double-walled pipe. Regarding the position at which the sodium behenate solution A was added to the reaction system and that at which the aqueous silver nitrate solution was added thereto, the two were disposed symmetrically to each other relative to the shaft of the stirrer disposed in the reactor, and the nozzle tips of the pipes were spaced apart from the reaction solution level in the reactor.

After adding the sodium behenate solution A was finished, the reaction system was stirred for 20 minutes at that temperature, and then heated to 35° C. over 30 minutes. Thereafter, the system was aged for 210 minutes. Immediately after the completion of the ageing, the system was centrifugally filtered to take out a solid component, which was washed with water until the conductivity of the washing waste reached 30 μS/cm. The solid thus obtained was the silver salt of the fatty acid and was stored as wet cake without drying it.

The shapes of the silver behenate particleas obtained herein were analyzed on the basis of their images taken through electronmicroscopic photography. Average values of a, b, and c were 0.14 μm, 0.4 μm and 0.6 μm, respectively (a, b and c are defined hereinabove). The mean aspect ratio was 5.2. The average sphere-equivalent diameter of the particles and the fluctuation coefficient of the sphere-equivalent diameters were 0.52 μm and 15%, respectively. The obtained particles were scale-like crystals.

19.3 kg of polyvinyl alcohol (trade name, PVA-217) and water were added to the wet cake whose amount corresponded to 260 kg of the dry weight thereof to make the total amount of the resultant 1000 kg. The resultant was formed into slurry with a dissolver wing, and then pre-dispersed with a pipe-line mixer (Model PM-10 available from Mizuho Industry Co.).

Next, the pre-dispersed stock slurry was processed three times in a disperser (Microfluidizer M-610 obtained from Microfluidex International Corporation, and equipped with a Z-type interaction chamber) at a controlled pressure of 1260 kg/cm$^2$. A silver behenate dispersion was thus prepared. To cool it, corrugated tube type heat exchangers were disposed before and after the interaction chamber. The temperature of the coolant in these heat exchangers was so controlled that the system could be processed at a dispersion temperature of 18° C.

Preparation of Dispersion B of Silver Salt of Fatty Acid

Preparation of Recrystallized Behenic Acid 100 kg of behenic acid manufactured by Henkel Co. (Edenor C 22-85R) was mixed with 1200 kg of isopropyl alcohol, dissolved at 50° C., filtered through a 10 μm filter, and then cooled to 30° C. to recrystallize the behenic acid. The cooling rate at the time of recrystallization was controlled to 3° C./hour. The resultant crystals were centrifugally filtered, washed with 100 kg of isopropyl alcohol and then dried. The obtained crystals were esterified. GC-FID measurement was conducted, and the behenic acid content in the crystals was 96 mol %. In addition, the lignoceric acid content was 2 mol %, the archidic acid content was 2 mol % and the erucic acid content was 0.001 mol %.

Preparation of Dispersion B of Silver Salt of Fatty Acid 88 kg of the recrystallized behenic acid, 422 liters of distilled water, 49.2 liters of an aqueous NaOH solution having a concentration of 5 mol/L and 120 liters of t-butyl alcohol were mixed and reacted at 75° C. for one hour while the resultant system was stirred. Thus, a sodium behenate solution B was obtained. Separately, 206.2 liters of an aqueous solution (pH 4.0) containing 40.4 kg of silver nitrate was prepared and kept at 10° C. A reaction vessel containing 635 liters of distilled water and 30 liters of t-butyl alcohol was kept at 30° C. The entire amount of the sodium behenate solution B and the entire amount of the aqueous solution of silver nitrate were added to the content of the vessel at constant flow rates over 93 minutes and 15 seconds, and 90 minutes, respectively while the content in the vessel was sufficiently stirred. At this time, only the aqueous solution of silver nitrate was added for 11 minutes after starting the addition of the aqueous solution of silver nitrate, addition of sodium behenate solution B was started subsequently, and only the sodium behenate solution B was added for 14 minutes and 15 seconds after the completion of the addition of the aqueous solution of silver nitrate. At this time, the internal temperature of the reaction vessel was kept at 30° C. and the external temperature was controlled such that the liquid temperature was constant. The pipe line for the sodium behenate solution B was a double-walled pipe and thermally insulated by circulating hot water through the interspace of the double-walled pipe, and the temperature of the solution at the outlet of the nozzle tip was adjusted at 75° C. The pipe line for the aqueous silver nitrate solution was also a double-walled pipe and thermally insulated by circulating cold water through the interspace of the double-walled pipe. Regarding the position at which the sodium behenate solution B was added to the reaction system and that at which the aqueous silver nitrate solution was added thereto, the two were disposed symmetrically to each other relative to the shaft of the stirrer disposed in the reactor, and the nozzle tips of the pipes were spaced apart from the reaction solution level in the reactor.

After adding the sodium behenate solution B was finished, the reaction system was stirred for 20 minutes at that temperature, and then heated to 35° C. over 30 minutes. Thereafter, the system was aged for 210 minutes. Immediately after the completion of the ageing, the system was centrifugally filtered to take out a solid component, which was washed with water until the conductivity of the washing waste reached 30 μS/cm. The solid thus obtained was the silver salt of the fatty acid and was stored as wet cake without drying it.

The shapes of the silver behenate particleas obtained herein were analyzed on the basis of their images taken through electronmicroscopic photography. Average values of a, b, and c were 0.21 μm, 0.4 μm and 0.4 μm, respectively (a, b and c are defined hereinabove). The mean aspect ratio was 2.1. The fluctuation coefficient of the sphere-equivalent diameters was 11%.

19.3 kg of polyvinyl alcohol (trade name, PVA-217) and water were added to the wet cake whose amount corresponded to 260 kg of the dry weight thereof to make the total amount of the resultant 1000 kg. The resultant was formed into slurry with a dissolver wing, and then pre-dispersed with a pipe-line mixer (Model PM-10 available from Mizuho Industry Co.).

Next, the pre-dispersed stock slurry was processed three times in a disperser (Microfluidizer M-610 obtained from Microfluidex International Corporation, and equipped with a Z-type interaction chamber) at a controlled pressure of 1150 kg/cm$^2$. A silver behenate dispersion was thus prepared. To cool it, corrugated tube type heat exchangers were disposed before and after the interaction chamber. The temperature of the coolant in these heat exchangers was so controlled that the system could be processed at a dispersion temperature of 18° C.

3) Preparation of Reducing Agent Dispersion

Preparation of Reducing Agent-1 Dispersion 10 kg of a reducing agent-1 (2,2'-methylenebis-(4-ethyl-6-tert-butylphenol)), 16 kg of a 10 mass % aqueous solution of modified polyvinyl alcohol (Poval MP203 available from Kuraray) and 10 kg of water were sufficiently mixed to form slurry. The slurry was fed by a diaphragm pump into a horizontal sand mill (UVM-2 available from IMEX) including zirconia beads having a mean diameter of 0.5 mm, and dispersed therewith for 3 hours. Then, 0.2 g of benzoisothiazolinone sodium salt and water were added thereto to adjust the reducing agent concentration of the resultant at 25% by mass. The dispersion was heated at 60° C. for 5 hours. A reducing agent-i dispersion was thus prepared. The reducing agent particles in the dispersion had a median diameter of 0.40 μm, and a maximum particles size of at most 1.4 μm. The reducing agent dispersion was filtered through a polypropylene filter having a pore size of 3.0 μm to remove foreign objects such as dusts from it, and then stored.

Preparation of Reducing Agent-2 Dispersion 10 kg of a reducing agent-2 (6,6'-di-t-butyl-4,4'-dimethyl-2,2'-butylidenediphenol), 16 kg of a 10 mass % aqueous solution of modified polyvinyl alcohol (Poval MP203 available from Kuraray) and 10 kg of water were sufficiently mixed to form slurry. The slurry was fed by a diaphragm pump into a horizontal sand mill (UVM-2 available from IMEX) including zirconia beads having a mean diameter of 0.5 mm, and dispersed therewith for 3 hours and 30 minutes. Then, 0.2 g of benzoisothiazolinone sodium salt and water were added thereto to adjust the reducing agent concentration of the resultant at 25% by mass. The dispersion was then heated at 40° C. for 1 hour, and then at 80° C. for 1 hour. A reducing agent-2 dispersion was thus prepared. The reducing agent particles in the dispersion had a median diameter of 0.50 μm, and a maximum particle size of at most 1.6 μm. The reducing agent dispersion was filtered through a polypropylene filter having a pore size of 3.0 μm to remove foreign objects such as dusts from it, and then stored.

4) Preparation of Hydrogen Bonding Compound-1 Dispersion 10 kg of a hydrogen bonding compound-1 (tri(4-t-butylphenyl)phosphine oxide), 16 kg of a 10 mass % aqueous solution of modified polyvinyl alcohol (Poval MP203 available from Kuraray) and 10 kg of water were sufficiently mixed to form slurry. The slurry was fed by a diaphragm pump into a horizontal sand mill (UVM-2 available from IMEX) containing zirconia beads having a mean diameter of 0.5 mm, and dispersed therewith for 4 hours. Then, 0.2 g of benzoisothiazolinone sodium salt and water were added thereto to adjust the hydrogen bonding compound concentration of the resultant at 25% by mass. The dispersion was heated at 40° C. for 1 hour and then at 80° C. for 1 hour. A hydrogen bonding compound-1 dispersion was thus prepared. The hydrogen bonding compound particles in the dispersion had a median diameter of 0.45 μm, and a maximum particle size of at most 1.3 μm. The hydrogen bonding compound dispersion was filtered through a polypropylene filter having a pore size of 3.0 μm to remove foreign objects such as dusts from it, and then stored.

5) Preparation of Development Accelerator-1 Dispersion 10 kg of a development accelerator-1, 20 kg of a 10 mass % aqueous solution of modified polyvinyl alcohol (Poval MP203 available from Kuraray) and 10 kg of water were sufficiently mixed to form slurry. The slurry was fed by a diaphragm pump into a horizontal sand mill (UVM-2 available from IMEX) containing zirconia beads having a mean diameter of 0.5 mm, and dispersed therewith for 3 hours and 30 minutes. Then, 0.2 g of benzoisothiazolinone sodium salt and water were added thereto to prepare a development accelerator-1 dispersion having a development accelerator concentration of 20% by mass. The development accelerator particles in the dispersion had a median diameter of 0.48 μm, and a maximum particle size of at most 1.4 μm. The development accelerator dispersion was filtered through a polypropylene filter having a pore size of 3.0 μm to remove foreign objects such as dusts from it, and then stored.

Development accelerator-2 and color toning agent-1 solid dispersions having the respective concentrations of 20% by mass and 15% by mass were prepared in the same manner as the preparation of the development accelerator-1 dispersion.

6) Preparation of Polyhalogen Compound Dispersion

Preparation of Organic Polyhalogen Compound-1 Dispersion 10 kg of an organic polyhalogen compound-1 (tribromomethanesulfonylbenzene), 10 kg of a 20 mass % aqueous solution of modified polyvinyl alcohol (Poval MP203 available from Kuraray), 0.4 kg of a 20 mass % aqueous solution of sodium triisopropylnaphthalenesulfonate, and 14 kg of water were sufficiently mixed to prepare slurry. The slurry was fed by a diaphragm pump into a horizontal sand mill (UVM-2 available from IMEX) including zirconia beads having a mean diameter of 0.5 mm, and dispersed therewith for 5 hours. Then, 0.2 g of benzoisothiazolinone sodium salt and water were added thereto to prepare an organic polyhalogen compound-1 dispersion having an ogranic polyhalogen compound content of 26 mass %. The organic polyhalogen compound particles in the dispersion had a median diameter of 0.41 μm, and a maximum particle size of at most 2.0 μm. The organic polyhalogen compound dispersion was filtered through a polypropylene filter having a pore size of 10.0 μm to remove foreign objects such as dusts from it, and then stored.

Preparation of Organic Polyhalogen Compound-2 Dispersion 10 kg of an organic polyhalogen compound-2 (N-butyl-3-tribromomethanesulfonylbenzamide), 20 kg of a 10 mass % aqueous solution of modified polyvinyl alcohol (Poval MP203 available from Kuraray), and 0.4 kg of a 20 mass % aqueous solution of sodium triisopropylnaphthalenesulfonate were sufficiently mixed to prepare slurry. The slurry was fed by a diaphragm pump into a horizontal sand mill (UVM-2 available from IMEX) including zirconia beads having a mean diameter of 0.5 mm, and dispersed therewith for 5 hours. Then, 0.2 g of benzoisothiazolinone sodium salt and water were added thereto to adjust the organic polyhalogen compound content of the resultant at 30 mass %. The dispersion was heated at 40° C. for 5 hours. An organic polyhalogen compound-2 dispersion was thus obtained. The organic polyhalogen compound particles in the dispersion had a median diameter of 0.40 μm, and a maximum particle size of at most 1.3 μm. The organic polyhalogen compound dispersion was filtered through a polypropylene filter having a pore size of 3.0 μm to remove foreign objects such as dusts from it, and then stored.

7) Preparation of Phthalazine Compound-1 Solution 8 kg of modified polyvinyl alcohol MP 203 manufactured by Kuraray Co. was dissolved in 174.57 kg of water and then 3.15 kg of a 20 mass % aqueous solution of sodium triisopropylnaphthalenesulfonate and 14.28 kg of a 70 mass % aqueus solution of phthalazine compound-1 (6-phthalazine) isopropylphtalazine) were added to the resultant solution to prepare 5 mass % solution of phthalazine compound-1.

8) Preparation of Mercapto Compound

Preparation of Mercapto Compound-1 Aqueous Solution 7 g of mercapto compound-1 (1-(3-sulfophenyl)-5-mercaptotetrazole sodium salt) was dissolved in 993 g of water to form a 0.7 mass % aqueous solution.

Preparation of Mercapto Compound-2 Aqueous Solution 20 g of mercapto compound-2 (1-(3-methyleidophenyl)-5-mercaptotetrazole) was dissolved in 980 g of water to form a 2.0 mass % aqueous solution.

9) Preparation of Pigment-1 Dispersion 64 g of C.I. Pigment Blue 60, 6.4 g of Demole N availaboe from Kao Corporation and 250 g of water were sufficiently mixed to prepare slurry. 800 g of zirconia beads having a mean diameter of 0.5 mm were prepared and put into a vessel along with the slurry. The slurry in the vessel was dispersed by using a disperserer (1/4G Sand Grinder Mill available from IMEX) for 25 hours, and water was added to the slurry to prepare a pigment-1 dispersion having a pigment concentration of 5% by mass. The pigment particles in the dispersion thus prepared had a mean grain size of 0.21 μm.

11) Preparation of SBR Latex 287 g of distilled water, 7.73 g of a surfactant (Pionin A-43-S having a solid content of 48.5% and available from Takemoto Yushi), 14.06 ml of 1 mol/liter NaOH, 0.15 g of tetrasodium ethylenediaminetetraacetate, 255 g of styrene, 11.25 g of acrylic acid, and 3.0 g of tert-dodecylmercaptan were put into the polymerization reactor of a gas monomer reaction apparatus (TAS-2J Model available from Taiatsu Glass Industries). The reactor was sealed, and the content therein was stirred at 200 rpm. The internal air was exhausted via a vacuum pump, and purged a few times repeatedly with nitrogen. Then, 108.75 g of 1,3-butadiene was introduced into the reactor under pressure, and the internal temperature of the reactor was raised to 60° C. A solution in which 1.875 g of ammonium persulfate was dissolved in 50 ml of water was added to the system, and the system was stirred for 5 hour. The system was further heated to 90° C. and stirred for 3 hours. After the reaction was completed, the internal temperature was lowered to room temperature. Then, NaOH and $NH_4OH$ (both 1 mol/liter) were added to the system at a molar ratio of $Na^+$ and $NH_4^+$ of 1/5.3 so as to adjust the pH of the system at 8.4. Next, the system was filtered through a polypropylene filter having a pore size of 1.0 μm to remove foreign objects such as dusts from it, and then stored. 774.7 g of SBR latex was thus obtained. Its halide ion content was measured through ion chromatography, and the chloride ion concentration of the latex was 3 ppm. The chelating agent concentration thereof was measured through high-performance liquid chromatography, and was 145 ppm.

The mean particle size of the latex was 90 nm, Tg thereof was 17° C., the solid content thereof was 44% by mass, the equilibrium moisture content thereof at 25° C. and 60% RH was 0.6% by mass, and the ion conductivity thereof was 4.80 mS/cm. To measure the ion conductivity, a conductivity meter CM-30S available from Toa Denpa Kogyo was used. In the device, the 44 mass % latex was measured at 25° C.

11) Water-Soluble Metal Phthalocyanine Dye-1 Aqueous Solution

Preparation of Water-Soluble Metal Phthalocyanine Dye-1 Aqueous Solution

An aqueous solution containing 18.5 mass % of copper phthalocyanine derivative (C.I. Direct Blue 199) and 15 mass % of urea was prepared, and water was added to the solution just before use to adjust the content of copper phthalocyanine derivative (C.I. direct Blue 199) at 2 mass %. A water-soluble metal phthalocyanine dye-1 aqueous solution was thus obtained.

2. Preparation of Coating Liquid

1) Preparation of Image Forming Layer Coating Liquid-1

1,000 g of dispersion A of the silver salt of the fatty acid, 135 ml of water, 35 g of the pigment-1 dispersion, 19 g of the organic polyhalogen compound-1 dispersion, 58 g of the organic polyhalogen compound-2 dispersion, 162 g of the phthalazine compound-1 solution, 1060 g of the SBR latex (Tg: 17° C.) solution, 75 g of the reducing agent-1 dispersion, 75 g of the reducing agent-2 dispersion, 106 g of the hydrogen bonding compound-1 dispersion, 4.8 g of the development accelerator-1 dispersion, 9 ml of the aqueous mercapto compound-1 solution, and 27 ml of the aqueous mercapto compound-2 solution were mixed successively. 118 g of the silver halide emulsion mixture A was added to the resultant mixture just before coating. An image forming layer coating liquid 1 was thus obtained. The image forming layer coating liquid 1 was thoroughly stirred and fed as it was to a coating dye and coating was conducted by using the coating liquid.

The viscosity of the image forming layer coating liquid was 25 mPa·s at 40° C. and 60 rpm when measured by a B-type viscometer (No. 1 rotor) available from Tokyo Keiki.

The viscosities of the coating liquid at 38° C. measured by using Rheo Stress RS 150 manufactured by Haake Co. were 32, 35, 33, 26, and 17 mPa·s at a shearing rate of 0.1, 1, 10, 100, and 1000 (1/sec), respectively.

The amount of zirconium in the coating liquid was 0.32 mg per g of silver.

2) Preparation of Image Forming Layer Coating Liquid-2

1,000 g of dispersion B of the silver salt of the fatty acid, 135 ml of water, 36 g of the pigment-1 dispersion, 25 g of the organic polyhalogen compound-1 dispersion, 39 g of the organic polyhalogen compound-2 dispersion, 171 g of the phthalazine compound-1 solution, 1060 g of the SBR latex solution (Tg: 17° C.), 153 g of the reducing agent-2 dispersion, 55 g of the hydrogen bonding compound-1dispersion, 4.8 g of the development accelerator-1 dispersion, 5.2 g of the development accelerator-2 dispersion, 2.1 g of the color toning agent-1 dispersion, 8 ml of the aqueous mercapto compound-2 solution were mixed successively. 140 g of the silver halide emulsion mixture A was added to the resultant mixture just before coating. An image forming layer coating liquid 2 was thus obtained. The image forming layer coating liquid 2 was thoroughly stirred and was fed as it was to a coating dye and coating was conducted by using this coating liquid.

The viscosity of the image forming layer coating liquid 2 was 40 mPa·s at 40° C. and 60 rpm when measured by a B-type viscometer (No. 1 rotor) available from Tokyo Keiki.

The viscosities of the coating liquid at 38° C. measured by using Rheo Stress RS150 manufactured by Haake Co. were 30, 43, 41, 28, and 20 mPa·s at the shearing rate of 0.1, 1, 10, 100, and 1000 (1/sec), respectively.

The amount of zirconium in the coating liquid was 0.30 mg per g of silver.

3) Preparation of Intermediate Layer Coating Liquid 1000 g of polyvinyl alcohol PVA-205 (manufactured by Kuraray Co.), 163 g of the pigment-1 dispersion, 33 g of the water-soluble metal phthalocyanine dye-1 solution, 27 ml of a 5 mass % aqueous solution of sodium di(2-ethylhexyl) sulfosuccinate, and 4200 ml of a 19 mass % solution of a methyl methacrylate/styrene/butyl acrylate/hydroxyethyl methacrylate/acrylic acid copolymer (copolymerization mass ratio: 57/8/28/5/2), 27 ml of a 5 mass % aqueous solution of aerosol OT (manufactured by American Cyanamid Co.) and 135 ml of a 20 mass % aqueous solution of diammonium phthalate were mixed and water was added to the resultant mixture to make the total amount 10000 g. The pH of the resultant was adjusted at 7.5 with addition of NaOH to form an intermediate layer coating liquid. Ths coating liquid was fed to a coating die and coating was conducted to obtain a coating amount of 8.9 ml/m$^2$.

The viscosity of the coating liquid was 58 mPa·s when measured at 40° C. and 60 rpm by a B-type viscometer (No. 1 rotor)

4) Preparation of a First Surface Protective Layer Coating Liquid-1

100 g of inert gelatin and 10 mg of benzoisothiazolinone were dissolved in 840 ml of water. 180 g of a 19 mass % solution of a methyl methacrylate/styrene/butyl acrylate/hydroxyethyl methacrylate/acrylic acid copolymer (copolymerization weight ratio: 57/8/28/5/2) latex, 46 ml of a 15 mass % methanol solution of phthalic acid, and 5.4 ml of a 5 mass % aqueous solution of sodium di(2-ethylhexyl) sulfosuccinate were added to and mixed with the resultant solution. 40 ml of a 4 mass % chrome alum was mixed with the resultant mixture just before coating by using a static mixer. The resultant mixture was fed to a coating die and coating was conducted at a coating liquid amount of 26.1 ml/m$^2$.

The viscosity of the coating liquid was 20 mPa·s when measured by a B-type viscometer (No. 1 rotor) at 40° C. and 60 rpm.

5) Preparation of a Second Surface Protective Layer Coating Liquid-1

26.8 g of inert gelatin and 10 mg of benzoisothiazolinone were dissolved in 800 ml of water. 565 g of a 19 mass % solution of a methyl methacrylate/styrene/butyl acrylate/hydroxyethyl methacrylate/acrylic acid copolymer (copolymerization weight ratio: 57/8/28/5/2) latex, 40 ml of a 15 mass % methanol solution of phthalic acid, 5.5 ml of a 1 mass % solution of a fluorinated surfactant (F-3), 5.5 ml of a 1 mass % solution of a fluorinated surfactant (F-4), 28 ml of a 5 mass % aqueous solution of sodium di(2-ethylhexyl) sulfosuccinate, 4 g of fine polymethyl methacrylate particles (average particle size of 0.7 μm), 21 g of fine polymethyl methacrylate particles (average particle size of 4.5 μm) were mixed with the resultant solution to form a second surface protective layer coating liquid, which was fed to a coating die. Then, coating was conducted such that the total coating amount of gelation and latex (corresponding to the coating amount of binder) was 0.97 g/m$^2$.

The viscosity of the coating liquid was 19 mPa·S when measured by a B-type viscometer (No. 1 rotor) at 40° C. and 60 rpm.

6) Preparation of Second Surface Protective Layer Coating Liquids-2 to 26

Latexes described in Table 1 were used instead of the latex for the second surface protective layer coating liquid-1. The coating amounts for the binders thereof were identical to that of the second surface protective layer coating liquid-1 and the ratio of the binders used in each coating liquid is shown in Table 1.

TABLE 1

| 2nd Surface protective layer coating liquid | Binder: Type of latex | Binder: Type of polymer other than latex | Binder: Latex/entire binder (mass %) | Remarks |
|---|---|---|---|---|
| 1 | MMA/St/BA/HEM/AA | gelatin | 80 | Comp. Example |
| 2 | MMA/St/BA/HEM/AAP-14 | gelatin | 85 | Invention |
| 3 | MMA/St/BA/HEM/AA | gelatin | 90 | Invention |
| 4 | MMA/St/BA/HEM/AA | gelatin | 95 | Invention |
| 5 | Urethane (P-1) | gelatin | 90 | Invention |
| 6 | Urethane (P-2) | gelatin | 90 | Invention |
| 7 | Urethane (P-3) | gelatin | 90 | Invention |
| 8 | Urethane (P-4) | gelatin | 90 | Invention |
| 9 | Urethane (P-1)<br>Urethane (P-2) | gelatin | 90<br>(P-1:P-2 = 1:1) | Invention |
| 10 | Urethane (P-3)<br>Urethane (P-4) | gelatin | 90<br>(P-3:P-4 = 1:1) | Invention |

Note)
MMA: methyl methacrylate,
St: Styrene,
BA: butyl acrylate,
HEM: hydroxyethyl methacrylate,
AA: Acrylic acid 3. Preparation of Heat-Developable Photosensitive Materials 101 to 110

1) Preparation of Heat-Developable Photosensitive Material 101

The undercoat layer of the support which layer was opposite to the back surface was simultaneously coated with he image forming layer coating liquid-1, the intermediate layer coating liquid-1, the first surface protective layer coating liquid-1, and the second surface protective layer coating liquid-1 in this order by a slide bead coating method to prepare a heat-developable photosensitive material-101. The temperature of the image forming layer coating liquid C and the intermediate layer coating liquid was ajusted at 31°, that of the first surface protective layer coating liquid was adjusted at 36° C. and that of the second surface protective layer coating liquid was adjusted at 37° C.

The coating amount (g/m$^2$) of each compound of the image forming layer is shown below.

| | |
|---|---|
| Silver behenate | 5.42 |
| Pigment (C. I. Pigment Blue 60) | 0.036 |
| Polyhalogen compound-1 | 0.12 |
| Polyhalogen compound-2 | 0.25 |
| Phthalazine compound-1 | 0.18 |
| SBR latex | 9.70 |
| Reducing agent-1 | 0.40 |
| Reducing agent-2 | 0.40 |
| Hydrogen bonding compound-1 | 0.58 |
| Development accelerator-1 | 0.02 |
| Mercapto compound-1 | 0.002 |
| Mercapto compound-2 | 0.012 |
| Silver of silver halide | 0.10 |

The coating amounts of the first and second surface protective layers are shown in Table 2. Coating and drying conditions are shown below.

Coating was conducted at a speed of 160 m/min, the gap between the coating die tip end and the support was adjusted at 0.10 to 0.30 mm, and the internal pressure in a reduced pressure chamber was set such that it was lower by 196 to 882 Pa than the atmospheric pressure. The charge of the support was eliminated by an ionic blow before coating.

In the subsequent chilling zone, the coated support was chilled with an air blow whose dry-bulb temperature was 10 to 20° C. In the next helix type contactless drying zone, the support was dried with a dry air blow whose dry-bulb temperature was 23 to 45° C., and whose wet-bulb temperature was 15 to 21° C. In this zone, the coated support to be dried was kept not in contact with the drier.

After drying, the support was conditioned at 25° C. and 40 to 60% RH, and then heated so that the surface temperature was between 70 and 90° C. After heating, the support was cooled to have a surface temperature of 25° C.

The degree of matting, in terms of the Beck's smoothness, of the image forming layer-coated surface of the heat-developable photosensitive material thus prepared was 550 seconds and Beck's smoothness of the back surface thereof was 130 seconds. The pH of the image forming-coated surface was measured and was 6.0.

2) Preparation of Heat-Developable Photosensitive Materials-102 to 110

Heat-developable photosensitive materials-102 to 110 were prepared in the same manner as the preparation of the heat-developable photosensitive material 101, except that the second surface protective layer coating liquids-2 to 10 shown in Table 1 were used, respectively, in place of the second surface protective layer coating liquid-1.

3) Preparation of Heat-Developable Photosensitive Material-201

A heat-developable photosensitive material-201 was prepared in the same manner as the preparation of the heat-developable photosensitive material-101 except that the image forming layer coating liquid-2 was used in place of the image forming layer coating liquid-1.

The coating amount (g/m$^2$) of each compound of the image forming layer is shown below.

| | |
|---|---|
| Silver behenate | 5.27 |
| Pigment (C. I. Pigment Blue 60) | 0.036 |
| Polyhalogen compound-1 | 0.14 |
| Polyhalogen compound-2 | 0.28 |
| Phthalazine compound-1 | 0.18 |
| SBR latex | 9.43 |
| Reducing agent-2 | 0.77 |
| Hydrogen bonding compound-1 | 0.28 |
| Development accelerator-1 | 0.019 |
| Development accelerator-2 | 0.016 |
| Color toning agent-1 | 0.006 |
| Mercapto compound-2 | 0.003 |
| Silver of silver halide | 0.13 |

4) Preparation of Heat-Developable Photosensitive Materials-202 to 210

Heat-developable photosensitive materials-202 to 210 were prepared in the same manner as the preparation of the heat-developable photosensitive material-201 except that the second surface protective layer coating liquids-2to 10 was used, respectively, in place of the second surface protective layer coating liquid-1.

Chemical structures of the compounds used in the example of the invention are shown below.

Spectral sensitizing dye A

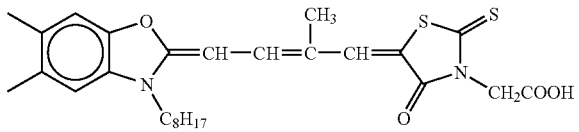

Spectral sensitizing dye B

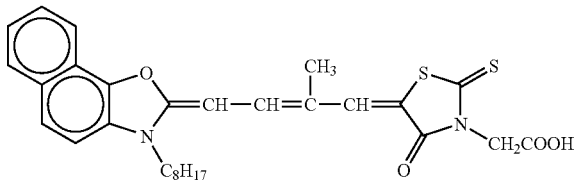

Tellurium sensitizing agent C

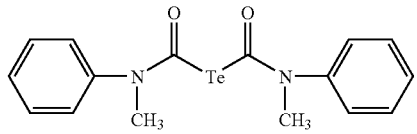

Base precursor compound-1

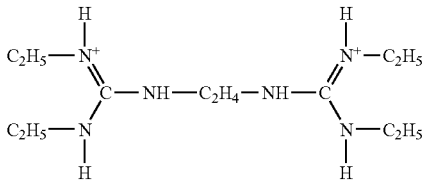

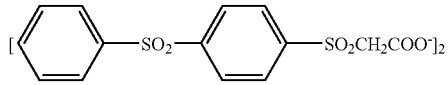

-continued
Cyanine dye compound-1
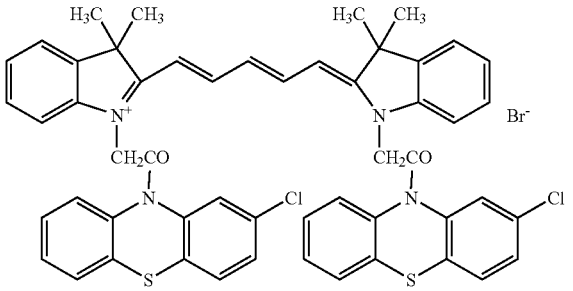
Blue dye compound-2
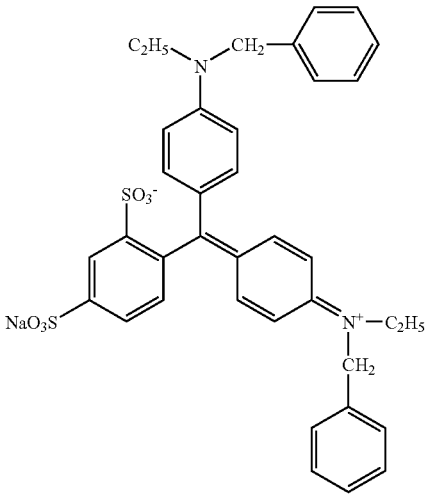
Mercapto compound-1
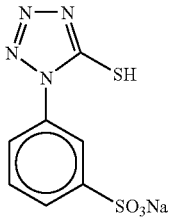
Mercapto compound-2
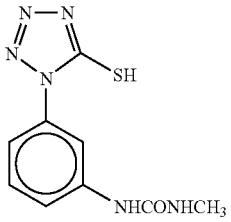
Development accelerator-1
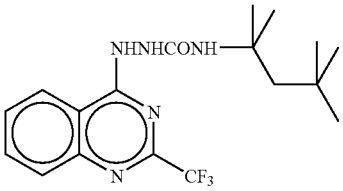
-continued
Development accelerator-2
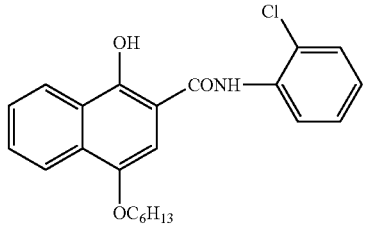
Color toning agent-1
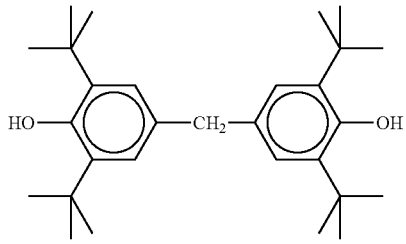
Phthalazine compound-1
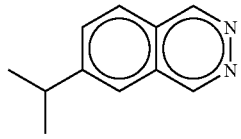
Hydrogen bonding compound-1
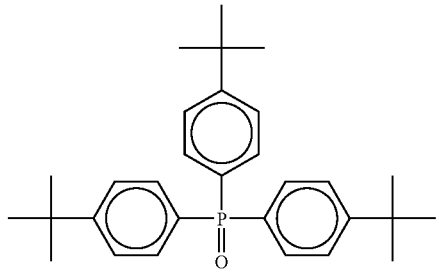
Reducing agent-1
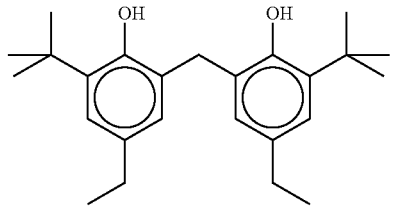
Reducing agent-2
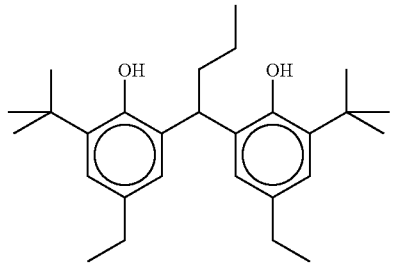
Organic polyhalogen compound-1
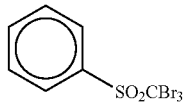

-continued

Organic polyhalogen compound-2

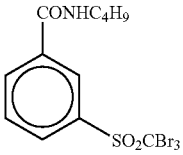

(F-3)

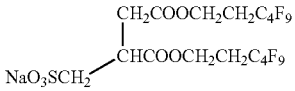

(F-4)

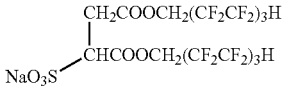

4. Evaluation of Photographic Performance

1) Preparation

Each material thus prepared was cut into pieces of a half-size, packaged with a packaging material mentioned below at 25° C. and 50% RH, stored at ordinary temperature for two weeks and tested according to the test method mentioned below.

Packaging Material

The packaging material used herein was a film comprising a PET film having a thickness of 10 μm, a PE film having a thickness of 12 μm, an aluminium foil having a thickness of 9 μm, a nylone film having a thickness of 15 μm, and a 3% carbon-containing polyethylene film having a thickness of 50 μm, and having an oxygen permeability of 0.02 ml/atm·m$^2$·25° C.·day and a moisture permeability of 0.10 g/atm·m$^2$·25° C.·day.

3) Result of Exposure and Development of Photosensitive Material

The heat-developable photosensitive materials-101 to 110 were exposed to light and thermally developed by using a Fuji medical dry laser imager FM-DPL having a semiconductor laser emitting light having a wavelength of 660 nm and having a maximum power of 60 mW (IIIB)). The thermal development was conducted for 24 seconds in total by using four panel heaters adjusted at 112° C., 119° C., 121° C., and 121° C., respectively. Then, obtained images were evaluated by using a densitometer.

The heat-developable photosensitive materials-201 to 210 were exposed to light and thermally developed by using a Fuji medical dry laser imager Drypix7000 having a semiconductor laser emitting light having a wavelength of 660 nm and having a maximum power of 50 mW (IIIB)). The thermal development was conducted for 14 seconds in total by using three panel heaters adjusted at 107° C., 121° C., and 121° C., respectively. Then, obtained images were evaluated by using a densitometer.

Images of all the photosensitive materials but the photosensitive material-4 for comparison which images were output under the conditions described above had good contrast.

4) Image Storability Test in Dark Place

This is a compulsory test to evaluate the image storability of the materials.

10 g of NaCl was dissolved in water so that the total amount was accurately 500 ml to prepare a saline. The heat-developable photosensitive materials which had been exposed to light and thermally developed were prepared. Filter paper impregnated with the saline was superimposed on and pressed against the area of each image having the lowest density for 5 seconds in a dark place. After removing the filter paper, the half of each material was stored at 50° C. and 50% RH for 7 days, and the half was compared with another half of each material.

Further, filter paper impregnated with the saline was superimposed on and pressed against the area of each image having the highest density for 5 seconds in a dark place. After removing the filter paper, the half of each material was stored at 50° C. and 50% RH for 7 days, and the half was compared with another half of each material.

The obtained materials were observed visually and judged according to the following criteria. Since the materials were evaluated under compulsory conditions, mateirals having a rank of 2 or higher have no practical problem.

Rank 4: No uneven density was recognized both in the lowest density area and the highest density area. There was no gloss uneveness on the surface of the material.

Rank 3: Slight uneven density was observed. Slight gloss uneveness was generated on the surface of the material.

Rank 2: Slight uneven density was observed. Gloss unevenness was generated on the surface of the material.

Rank 1: Uneven density was recognized distinctly both in the lowest density area and the highest density area. Gloss Uneveness was distinctly recognized.

The results are shown in Table 2 and Table 3

TABLE 2

| Heat-developable photosensitive material | Image forming layer coating liquid | Second surface protective layer coating liquid | Latex/entire binder (mass %) | Image storability | Remarks |
|---|---|---|---|---|---|
| 101 | 1 | 1 | 80 | 1 | Comp. Example |
| 102 | 1 | 2 | 85 | 2 | Invention |
| 103 | 1 | 3 | 90 | 3 | Invention |
| 104 | 1 | 4 | 95 | 4 | Invention |
| 105 | 1 | 5 | 90 | 3 | Invention |
| 106 | 1 | 6 | 90 | 3 | Invention |
| 107 | 1 | 7 | 90 | 3 | Invention |
| 108 | 1 | 8 | 90 | 3 | Invention |
| 109 | 1 | 9 | 90 (P-1:P-2 = 1:1) | 3 | Invention |
| 110 | 1 | 10 | 90 (P-3:P-4 = 1:1) | 3 | Invention |

TABLE 3

| Heat-developable photosensitive material | Image forming layer coating liquid | Second surface protective layer coating liquid | Latex/entire binder (mass %) | Image storability | Remarks |
|---|---|---|---|---|---|
| 201 | 1 | 1 | 80 | 1 | Comp. Example |
| 202 | 1 | 2 | 85 | 2 | Invention |
| 203 | 1 | 3 | 90 | 3 | Invention |
| 204 | 1 | 4 | 95 | 4 | Invention |
| 205 | 1 | 5 | 90 | 3 | Invention |
| 206 | 1 | 6 | 90 | 3 | Invention |
| 207 | 1 | 7 | 90 | 3 | Invention |
| 208 | 1 | 8 | 90 | 3 | Invention |
| 209 | 1 | 9 | 90 (P-1:P-2 = 1:1) | 3 | Invention |
| 210 | 1 | 10 | 90 (P-3:P-4 = 1:1) | 3 | Invention |

From the obtained result, it was found that, when the content of the latex polymer in the binders of the outermost layer was 85 mass % or more, heat-developable photosensitive materials having excellent image storability in a dark place could be obtained. In particularly, there was a remarkable difference between the result of the material in which the content of the latex polymer in the binders of the outermost layer was 80 mass % layer and that in which the content of the latex polymer in the binders of the outermost layer was 85 mass %. The material in which the content of the latex polymer in the binders of the outermost layer was 90 mass % had better image storability in a dark place and the material in which the content of the latex polymer in the binders of the outermost layer was 95 mass % had even more preferable image storability.

Example 2

Preparation of First Surface Protective Layer Coating Liquid-2

26.8 g of polyvinyl alcohol (PVA-217™ manufactured by Kurary) and 10 mg of benzoisothiazolinone were dissolved in 840 ml of water. 565 g of a 19 mass % solution of a methyl methacrylate/styrene/butyl acrylate/hydroxyethyl methacrylate/acrylic acid copolymer (copolymerization mass ratio: 57/8/28/5/2) latex, 46 ml of a 15 mass % methanol solution of phthalic acid, and 5.4 ml of a 5 mass % aqueous solution of sodium di(2-ethylhexyl) sulfosuccinate were added to and mixed with the resultant solution. Then, 40 ml of 4 mass % chrome alum was mixed with the resultant mixutre with a static mixer just before coating. The resultant was fed to a coating die and coating was conducted such that the coating amount was 26.1 g/m$^2$.

The viscosity of the coating liquid was 26 mPa·S when measured by a B-type viscometer (No. 1 rotor) at 40° C. and 60 rpm.

Preparation of Heat-Developable Photosensitive Material-301

A heat-developable photosensitive material-301 was prepared in the same manner as the preparation of the heat-developable photosensitive material-205, except that the first surface protective layer coating liquid-2 was used in place of the first surface protective layer coating liquid-1.

Exposure and Development

The heat-developable photosensitive material-301 was exposed to light and developed by the same method as the exposure and development method of the heat-developable photosensitive material-205

Evaluation

The image storability of the heat-developable photosensitive material-301 in a dark place was evaluated by the same method as the evaluation method of the heat-developable photosensitive material-205. The result is shown in Table 4.

TABLE 4

| Heat-developable photosensitive material | Image forming layer coating liquid | First surface protective layer coating liquid | Second surface protective layer coating liquid | Binder: Latex type | Binder: Latex/entire binder (mass %) | Image storability | Remarks |
|---|---|---|---|---|---|---|---|
| 205 | 1 | 1 | 5 | Urethane (P-1) | 90 | 3 | Invention |
| 301 | 1 | 2 | 5 | Urethane (P-1) | 90 | 2 | Invention |

The heat-developable photosensitive material-205 in which the binders of the coating liquid of the first surface protective layer adjacent to the outermost layer were gelatin (binder which gels due to temperature reduction) and the latex polymer apparanetly had a flatter coated surface than the heat-developable photosensitive material-305 in which the binders were PVA and the latex polymer. Further, the heat-developable photosensitive material-205 had better image storability in a dark place.

What is claimed is:

1. A heat-developable photosensitive material comprising a support having provided thereon an image forming layer containing a photosensitive silver halide, a non-photosensitive organic silver salt, a reducing agent, and a binder, and further an outermost layer containing a binder and a layer adjacent to the outermost layer, wherein the binder of the outermost layer includes a latex polymer, the content of which is 85 mass % or more based on the binder in the outermost layer, and the layer adjacent to the outermost layer contains a binder that gels due to temperature reduction.

2. A heat-developable photosensitive material according to claim 1, wherein the latex polymer is a urethane polymer.

3. A heat-developable photosensitive material according to claim 2, wherein the urethane polymer is an ionomer polymer.

4. A heat-developable photosensitive material according to claim 1, wherein the binder of the layer adjacent to the outermost layer contains a water-soluble polymer derived from animal protein and gels due to temperature reduction, and the content of the water-soluble polymer in the binder of the layer is 50 mass % or more.

5. A heat-developable photosensitive material according to claim 2, wherein the binder of the layer adjacent to the outermost layer contains a water-soluble polymer derived from animal protein and gels due to temperature reduction, and the content of the water-soluble polymer in the binder of the layer is 50 mass % or more.

6. A heat-developable photosensitive material according to claim 3, wherein the binder of the layer adjacent to the outermost layer contains a water-soluble polymer derived from animal protein and gels due to temperature reduction, and the content of the water-soluble polymer in the binder of the layer is 50 mass % or more.

7. A heat-developable photosensitive material according to claim 1, wherein the content of the latex polymer in the binder of the outermost layer is 85 to 95 mass %.

8. A heat-developable photosensitive material according to claim 2, wherein the content of the latex polymer in the binder of the outermost layer is 85 to 95 mass %.

9. A heat-developable photosensitive material according to claim 3, wherein the content of the latex polymer in the binder of the outermost layer is 85 to 95 mass %.

10. A heat-developable photosensitive material according to claim 4, wherein the content of the latex polymer in the binder of the outermost layer is 85 to 95 mass %.

11. A heat-developable photosensitive material according to claim 5, wherein the content of the latex polymer in the binder of the outermost layer is 85 to 95 mass %.

12. A heat-developable photosensitive material according to claim 6, wherein the content of the latex polymer in the binder of the outermost layer is 85 to 95 mass %.

* * * * *